US007258175B2

(12) United States Patent
Veeningen et al.

(10) Patent No.: US 7,258,175 B2
(45) Date of Patent: Aug. 21, 2007

(54) METHOD AND APPARATUS AND PROGRAM STORAGE DEVICE ADAPTED FOR AUTOMATIC DRILL BIT SELECTION BASED ON EARTH PROPERTIES AND WELLBORE GEOMETRY

(75) Inventors: Daan Veeningen, Houston, TX (US); Kris Givens, Stafford, TX (US); Patrick Chen, Houston, TX (US)

(73) Assignee: Schlumberger Technology Corporation, Houston, TX (US)

( * ) Notice: Subject to any disclaimer, the term of this patent is extended or adjusted under 35 U.S.C. 154(b) by 226 days.

(21) Appl. No.: 10/802,507

(22) Filed: Mar. 17, 2004

(65) Prior Publication Data

US 2005/0236184 A1 Oct. 27, 2005

(51) Int. Cl.
*E21B 47/00* (2006.01)

(52) U.S. Cl. ..... 175/40; 175/39; 175/50

(58) Field of Classification Search ..... None
See application file for complete search history.

(56) References Cited

U.S. PATENT DOCUMENTS

| | | | |
|---|---|---|---|
| 5,305,836 | A | 4/1994 | Holbrook et al. |
| 5,312,163 | A | 5/1994 | Hanamoto et al. |
| 5,794,720 | A | 8/1998 | Smith et al. |
| 6,269,892 | B1 | 8/2001 | Boulton et al. |
| 6,353,799 | B1 | 3/2002 | Meany et al. |
| 6,785,641 | B1 | 8/2004 | Huang et al. |
| 2001/0042642 | A1 | 11/2001 | King |
| 2002/0138240 | A1 | 9/2002 | Jeffrey et al. |
| 2002/0177955 | A1 | 11/2002 | Jalali et al. |

(Continued)

FOREIGN PATENT DOCUMENTS

EP 1 146 200 A1 10/2000

(Continued)

OTHER PUBLICATIONS

SPE/IADC 67816 "Meeting Future Drilling Planning and Decision Support Requirements" Copyright 2001, Feb. 27-Mar. 1, 2001.

(Continued)

*Primary Examiner*—Zakiya W. Bates
(74) *Attorney, Agent, or Firm*—John H Bruchard; J. L. Jennie Salazan

(57) ABSTRACT

A bit selection method will generate and record or display a sequence of drill bits chosen from among a plurality of bit candidates adapted for drilling an Earth formation in response to input data representing Earth formation characteristics of the formation to be drilled by: comparing the input data representing the characteristics of the formation to be drilled with a set of historical data including a plurality of sets of Earth formation characteristics and a corresponding plurality of sequences of drill bits to be used in connection with the sets of Earth formation characteristics, and locating a substantial match between the characteristics of the formation to be drilled associated with the input data and at least one of the plurality of sets of Earth formation characteristics associated with the set of historical data; when the substantial match is found, generating one of the plurality of sequences of drill bits in response thereto; and recording or displaying the one of the plurality of sequences of drill bits on a recorder or display device.

51 Claims, 43 Drawing Sheets

U.S. PATENT DOCUMENTS

| | | | |
|---|---|---|---|
| 2003/0015351 | A1 | 1/2003 | Goldman et al. |
| 2004/0149431 | A1 | 8/2004 | Wylie et al. |
| 2004/0256152 | A1 | 12/2004 | Dashavskiy et al. |

FOREIGN PATENT DOCUMENTS

| | | | |
|---|---|---|---|
| GB | 2 290 330 | A | 12/1995 |
| GB | 2 367 843 | A | 4/2002 |
| WO | WO 00/50735 | * | 8/2000 |
| WO | 03/072907 | A1 | 4/2003 |

OTHER PUBLICATIONS

Bilgesu, H.I., et al., A New Approach for the Prediction of Rate Penetration (ROP) Values, Society of Petroleum Engineers, Oct. 1997, pp. 175-179, SPE 39231.

Sinor, A. and Warren, T.M., Drag Bit Wear Model, SPE Drilling Engineering, Jun. 1989, pp. 128-136.

Irrangang, R., et al., A Case-Based System to Cut Drilling Costs, Society of Petroleum Engineers, Oct. 1999, pp. 1-17, SPE 565504.

Luo, Y., et al., Flow-Rate Predictions for Cleaning Deviated Wells, IADC/SPE, Feb. 1992, pp. 367-376, SPE 23884.

Bourgoyne, Jr., et al., Drilling Hydraulics, Applied Drilling Engineering, 1986, pp. 113-189, First Printing, Society of Petroleum Engineers, Richardson, TX.

* cited by examiner

| | Hole Section | Size | IADC | Start MD |
|---|---|---|---|---|
| | | in | | ft |
| 1 | Surface | 24.000 | 111 | 2796.00 |
| 2 | Intermediate | 22.000 | 888 | 3493.24 |
| 3 | Intermediate | 17.500 | 888 | 5648.76 |
| 4 | Intermediate | 15.000 | 888 | 7558.20 |
| 5 | Intermediate | 12.250 | 116 | 10481.43 |
| 6 | Intermediate | 12.250 | 116 | 13946.00 |
| 7 | Intermediate | 8.500 | 999 | 14339.70 |
| 8 | Production | 6.500 | 116 | 16249.15 |
| 9 | Production | 6.500 | 116 | 16642.85 |
| 10 | Production | 6.500 | 116 | 16997.18 |
| 11 | Production | 6.500 | 116 | 17361.35 |

Bit Selection

| End MD | Distance | ROP | WOB | RPM | KREV | Excess | Co |
|---|---|---|---|---|---|---|---|
| ft | ft | ft/h | lbm | | | | K$ |
| 3493.24 | 697.24 | 38.50 | 5.00 | 85.00 | 0.00 | 0.00 | |
| 5648.76 | 2155.51 | 30.20 | 10.00 | 120.00 | 130.39 | 0.00 | |
| 7558.20 | 1909.45 | 35.40 | 5.00 | 140.00 | 599.55 | 0.00 | |
| 10481.43 | 2923.23 | 25.00 | 10.00 | 100.00 | 323.64 | 0.00 | |
| 13946.00 | 3464.57 | 30.00 | 10.00 | 100.00 | 701.57 | 0.00 | |
| 14339.70 | 393.70 | 29.90 | 10.00 | 100.00 | 692.91 | 0.00 | |
| 16249.15 | 1909.45 | 35.00 | 5.00 | 120.00 | 94.80 | 0.00 | |
| 16642.85 | 393.70 | 15.00 | 15.00 | 70.00 | 229.13 | 0.00 | |
| 16997.18 | 354.33 | 15.00 | 15.00 | 70.00 | 110.24 | 0.00 | |
| 17361.35 | 364.17 | 15.00 | 15.00 | 70.00 | 99.21 | 0.00 | |
| 17735.37 | 374.02 | 15.00 | 15.00 | 70.00 | 101.97 | 0.00 | |

FIG. 15B

METHOD AND APPARATUS AND PROGRAM STORAGE DEVICE ADAPTED FOR AUTOMATIC DRILL BIT SELECTION BASED ON EARTH PROPERTIES AND WELLBORE GEOMETRY

CROSS REFERENCE TO RELATED APPLICATIONS

This application is related to pending application Ser. No. 10/802,545 filed Mar. 17, 2004, and it is related to pending application Ser. No. 10/802,524 filed Mar. 17, 2004, and it is related to pending application Ser. No. 10/802,613 filed Mar. 17, 2004, and it is related to pending application Ser. No. 10/802,622 filed Mar. 17, 2004.

BACKGROUND OF THE INVENTION

The subject matter of the present invention relates to a software system adapted to be stored in a computer system, such as a personal computer, for providing automatic drill bit selection based on Earth properties.

Minimizing wellbore costs and associated risks requires wellbore construction planning techniques that account for the interdependencies involved in the wellbore design. The inherent difficulty is that most design processes and systems exist as independent tools used for individual tasks by the various disciplines involved in the planning process. In an environment where increasingly difficult wells of higher value are being drilled with fewer resources, there is now, more than ever, a need for a rapid well-planning, cost, and risk assessment tool.

This specification discloses a software system representing an automated process adapted for integrating both a wellbore construction planning workflow and accounting for process interdependencies. The automated process is based on a drilling simulator, the process representing a highly interactive process which is encompassed in a software system that: (1) allows well construction practices to be tightly linked to geological and geomechanical models, (2) enables asset teams to plan realistic well trajectories by automatically generating cost estimates with a risk assessment, thereby allowing quick screening and economic evaluation of prospects, (3) enables asset teams to quantify the value of additional information by providing insight into the business impact of project uncertainties, (4) reduces the time required for drilling engineers to assess risks and create probabilistic time and cost estimates faithful to an engineered well design, (5) permits drilling engineers to immediately assess the business impact and associated risks of applying new technologies, new procedures, or different approaches to a well design. Discussion of these points illustrate the application of the workflow and verify the value, speed, and accuracy of this integrated well planning and decision-support tool.

The selection of Drill bits is a manual subjective process based heavily on personal, previous experiences. The experience of the individual recommending or selecting the drill bits can have a large impact on the drilling performance for the better or for the worse. The fact that bit selection is done primarily based on personal experiences and uses little information of the actual rock to be drilled makes it very easy to choose the incorrect bit for the application.

SUMMARY OF THE INVENTION

One aspect of the present invention involves a method of generating and recording or displaying a sequence of drill bits, chosen from among a plurality of bit candidates to be used, for drilling an Earth formation in response to input data representing Earth formation characteristics of the formation to be drilled, comprising the steps of: comparing the input data representing the characteristics of the formation to be drilled with a set of historical data including a plurality of sets of Earth formation characteristics and a corresponding plurality of sequences of drill bits to be used in connection with the sets of Earth formation characteristics, and locating a substantial match between the characteristics of the formation to be drilled associated with the input data and at least one of the plurality of sets of Earth formation characteristics associated with the set of historical data; when the substantial match is found, generating one of the plurality of sequences of drill bits in response thereto; and recording or displaying the one of the plurality of sequences of drill bits on a recorder or display device.

Another aspect of the present invention involves a program storage device readable by a machine tangibly embodying a program of instructions executable by the machine to perform method steps for generating and recording or displaying a sequence of drill bits, chosen from among a plurality of bit candidates, for drilling an Earth formation in response to input data representing Earth formation characteristics of the formation to be drilled, the method steps comprising: comparing the input data representing the characteristics of the formation to be drilled with a set of historical data including a plurality of sets of Earth formation characteristics and a corresponding plurality of sequences of drill bits to be used in connection with the sets of Earth formation characteristics, and locating a substantial match between the characteristics of the formation to be drilled associated with the input data and at least one of the plurality of sets of Earth formation characteristics associated with the set of historical data; when the substantial match is found, generating one of the plurality of sequences of drill bits in response thereto; and recording or displaying the one of the plurality of sequences of drill bits on a recorder or display device.

Another aspect of the present invention involves a method of selecting one or more drill bits to drill in an Earth formation, comprising the steps of: (a) reading variables and constants, (b) reading catalogs, (c) building a cumulative rock strength curve from casing point to casing point, (d) determining a required hole size, (e) finding the bit candidates that match the closest unconfined compressive strength of a rock to drill, (f) determining an end depth of a bit by comparing a historical drilling energy with a cumulative rock strength curve for all bit candidates, (g) calculating a cost per foot for each bit candidate taking into account the rig rate, trip speed and drilling rate of penetration, (h) evaluating which bit candidate is most economic, (i) calculating a remaining cumulative rock strength to casing point, and (j) repeating steps (e) to (i) until an end of the hole section is reached.

Another aspect of the present invention involves a program storage device readable by a machine tangibly embodying a program of instructions executable by the machine to perform method steps for selecting one or more drill bits to drill in an Earth formation, the method steps comprising: (a) reading variables and constants, (b) reading catalogs, (c) building a cumulative rock strength curve from casing point to casing point, (d) determining a required hole size, (e) finding the bit candidates that match the closest unconfined compressive strength of a rock to drill, (f) determining an end depth of a bit by comparing a historical drilling energy with a cumulative rock strength curve for all bit candidates, (g) calculating a cost per foot for each bit candidate taking into account the rig rate, trip speed and drilling rate of penetration, (h) evaluating which bit candidate is most economic, (i) calculating a remaining cumulative rock strength to casing point, and (j) repeating steps (e) to (i) until an end of the hole section is reached.

Another aspect of the present invention involves a method of selecting a bit to drill an Earth formation, comprising the steps of: (a) receiving a list of bit candidates and determining an average rock strength for each bit candidate; (b) determining a resultant cumulative rock strength for the each bit candidate in response to the average rock strength for the each bit candidate; (c) performing an economic analysis in connection with the each bit candidate to determine if the each bit candidate is an inexpensive bit candidate; and (d) selecting the each bit candidate to be the bit to drill the Earth formation when the resultant cumulative rock strength is greater than or equal to a predetermined value and the each bit candidate is an inexpensive bit candidate.

Another aspect of the present invention involves a program storage device readable by a machine tangibly embodying a program of instructions executable by the machine to perform method steps for selecting a bit to drill an Earth formation, the method steps comprising: (a) receiving a list of bit candidates and determining an average rock strength for each bit candidate; (b) determining a resultant cumulative rock strength for the each bit candidate in response to the average rock strength for the each bit candidate; (c) performing an economic analysis in connection with the each bit candidate to determine if the each bit candidate is an inexpensive bit candidate; and (d) selecting the each bit candidate to be the bit to drill the Earth formation when the resultant cumulative rock strength is greater than or equal to a predetermined value and the each bit candidate is an inexpensive bit candidate.

Another aspect of the present invention involves a system adapted for selecting a bit to drill an Earth formation, comprising: apparatus adapted for receiving a list of bit candidates and determining an average rock strength for each bit candidate; apparatus adapted for determining a resultant cumulative rock strength for the each bit candidate in response to the average rock strength for the each bit candidate; apparatus adapted for performing an economic analysis in connection with the each bit candidate to determine if the each bit candidate is an inexpensive bit candidate; and apparatus adapted for selecting the each bit candidate to be the bit to drill the Earth formation when the resultant cumulative rock strength is greater than or equal to a predetermined value and the each bit candidate is an inexpensive bit candidate.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION

Figure 1:
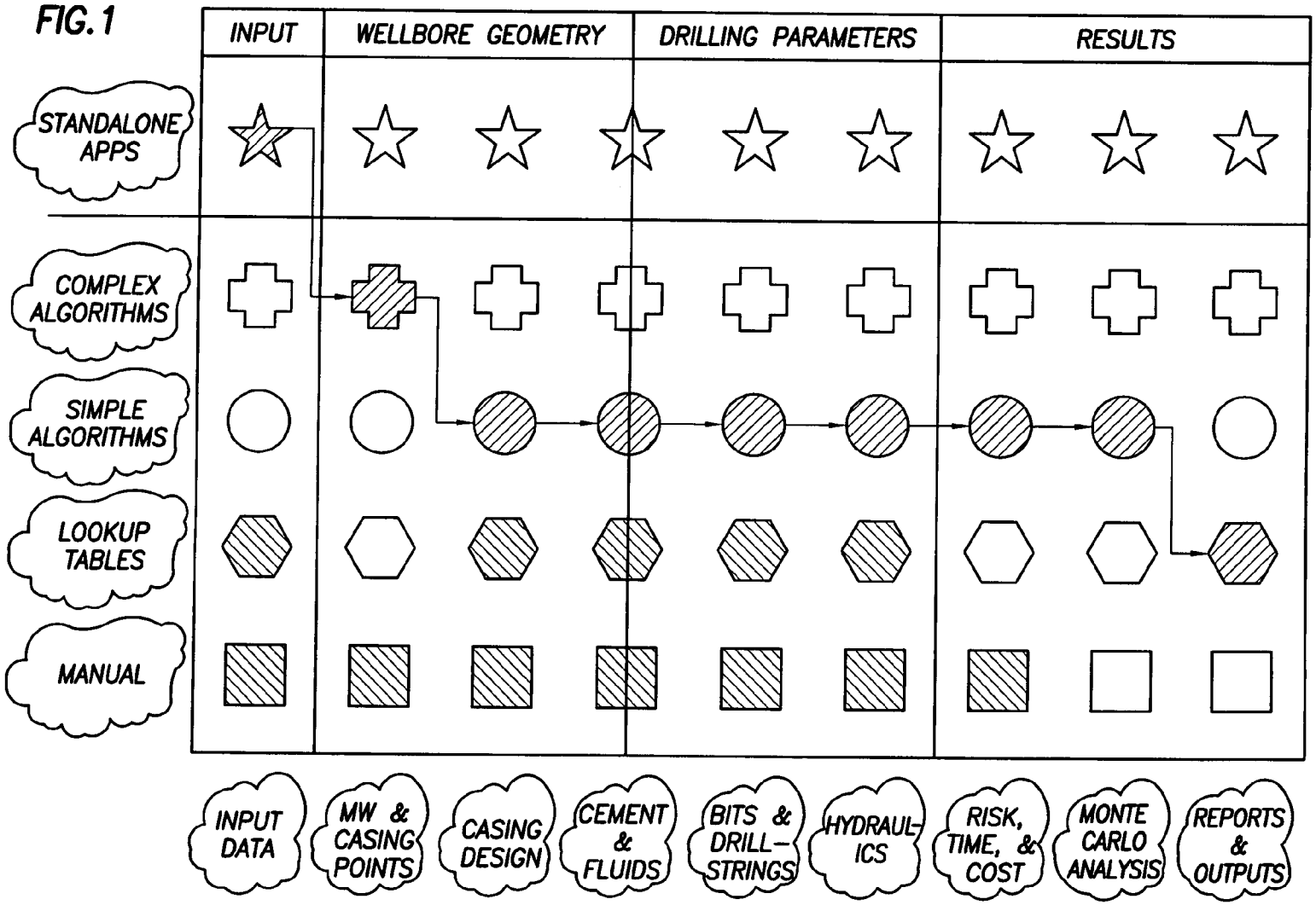
FIG. 1 illustrates a software architecture schematic indicating a modular nature to support custom workflows.

An 'Automatic Well Planning Software System' is disclosed in this specification. The 'Automatic Well Planning Software System' of the present invention is a "smart" tool for rapid creation of a detailed drilling operational plan that provides economics and risk analysis. The user inputs trajectory and earth properties parameters; the system uses this data and various catalogs to calculate and deliver an optimum well design thereby generating a plurality of outputs, such as drill string design, casing seats, mud weights, bit selection and use, hydraulics, and the other essential factors for the drilling task. System tasks are arranged in a single workflow in which the output of one task is included as input to the next. The user can modify most outputs, which permits fine-tuning of the input values for the next task. The 'Automatic Well Planning Software System' has two primary user groups: (1) Geoscientist: Works with trajectory and earth properties data; the 'Automatic Well Planning Software System' provides the necessary drilling engineering calculations; this allows the user to scope drilling candidates rapidly in terms of time, costs, and risks; and (2) Drilling engineer: Works with wellbore geometry and drilling parameter outputs to achieve optimum activity plan and risk assessment; Geoscientists typically provide the trajectory and earth properties data. The scenario, which consists of the entire process and its output, can be exported for sharing with other users for peer review or as a communication tool to facilitate project management between office and field. Variations on a scenario can be created for use in business decisions. The 'Automatic Well Planning Software System' can also be used as a training tool for geoscientists and drilling engineers.

The 'Automatic Well Planning Software System' will enable the entire well construction workflow to be run through quickly. In addition, the 'Automatic Well Planning Software System' can ultimately be updated and re-run in a time-frame that supports operational decision making. The entire replanning process must be fast enough to allow users to rapidly iterate to refine well plans through a series of what-if scenarios.

The decision support algorithms provided by the 'Automatic Well Planning Software System' disclosed in this specification would link geological and geomechanical data with the drilling process (casing points, casing design, cement, mud, bits, hydraulics, etc) to produce estimates and a breakdown of the well time, costs, and risks. This will allow interpretation variations, changes, and updates of the Earth Model to be quickly propogated through the well planning process.

The software associated with the aforementioned 'Automatic Well Planning Software System' accelerates the prospect selection, screening, ranking, and well construction workflows. The target audiences are two fold: those who generate drilling prospects, and those who plan and drill those prospects. More specifically, the target audiences include: Asset Managers, Asset Teams (Geologists, Geophysicists, Reservoir Engineers, and Production Engineers), Drilling Managers, and Drilling Engineers.

Asset Teams will use the software associated with the 'Automatic Well Planning Software System' as a scoping tool for cost estimates, and assessing mechanical feasibility, so that target selection and well placement decisions can be made more knowledgeably, and more efficiently. This process will encourage improved subsurface evaluation and provide a better appreciation of risk and target accessibility. Since the system can be configured to adhere to company or local design standards, guidelines, and operational practices, users will be confident that well plans are technically sound.

Drilling Engineers will use the software associated with the 'Automatic Well Planning Software System' disclosed in this specification for rapid scenario planning, risk identification, and well plan optimization. It will also be used for training, in planning centers, universities, and for looking at the drilling of specific wells, electronically drilling the well, scenario modeling and 'what-if' exercises, prediction and diagnosis of events, post-drilling review and knowledge transfer.

The software associated with the 'Automatic Well Planning Software System' will enable specialists and vendors to demonstrate differentiation amongst new or competing technologies. It will allow operators to quantify the risk and business impact of the application of these new technologies or procedures.

Therefore, the 'Automatic Well Planning Software System' disclosed in this specification will: (1) dramatically improve the efficiency of the well planning and drilling processes by incorporating all available data and well engineering processes in a single predictive well construction model, (2) integrate predictive models and analytical solutions for wellbore stability, mud weights & casing seat selection, tubular & hole size selection, tubular design, cementing, drilling fluids, bit selection, rate of penetration, BHA design, drillstring design, hydraulics, risk identification, operations planning, and probabilistic time and cost estimation, all within the framework of a mechanical earth model, (3) easily and interactively manipulate variables and intermediate results within individual scenarios to produce sensitivity analyses. As a result, when the 'Automatic Well Planning Software System' is utilized, the following results will be achieved: (1) more accurate results, (2) more effective use of engineering resources, (3) increased awareness, (4) reduced risks while drilling, (5) decreased well costs, and (6) a standard methodology or process for optimization through iteration in planning and execution. As a result, during the implementation of the 'Automatic Well Planning Software System' of the present invention, the emphasis was placed on architecture and usability.

In connection with the implementation of the 'Automatic Well Planning Software System', the software development effort was driven by the requirements of a flexible architecture which must permit the integration of existing algorithms and technologies with commercial-off-the-shelf (COTS) tools for data visualization. Additionally, the workflow demanded that the product be portable, lightweight and fast, and require a very small learning curve for users. Another key requirement was the ability to customize the workflow and configuration based on proposed usage, user profile and equipment availability.

The software associated with the 'Automatic Well Planning Software System' was developed using the 'Ocean' framework owned by Schlumberger Technology Corporation of Houston, Tex. This framework uses Microsoft's .NET technologies to provide a software development platform which allows for easy integration of COTS software tools with a flexible architecture that was specifically designed to support custom workflows based on existing drilling algorithms and technologies.

Referring to FIG. 1, a software architecture schematic is illustrated indicating the 'modular nature' for supporting custom workflows. FIG. 1 schematically shows the modular architecture that was developed to support custom workflows. This provides the ability to configure the application based on the desired usage. For a quick estimation of the time, cost and risk associated with the well, a workflow consisting of lookup tables and simple algorithms can be selected. For a more detailed analysis, complex algorithms can be included in the workflow.

In addition to customizing the workflow, the software associated with the 'Automatic Well Planning Software System' was designed to use user-specified equipment catalogs for its analysis. This ensures that any results produced by the software are always based on local best practices and available equipment at the project site. From a usability perspective, application user interfaces were designed to allow the user to navigate through the workflow with ease.

Figure 2:
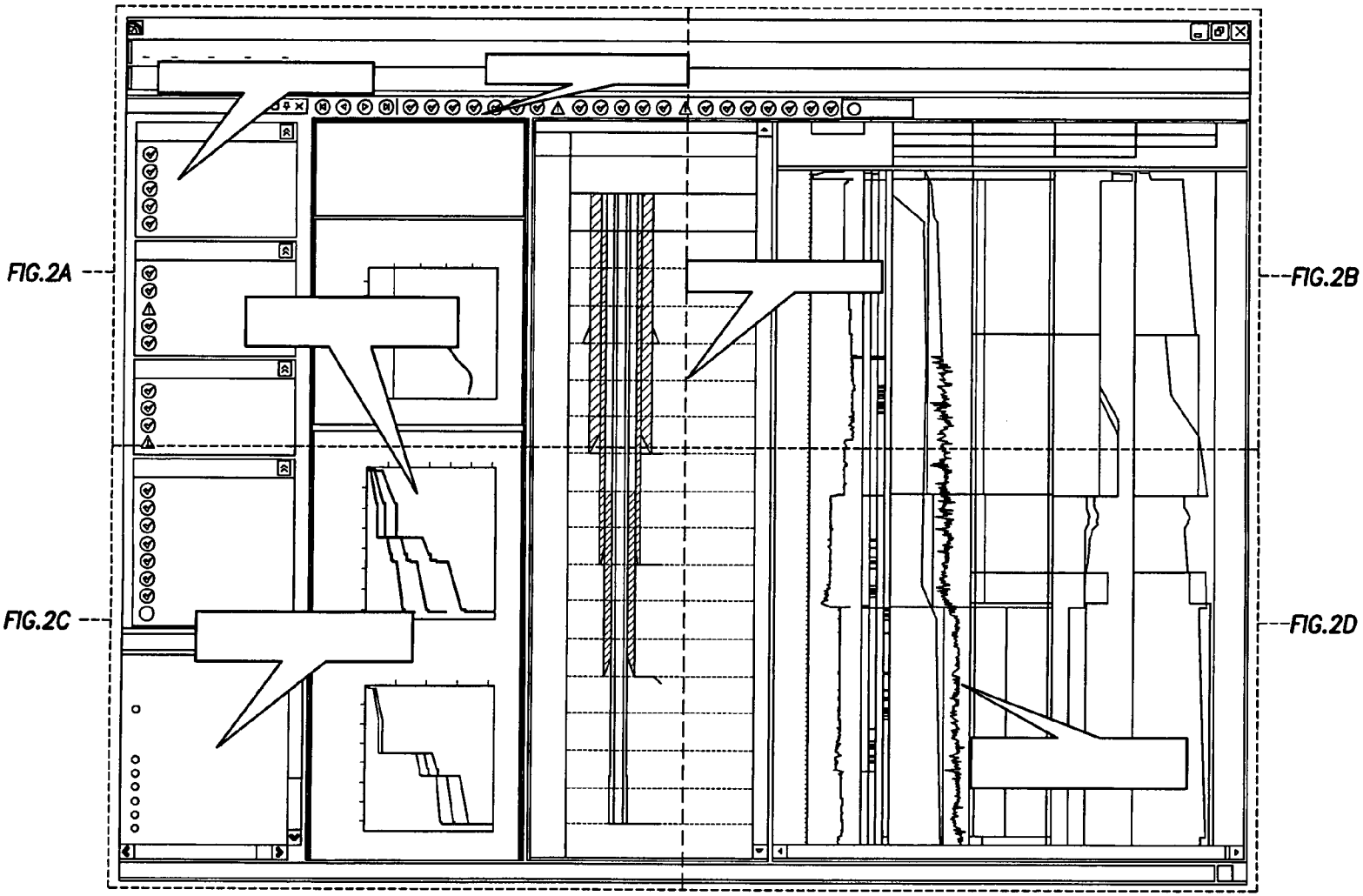
FIG. 2 including
Figure 2A:
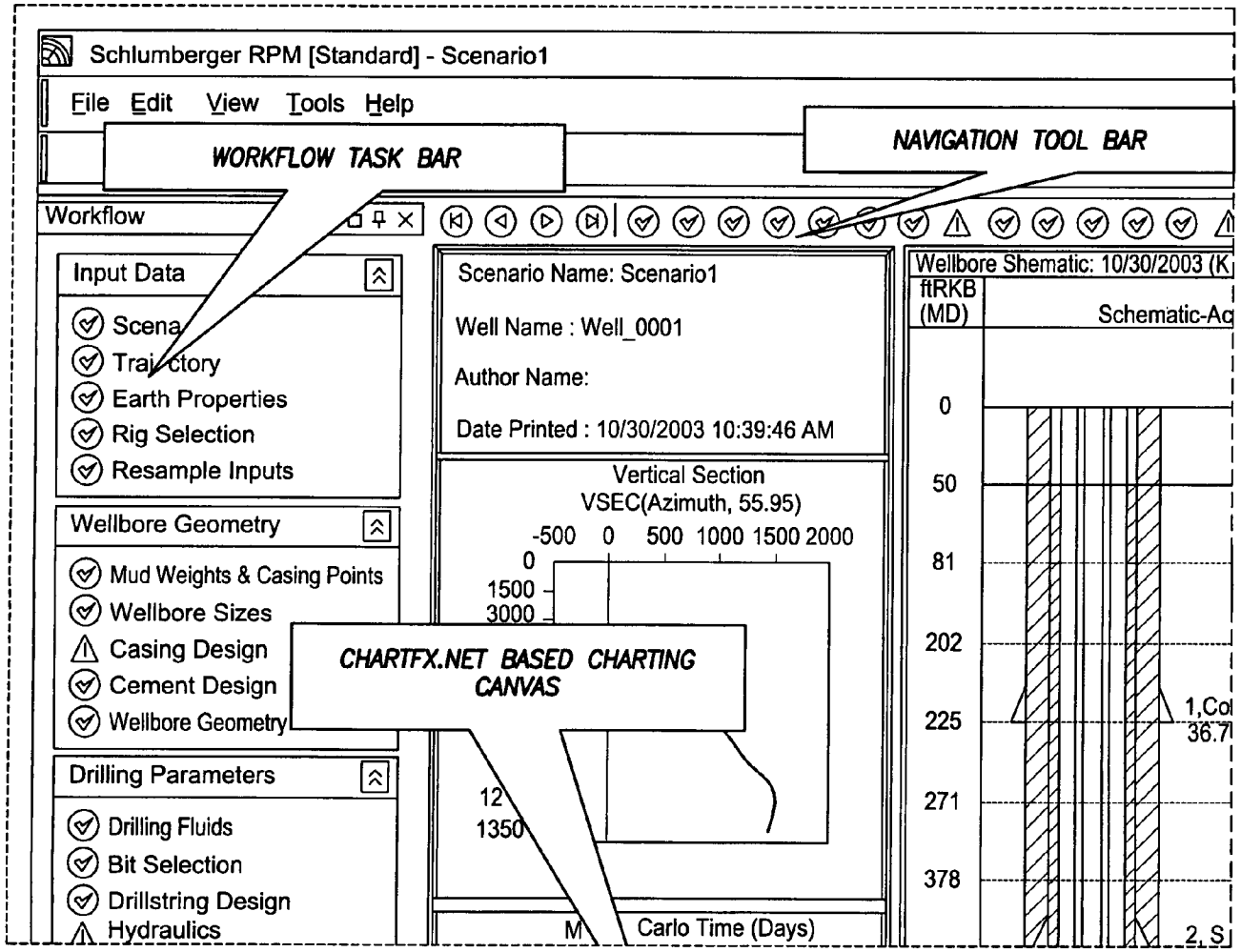
FIGS. 2A, 2B, 2C, and 2D illustrates a typical task view consisting of workflow, help and data canvases.
Figure 2B:
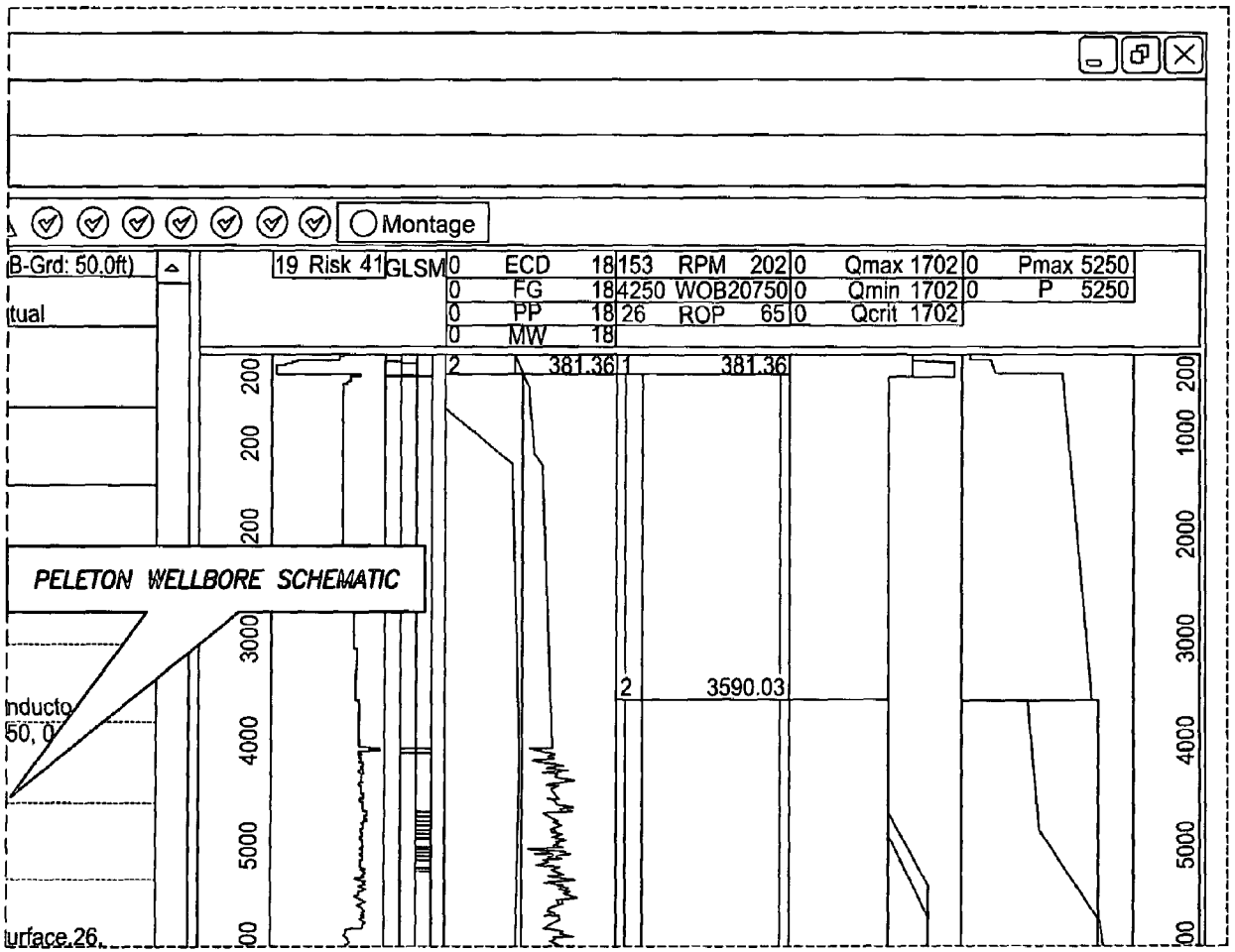
Figure 2C:
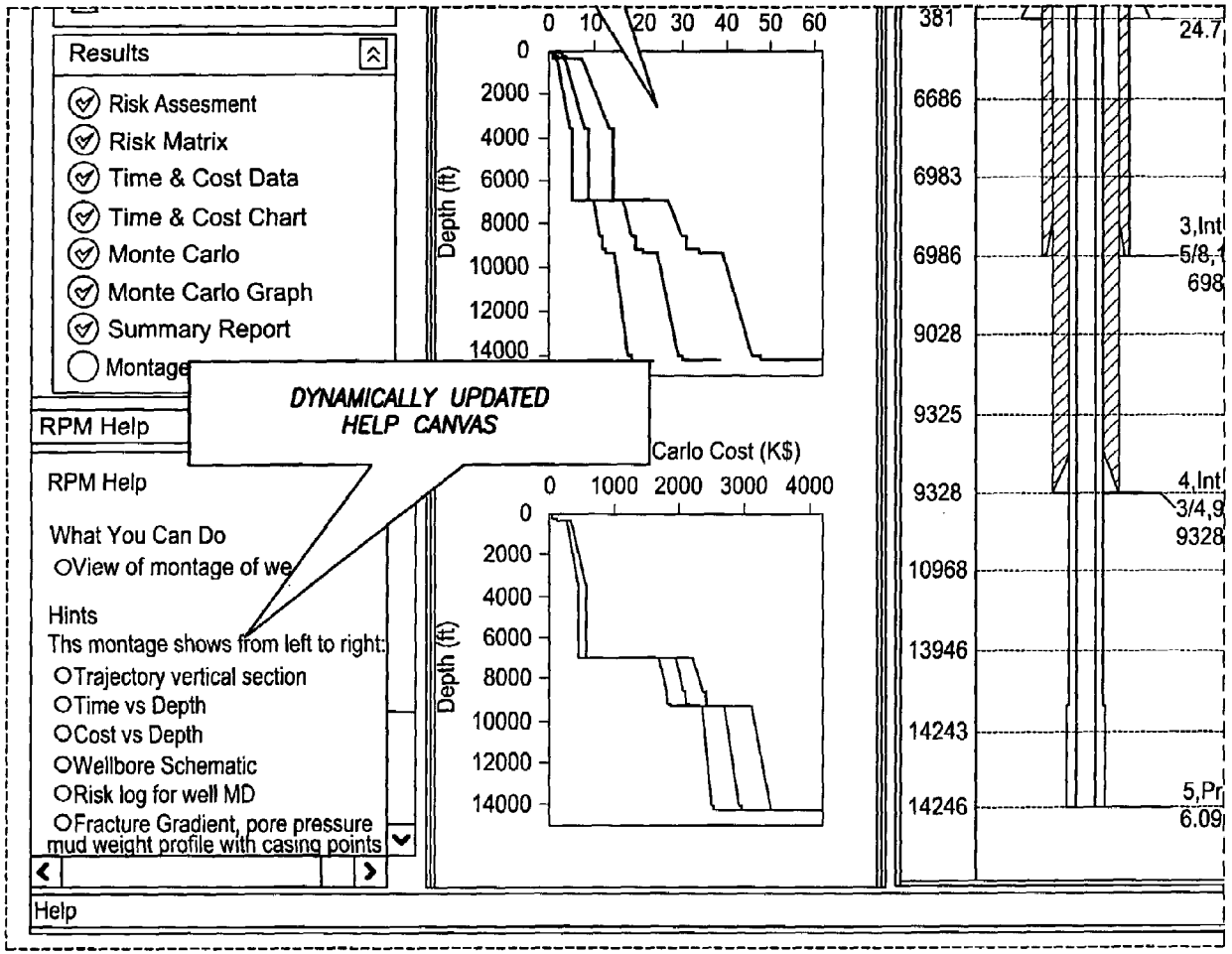
Figure 2D:
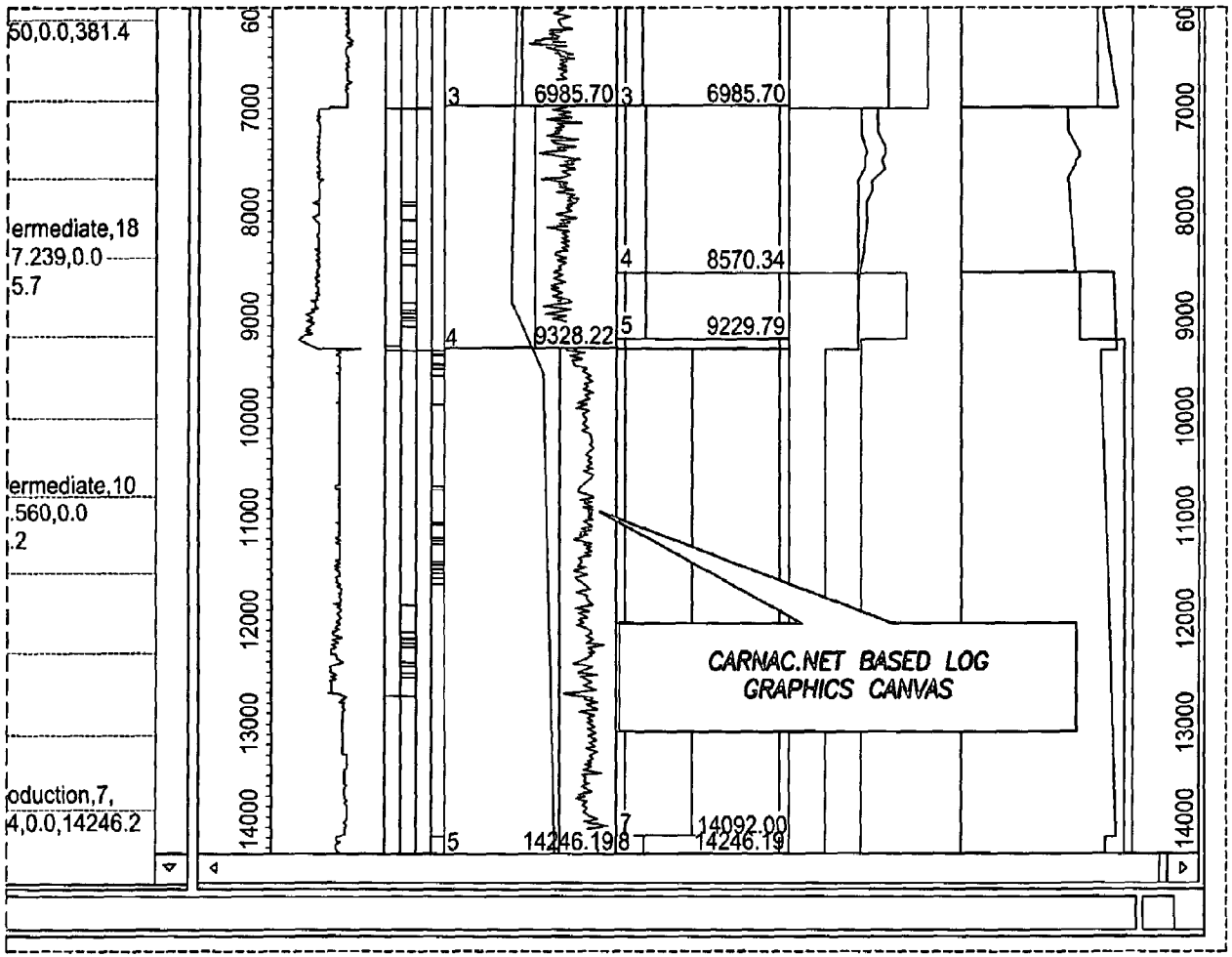

Referring to FIG. 2, a typical task view consisting of workflow, help and data canvases is illustrated. FIG. 2 shows a typical task view with its associated user canvases. A typical task view consists of a workflow task bar, a dynamically updating help canvas, and a combination of data canvases based on COTS tools like log graphics, Data Grids, Wellbore Schematic and charting tools. In any task, the user has the option to modify data through any of the canvases; the application then automatically synchronizes the data in the other canvases based on these user modifications.

The modular nature of the software architecture associated with the 'Automatic Well Planning Software System' also allows the setting-up of a non-graphical workflow, which is key to implementing advanced functionality, such as batch processing of an entire field, and sensitivity analysis based on key parameters, etc.

Basic information for a scenario, typical of well header information for the well and wellsite, is captured in the first task. The trajectory (measured depth, inclination, and azimuth) is loaded and the other directional parameters like true vertical depth and dogleg severity are calculated automatically and graphically presented to the user.

The 'Automatic Well Planning Software System' disclosed in this specification requires the loading of either geomechanical earth properties extracted from an earth model, or, at a minimum, pore pressure, fracture gradient, and unconfined compressive strength. From this input data, the 'Automatic Well Planning Software System' automatically selects the most appropriate rig and associated properties, costs, and mechanical capabilities. The rig properties include parameters like derrick rating to evaluate risks when running heavy casing strings, pump characteristics for the hydraulics, size of the BOP, which influences the sizes of the casings, and very importantly the daily rig rate and spread rate. The user can select a different rig than what the 'Automatic Well Planning Software System' proposed and can modify any of the technical specifications suggested by the software.

Other wellbore stability algorithms (which are offered by Schlumberger Technology Corporation, or Houston, Tex.) calculate the predicted shear failure and the fracture pressure as a function of depth and display these values with the pore pressure. The 'Automatic Well Planning Software System' then proposes automatically the casing seats and maximum mud weight per hole section using customizable logic and rules. The rules include safety margins to the pore pressure and fracture gradient, minimum and maximum lengths for hole sections and limits for maximum overbalance of the drilling fluid to the pore pressure before a setting an additional casing point. The 'Automatic Well Planning Software System' evaluates the casing seat selection from top-to-bottom and from bottom-to-top and determines the most economic variant. The user can change, insert, or delete casing points at any time, which will reflect in the risk, time, and cost for the well.

Figure 3:
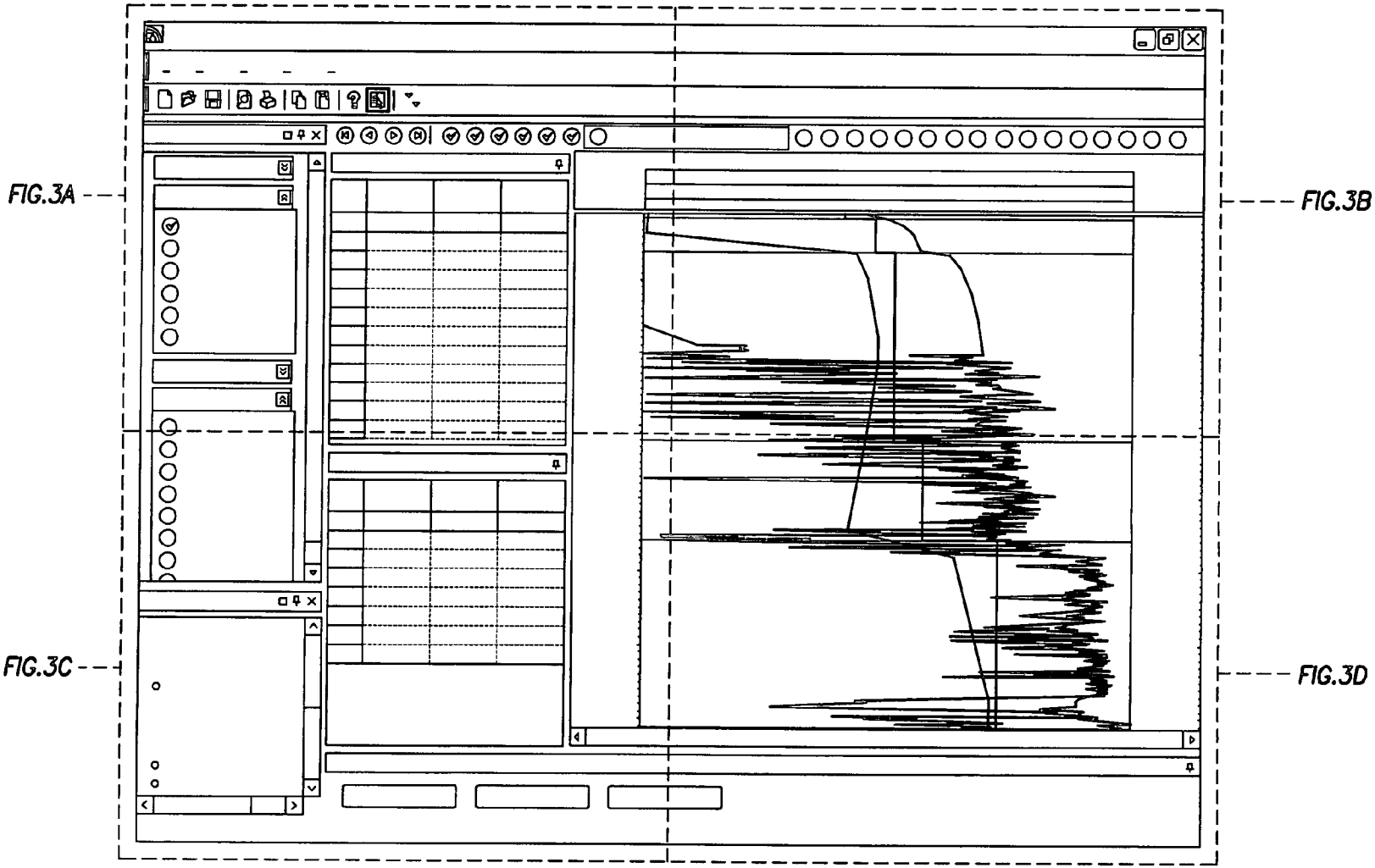
FIG. 3 including
Figure 3A:
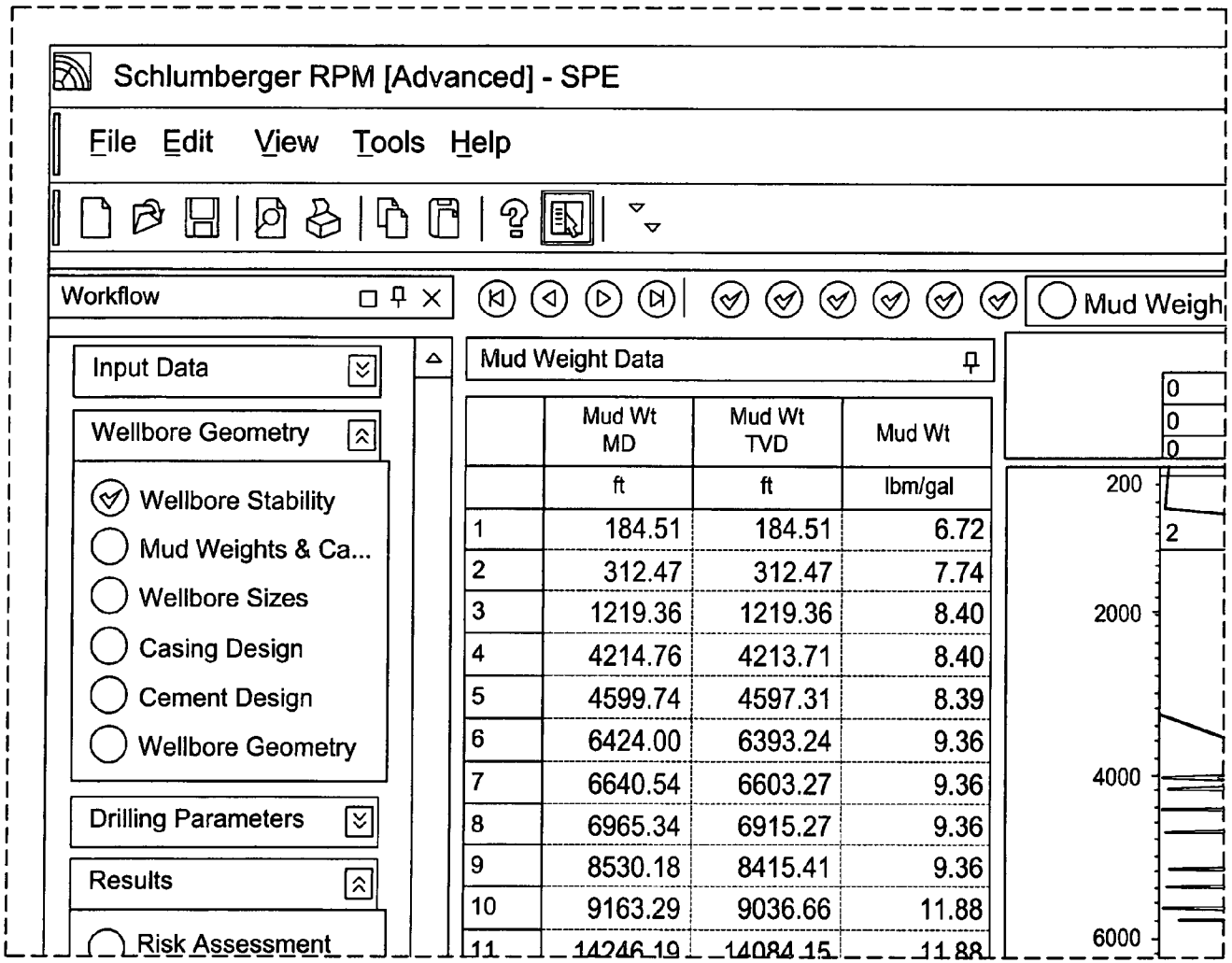
FIGS. 3A, 3B, 3C, and 3D illustrates wellbore stability, mud weights, and casing points.
Figure 3B:
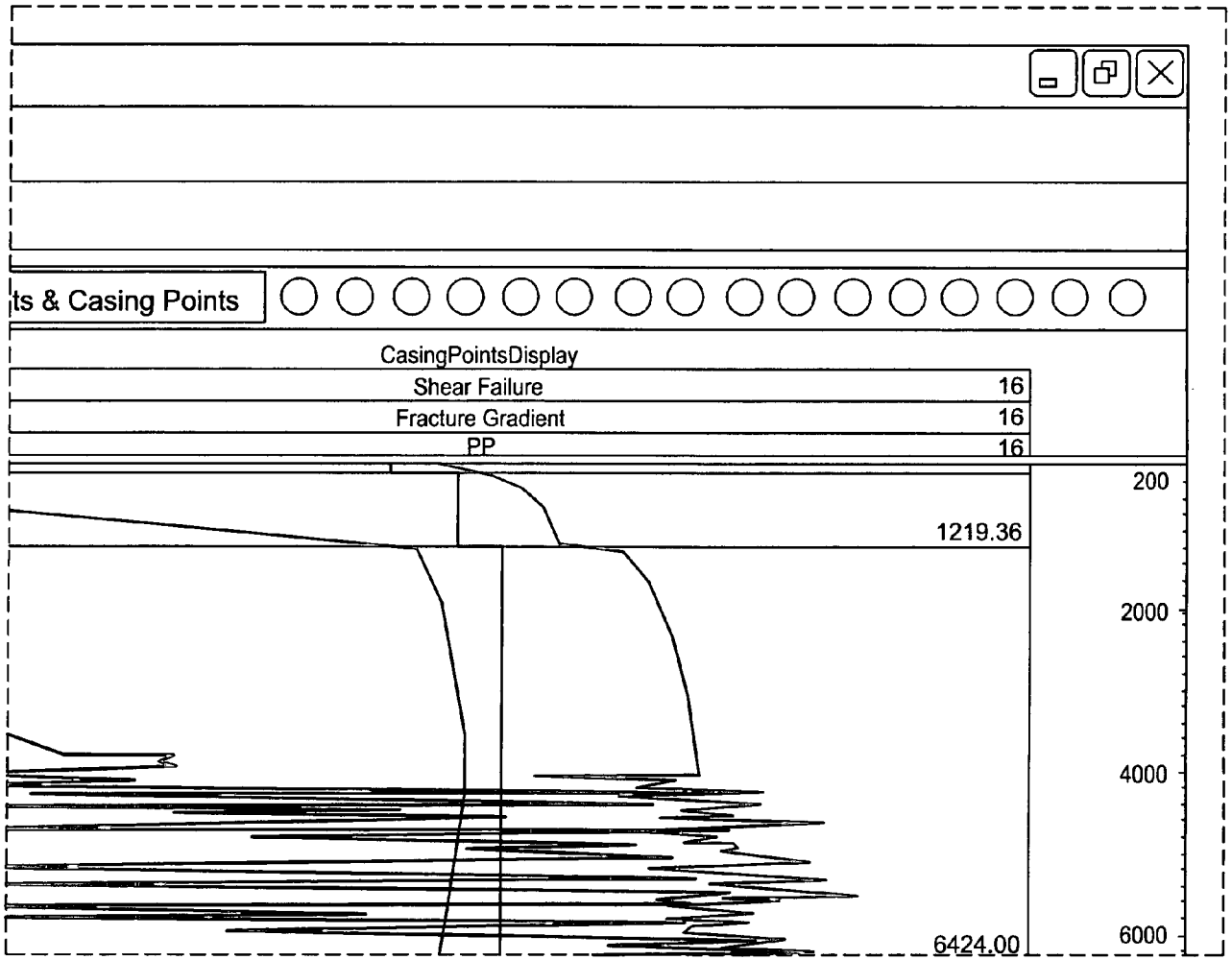
Figure 3C:
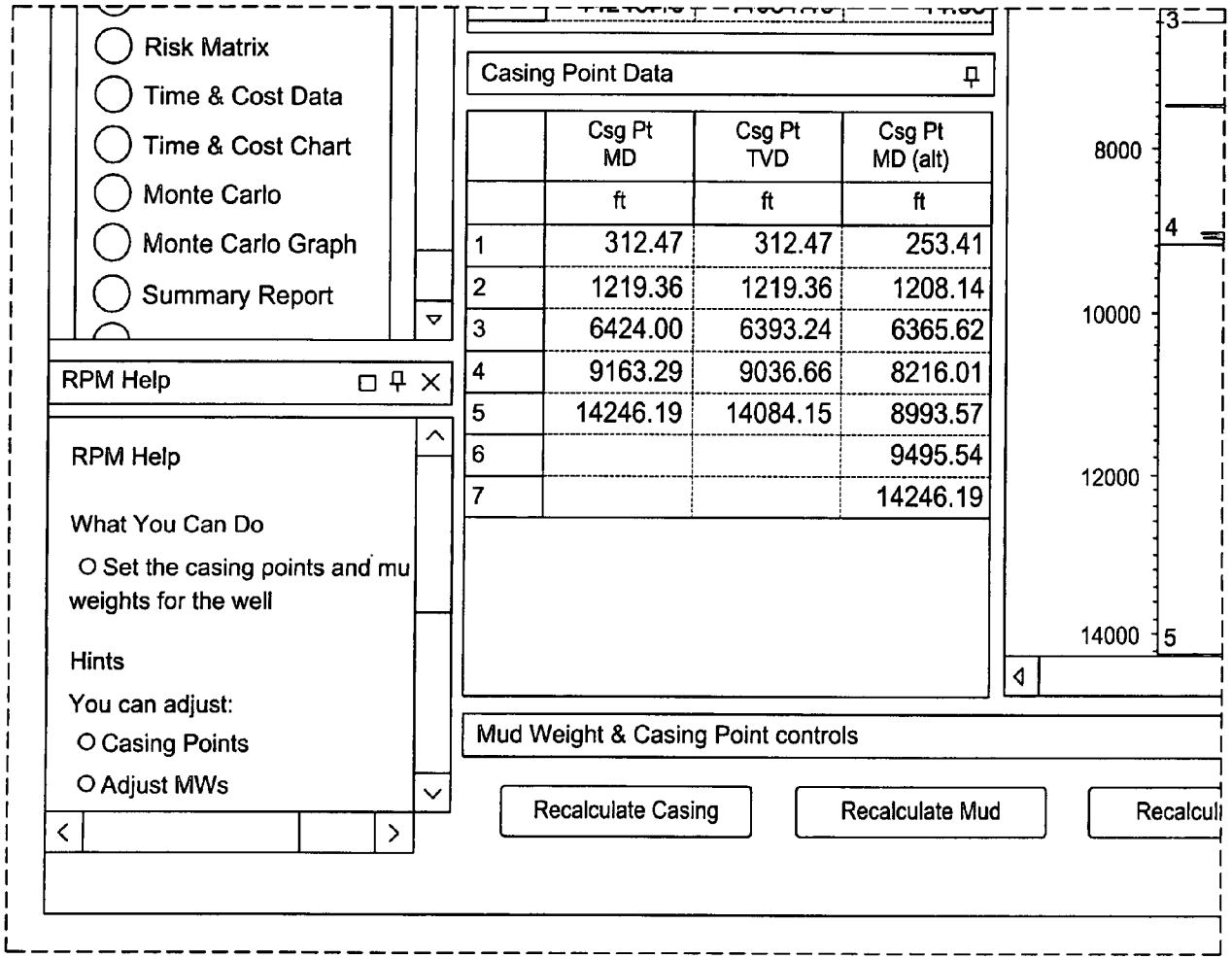
Figure 3D:
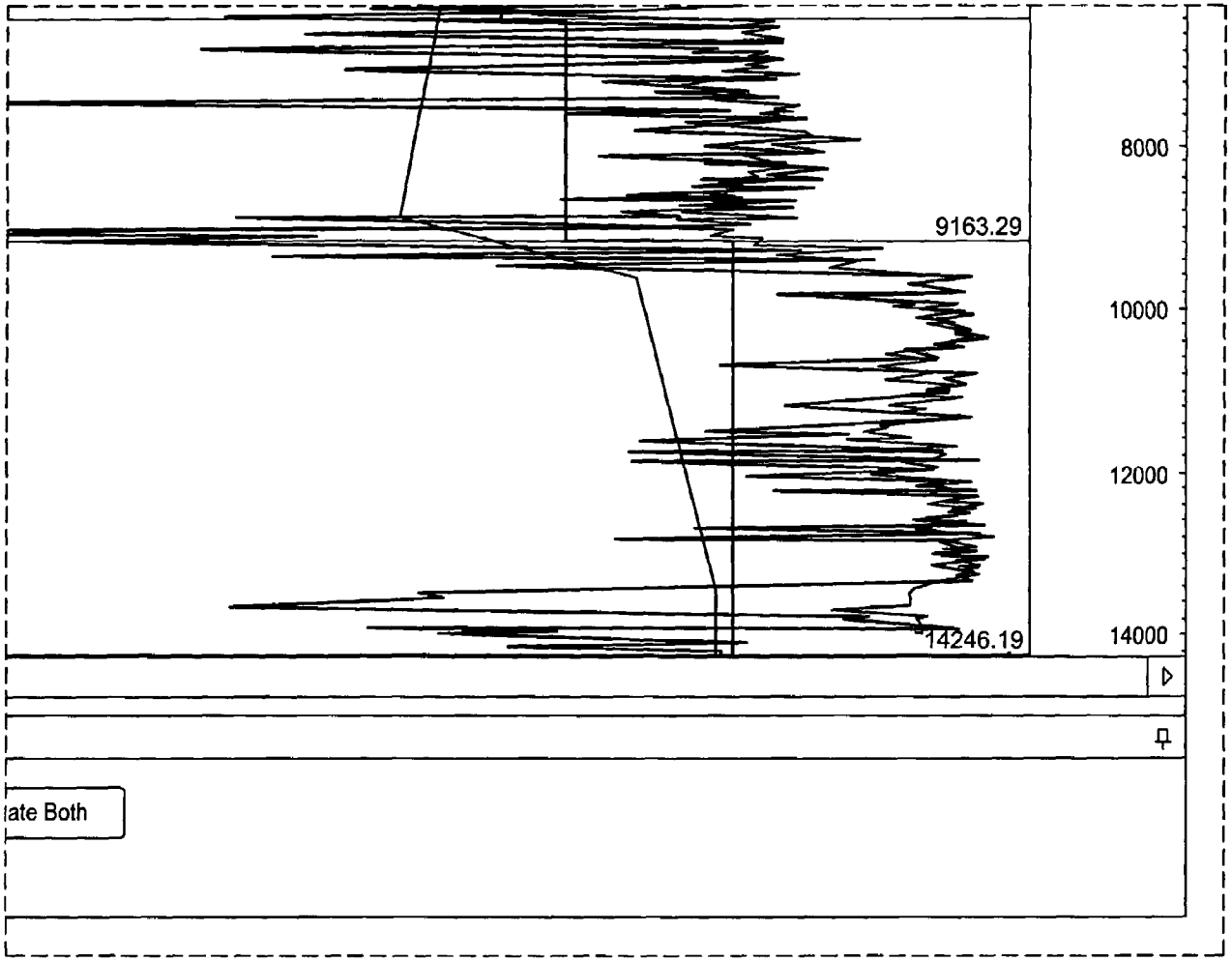

Referring to FIG. 3, a display showing wellbore stability, mud weights, and casing points is illustrated.

The wellbore sizes are driven primarily by the production tubing size. The preceding casing and hole sizes are determined using clearance factors. The wellbore sizes can be restricted by additional constraints, such as logging requirements or platform slot size. Casing weights, grades, and connection types are automatically calculated using traditional biaxial design algorithms and simple load cases for burst, collapse and tension. The most cost effective solution is chosen when multiple suitable pipes are found in the extensive tubular catalog. Non-compliance with the minimum required design factors are highlighted to the user, pointing out that a manual change of the proposed design may be in order. The 'Automatic Well Planning Software System' allows full strings to be replaced with liners, in which case, the liner overlap and hanger cost are automatically suggested while all strings are redesigned as necessary to account for changes in load cases. The cement slurries and placement are automatically proposed by the 'Automatic Well Planning Software System'. The lead and tail cement tops, volumes, and densities are suggested. The cementing hydrostatic pressures are validated against fracture pressures, while allowing the user to modify the slurry interval tops, lengths, and densities. The cost is derived from the volume of the cement job and length of time required to place the cement.

The 'Automatic Well Planning Software System' proposes the proper drilling fluid type including rheology properties that are required for hydraulic calculations. A sophisticated scoring system ranks the appropriate fluid systems, based on operating environment, discharge legislation, temperature, fluid density, wellbore stability, wellbore friction and cost. The system is proposing not more than 3 different fluid systems for a well, although the user can easily override the proposed fluid systems.

A new and novel algorithm used by the 'Automatic Well Planning Software System' selects appropriate bit types that are best suited to the anticipated rock strengths, hole sizes, and drilled intervals. For each bit candidate, the footage and bit life is determined by comparing the work required to drill the rock interval with the statistical work potential for that bit. The most economic bit is selected from all candidates by evaluating the cost per foot which takes into account the rig rate, bit cost, tripping time and drilling performance (ROP). Drilling parameters like string surface revolutions and weight on bit are proposed based on statistical or historical data.

In the 'Automatic Well Planning Software System', the bottom hole assembly (BHA) and drillstring is designed based on the required maximum weight on bit, inclination, directional trajectory and formation evaluation requirements in the hole section. The well trajectory influences the relative weight distribution between drill collars and heavy weight drill pipe. The BHA components are automatically selected based on the hole size, the internal diameter of the preceding casings, and bending stress ratios are calculated for each component size transition. Final kick tolerances for each hole section are also calculated as part of the risk analysis.

The minimum flow rate for hole cleaning is calculated using Luo's[2] and Moore's[3] criteria considering the wellbore geometry, BHA configuration, fluid density and rheology, rock density, and ROP. The bit nozzles total flow area (TFA) are sized to maximize the standpipe pressure within the liner operating pressure envelopes. Pump liner sizes are selected based on the flow requirements for hole cleaning and corresponding circulating pressures. The Power Law rheology model is used to calculate the pressure drops through the circulating system, including the equivalent circulating density (ECD).

Figure 4:
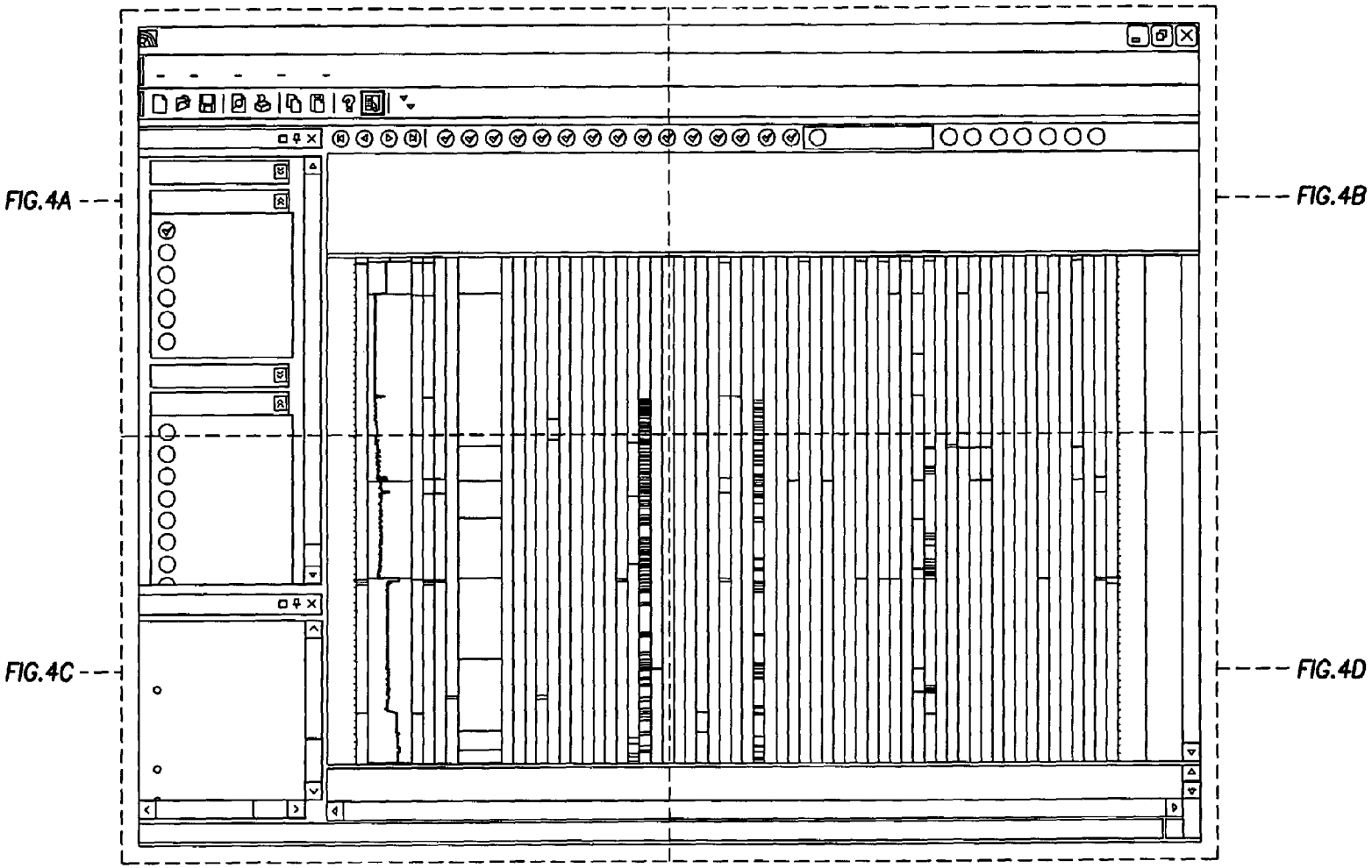
FIG. 4 including
Figure 4A:
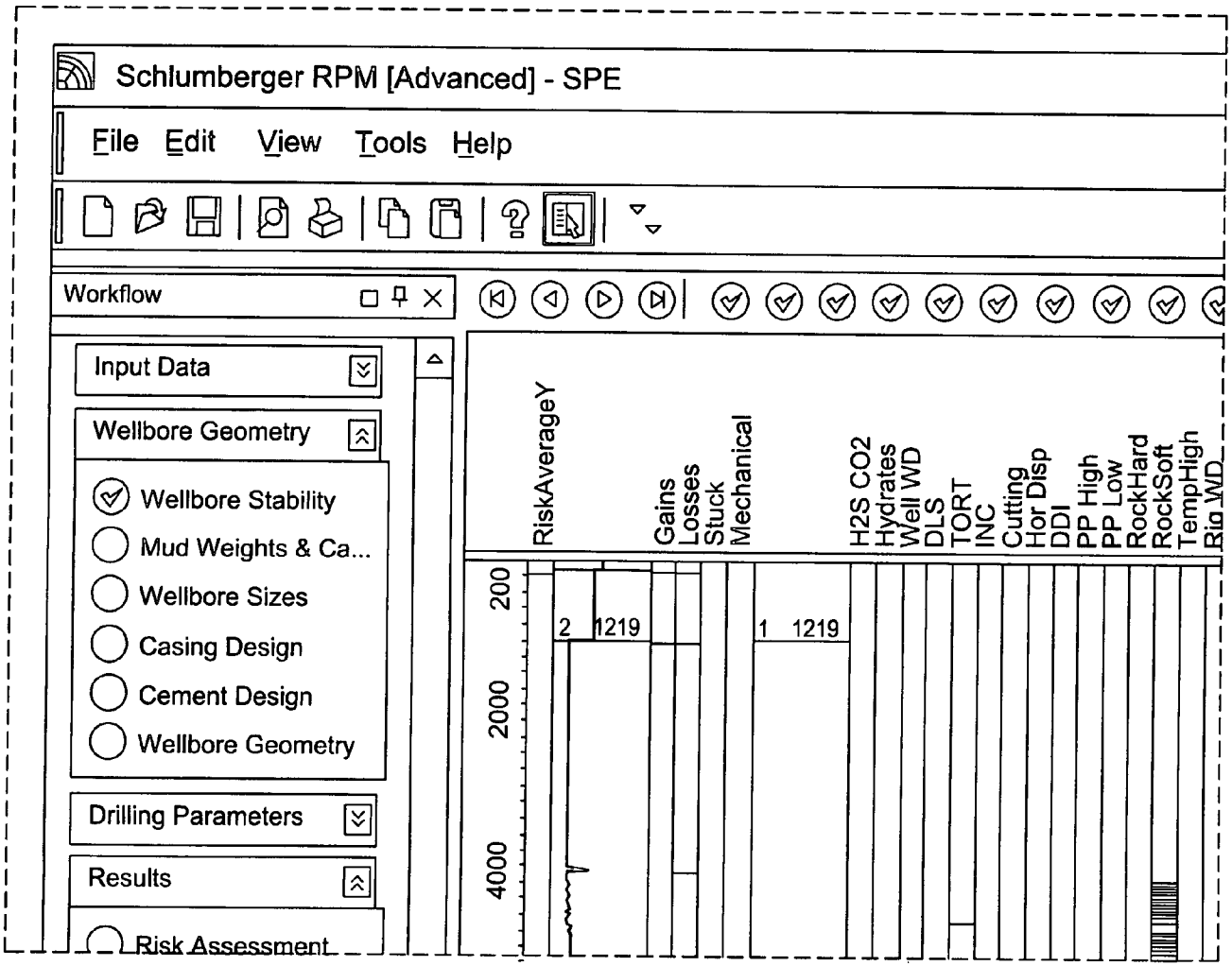
FIGS. 4A, 4B, 4C, and 4D illustrates risk assessment.
Figure 4B:
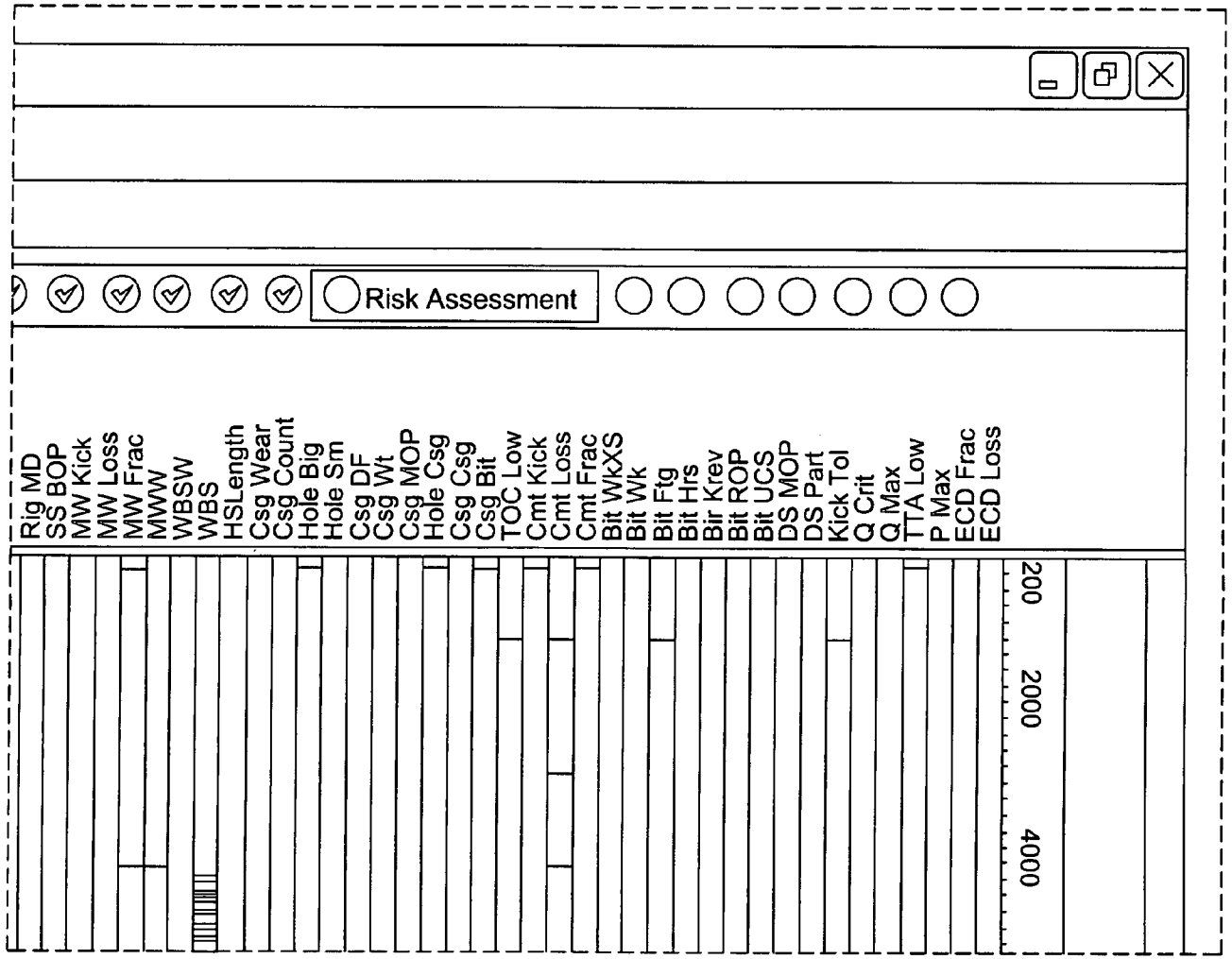
Figure 4C:
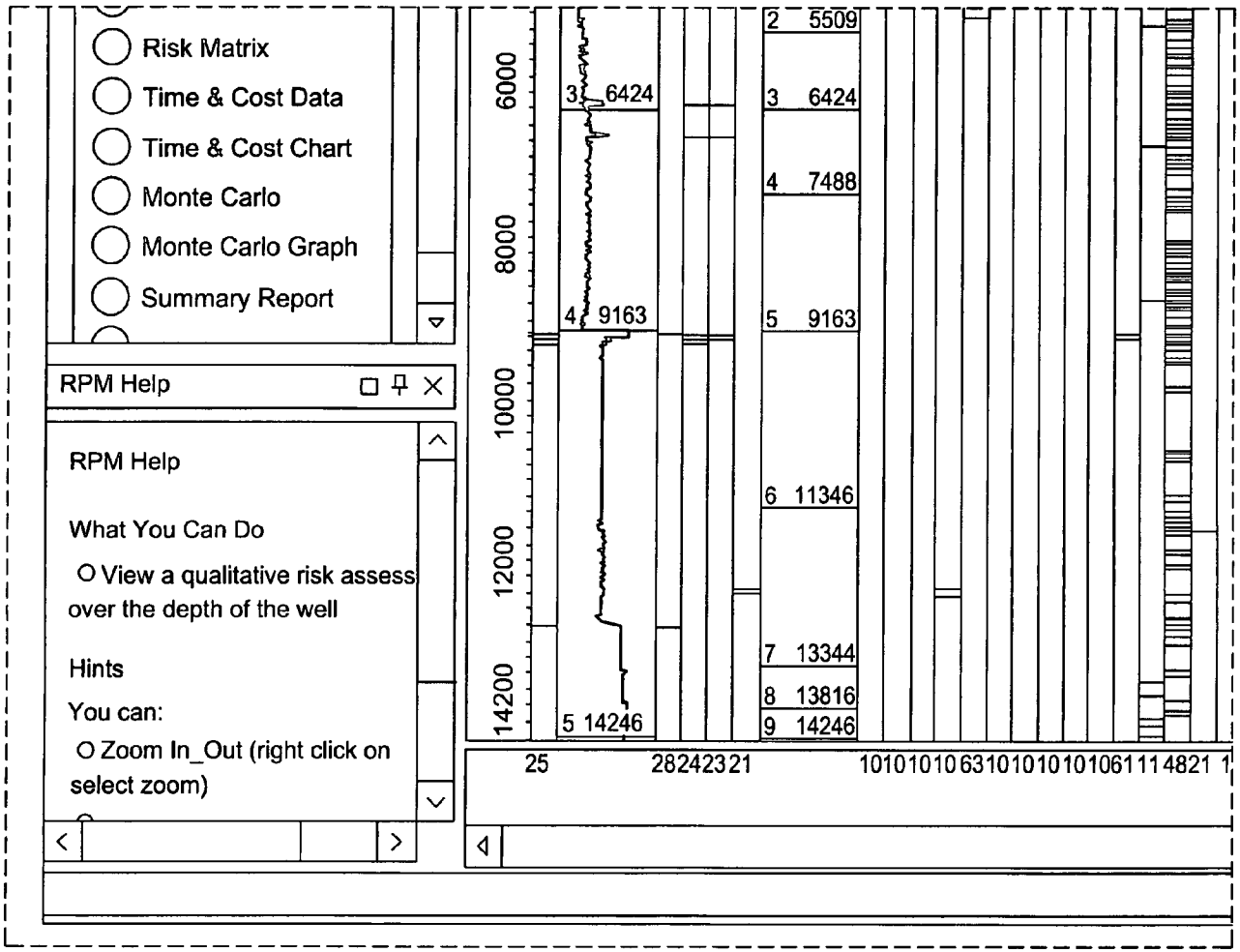
Figure 4D:
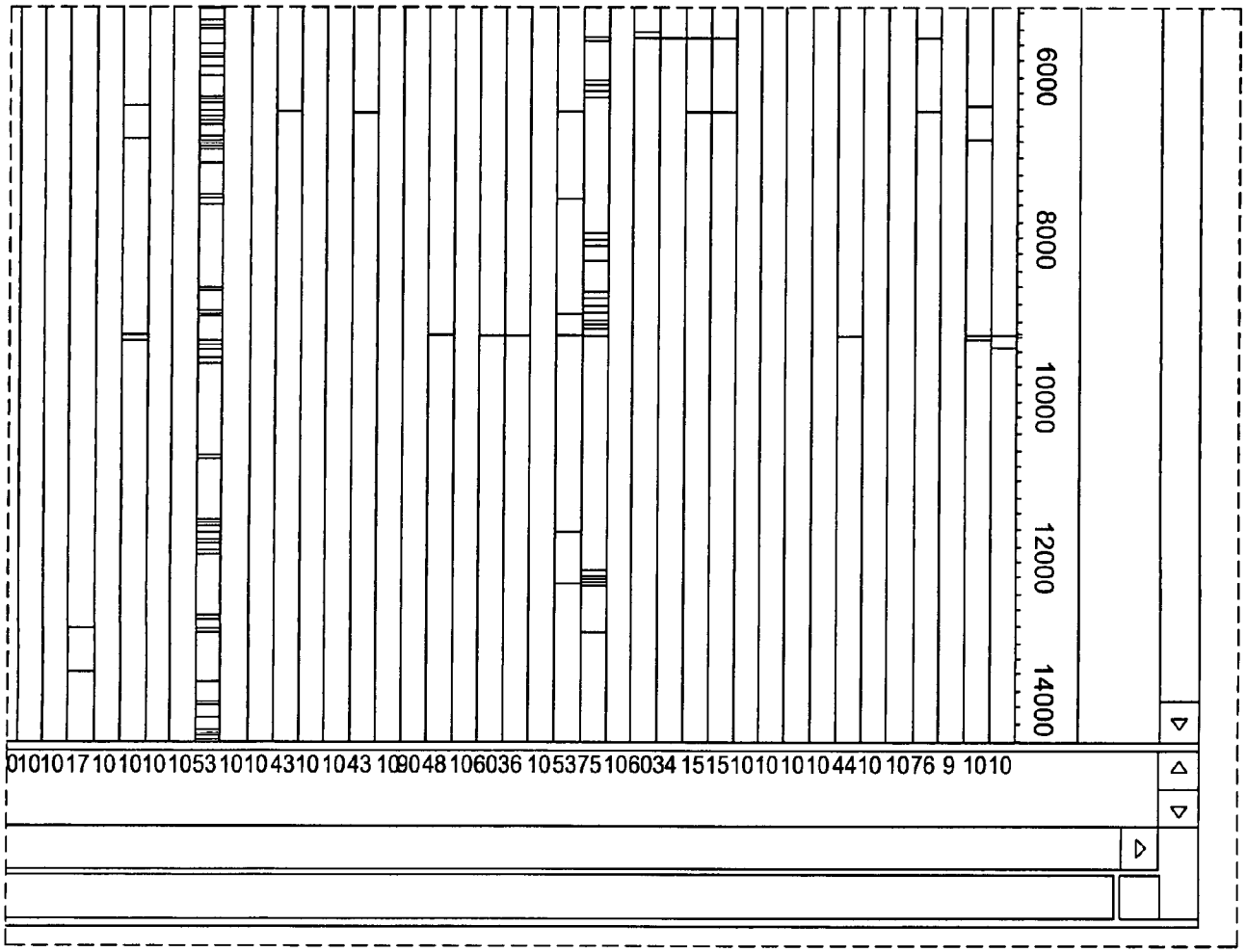

Referring to FIG. 4, a display showing 'Risk Assessment' is illustrated.

In FIG. 4, in the 'Automatic Well Planning Software System', drilling event 'risks' are quantified in a total of 54 risk categories of which the user can customize the risk thresholds. The risk categories are plotted as a function of depth and color coded to aid a quick visual interpretation of potential trouble spots. Further risk assessment is achieved by grouping these categories in the following categories: 'gains', 'losses', 'stuck pipe', and 'mechanical problems'. The total risk log curve can be displayed along the trajectory to correlate drilling risks with geological markers. Additional risk analysis views display the "actual risk" as a portion of the "potential risk" for each design task.

In the 'Automatic Well Planning Software System', a detailed operational activity plan is automatically assembled from customizable templates. The duration for each activity is calculated based on the engineered results of the previous tasks and Non-Productive Time (NPT) can be included. The activity plan specifies a range (minimum, average, and maximum) of time and cost for each activity and lists the operations sequentially as a function of depth and hole section. This information is graphically presented in the time vs depth and cost vs depth graphs.

Figure 5:
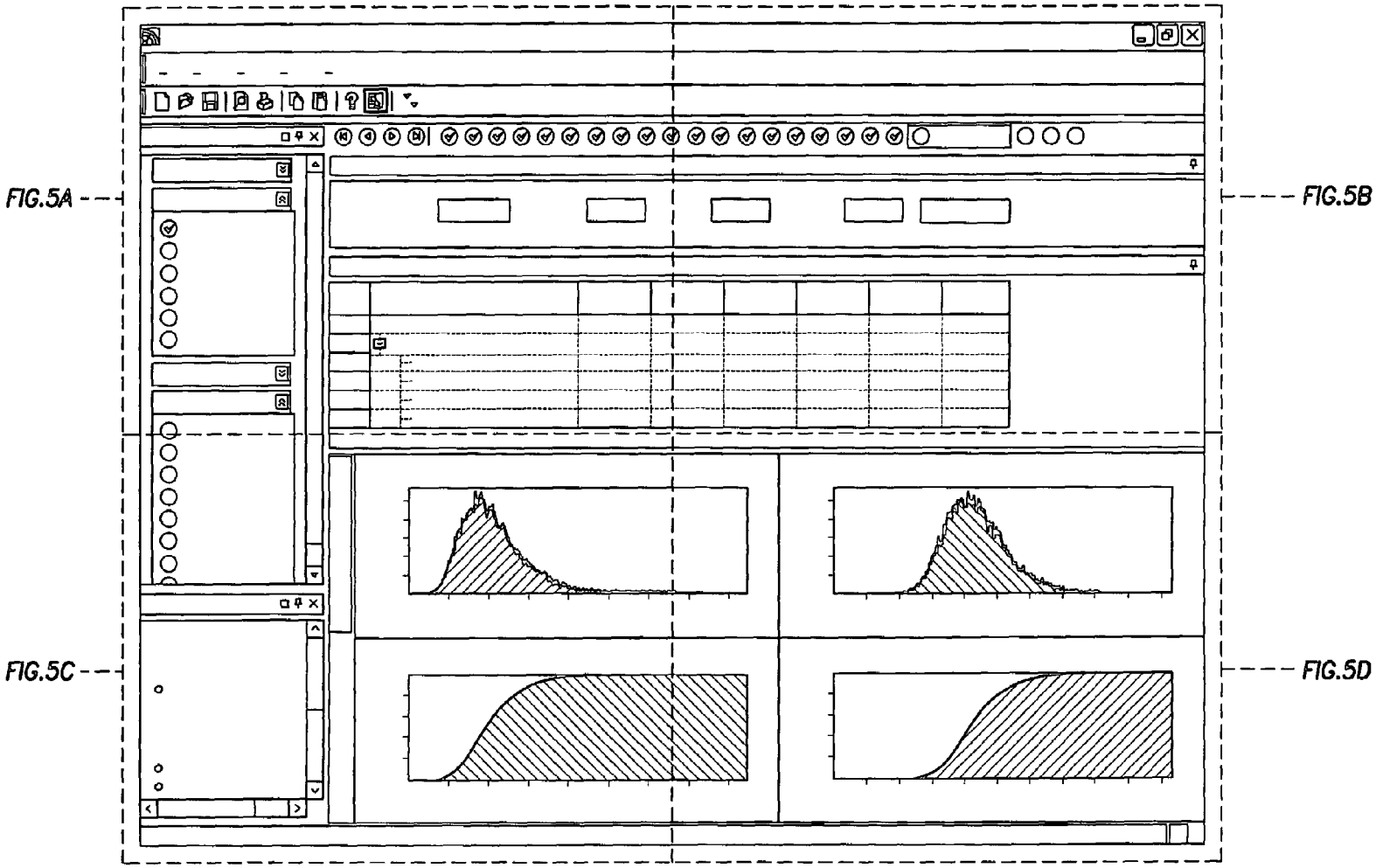
FIG. 5 including
Figure 5A:
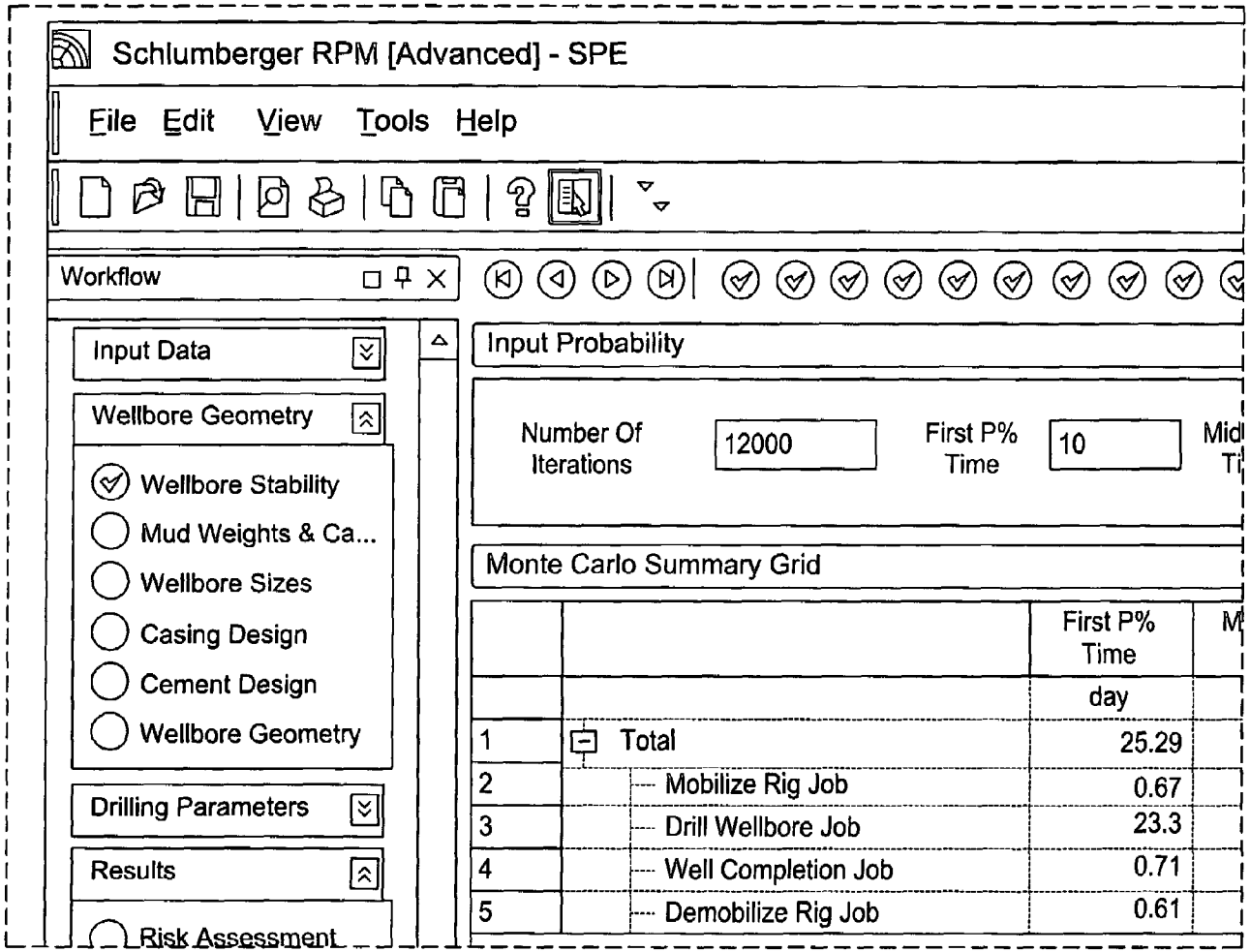
FIGS. 5A, 5B, 5C, and 5D illustrates a Monte Carlo time and cost distribution.
Figure 5B:
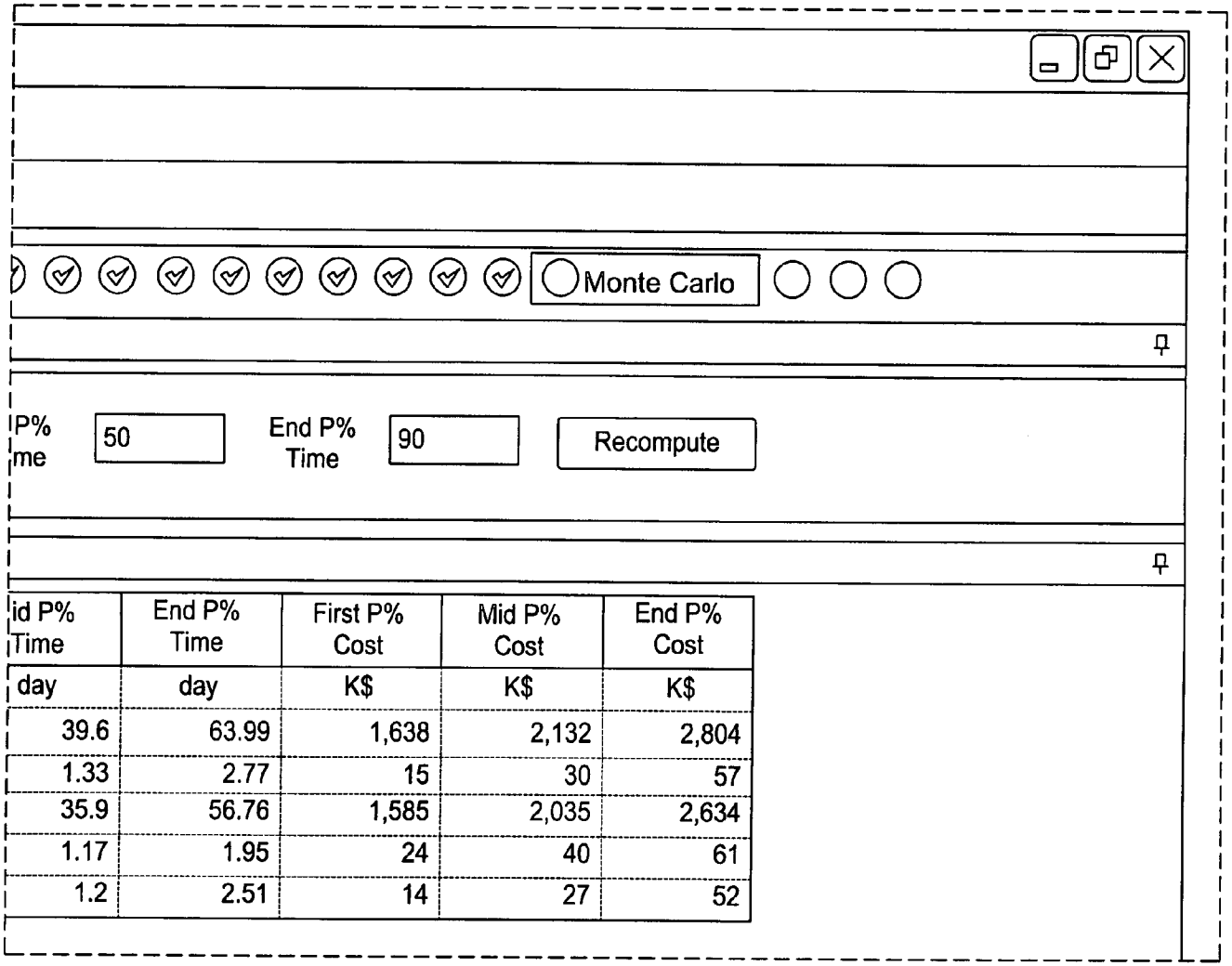
Figure 5C:
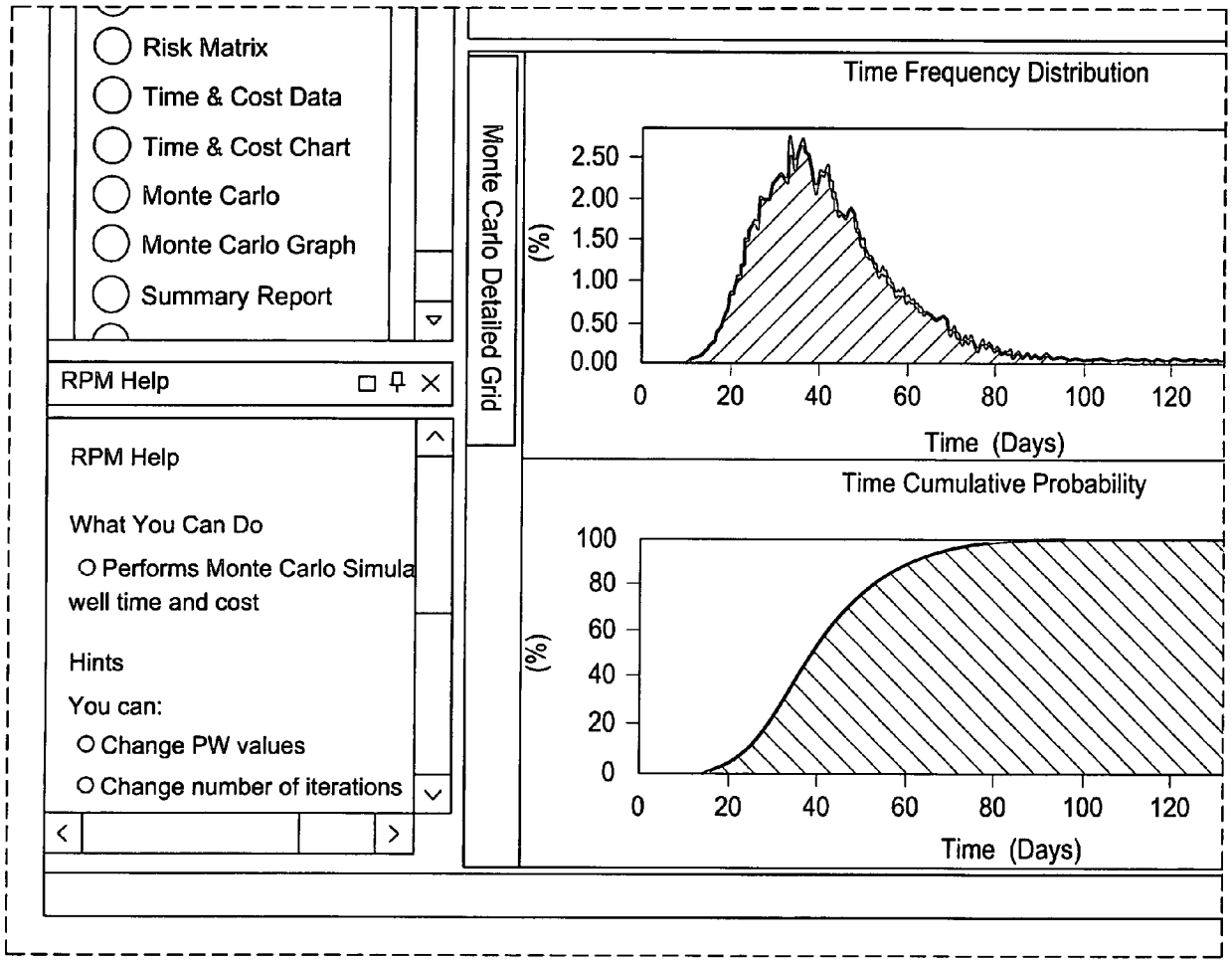
Figure 5D:
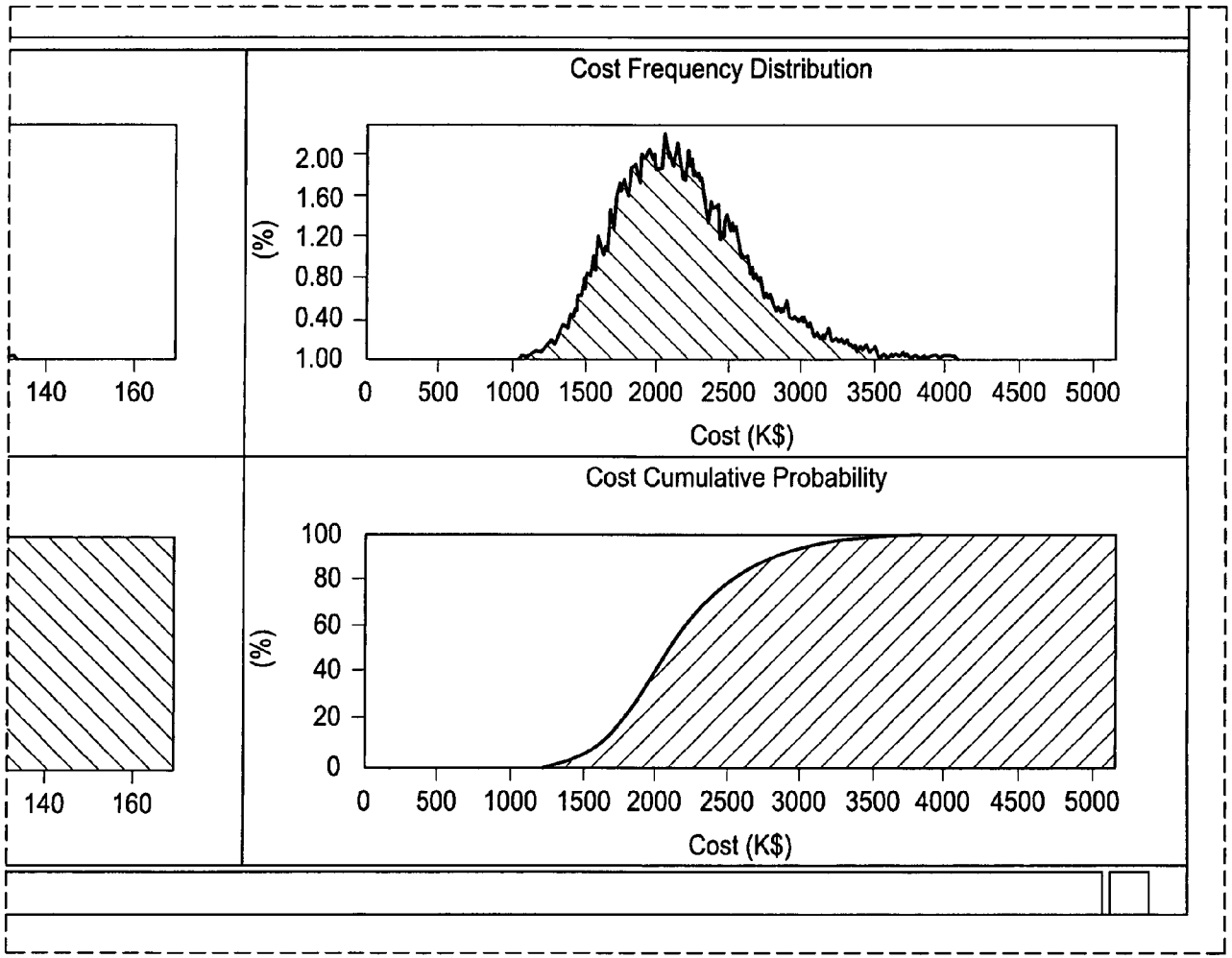

Referring to FIG. 5, a display showing Monte Carlo time and cost distributions is illustrated. In FIG. 5, the 'Automatic Well Planning Software System' uses Monte Carlo simulation to reconcile all of the range of time and cost data to produce probabilistic time and cost distributions.

Figure 6:
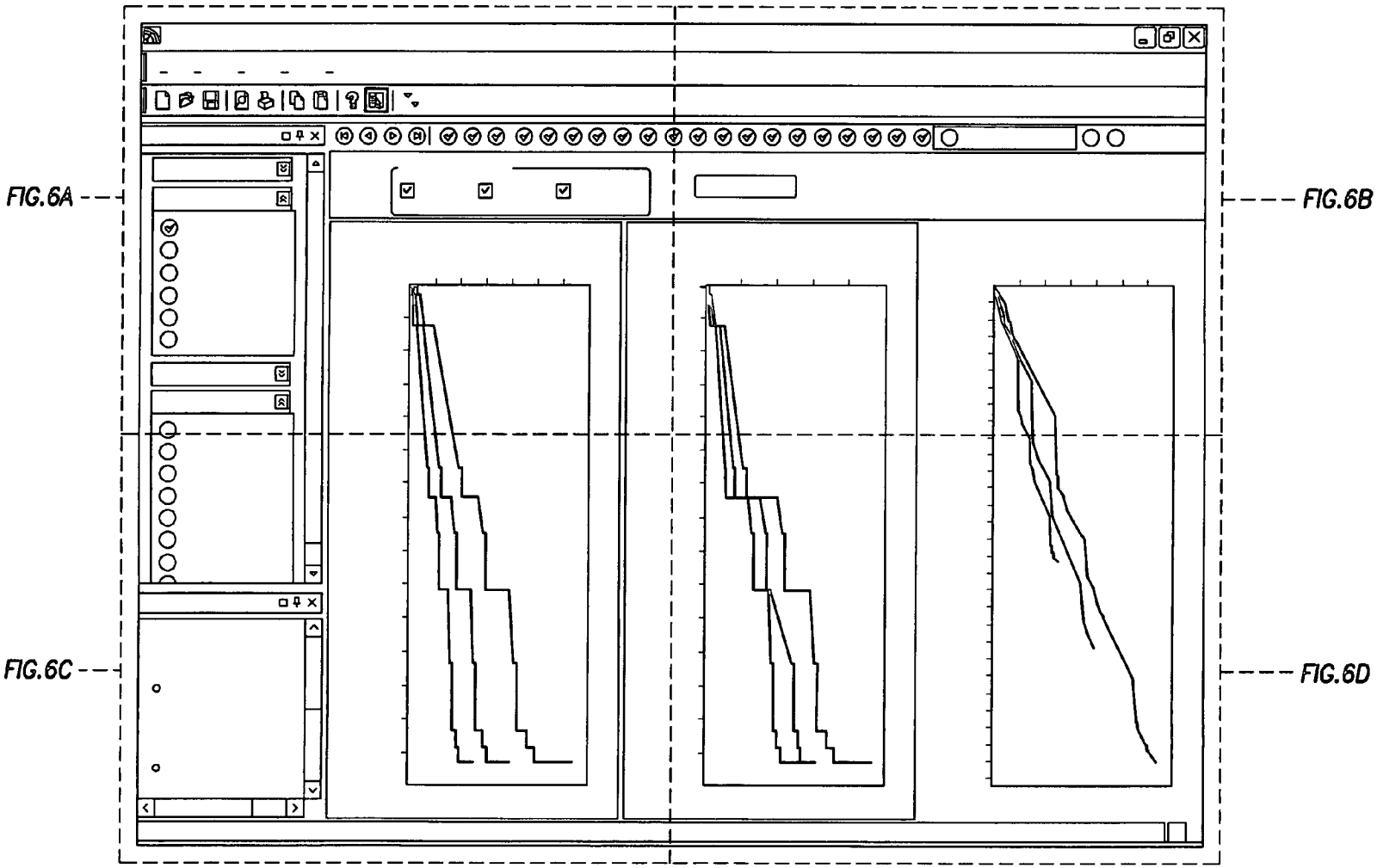
FIG. 6 including
Figure 6A:
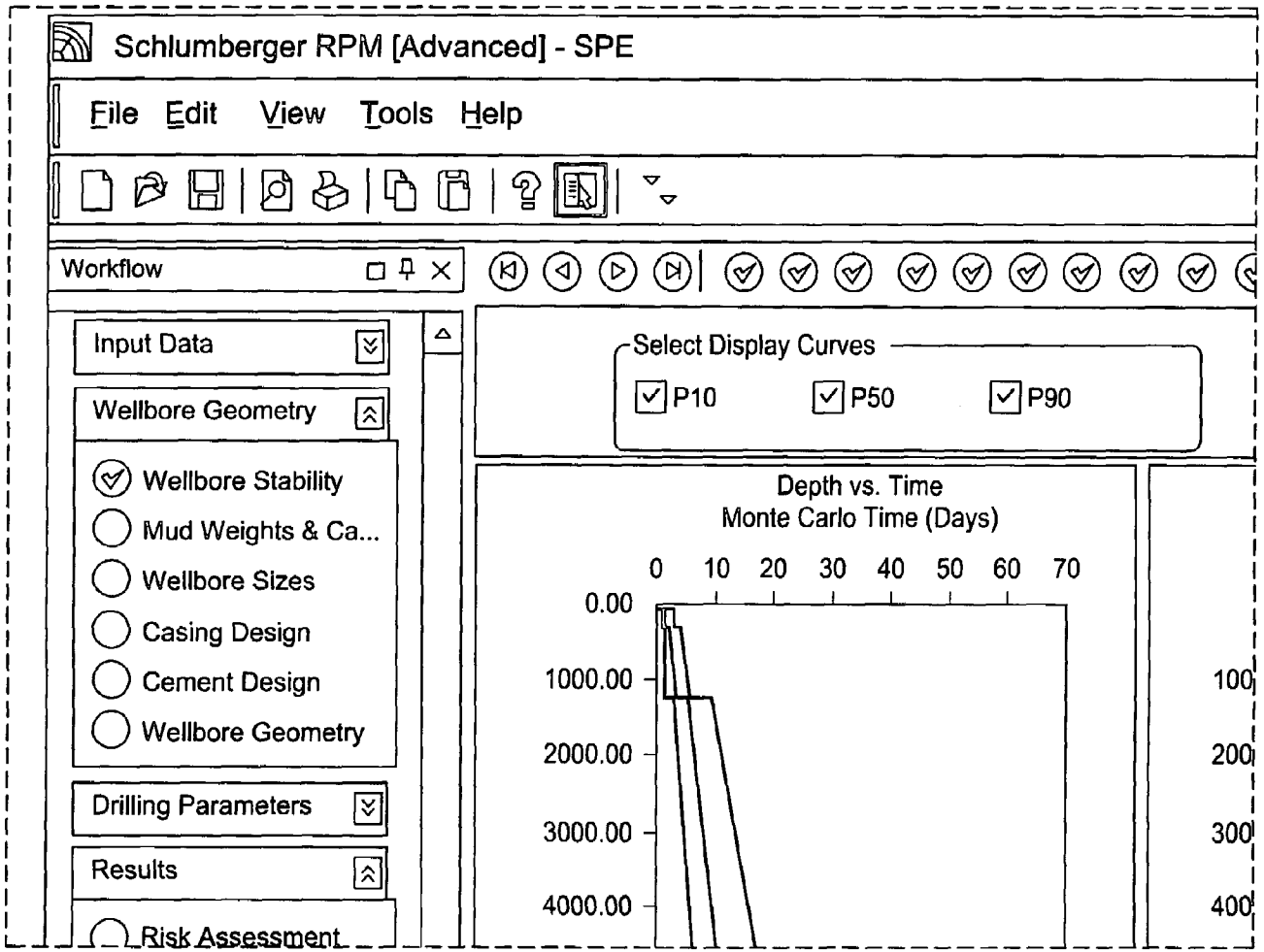
FIGS. 6A, 6B, 6C, and 6D illustrates a probabilistic time and cost vs. depth.
Figure 6B:
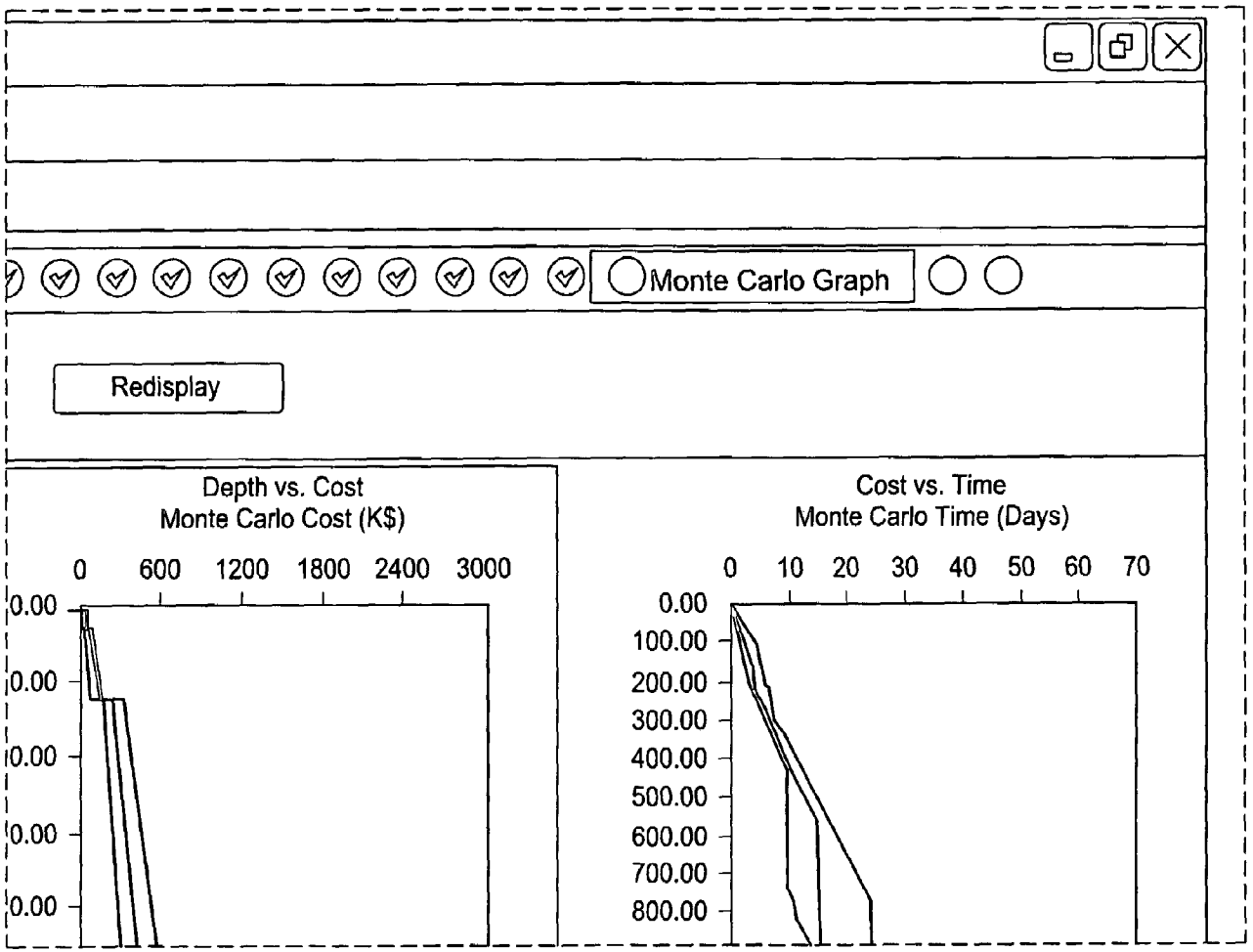
Figure 6C:
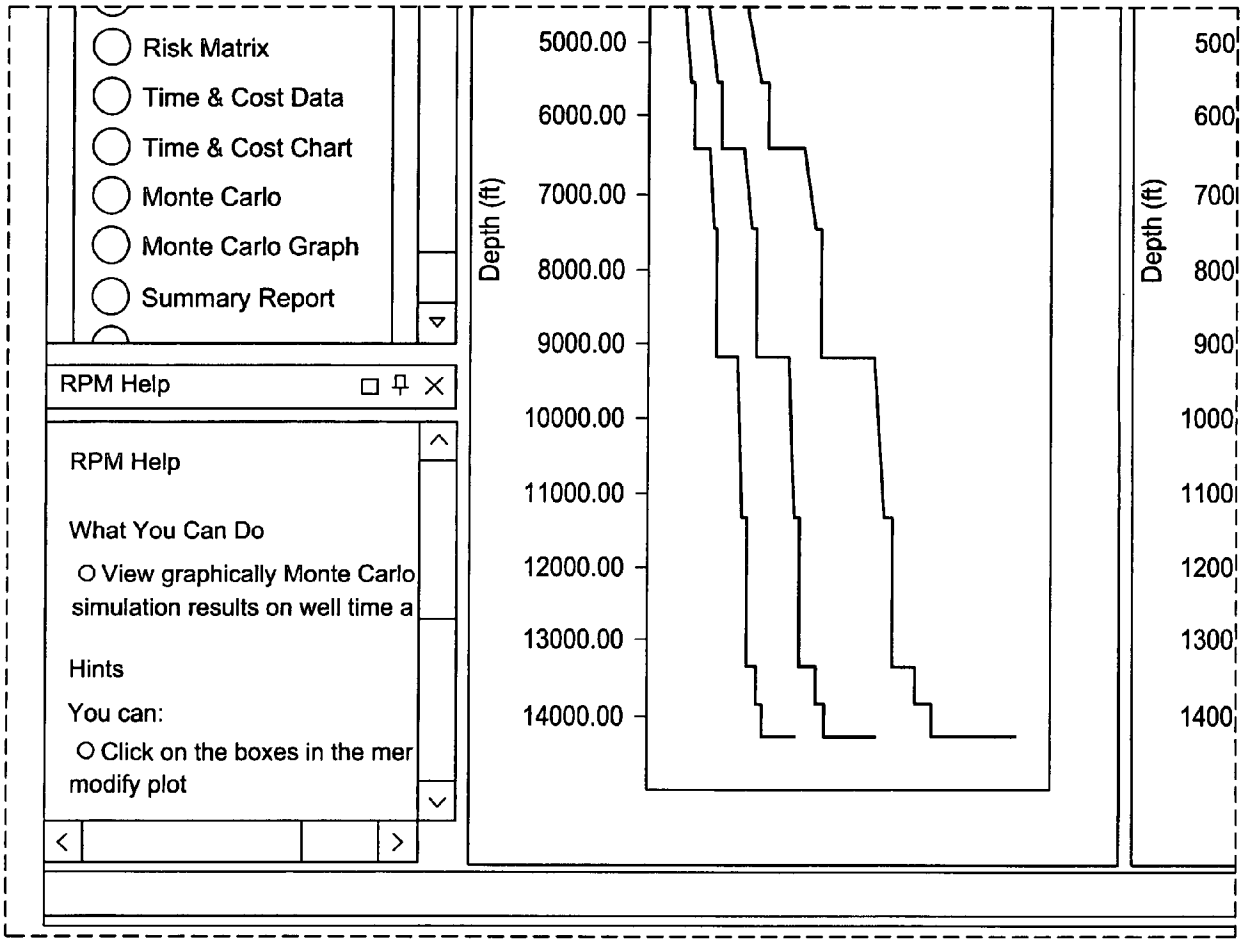
Figure 6D:
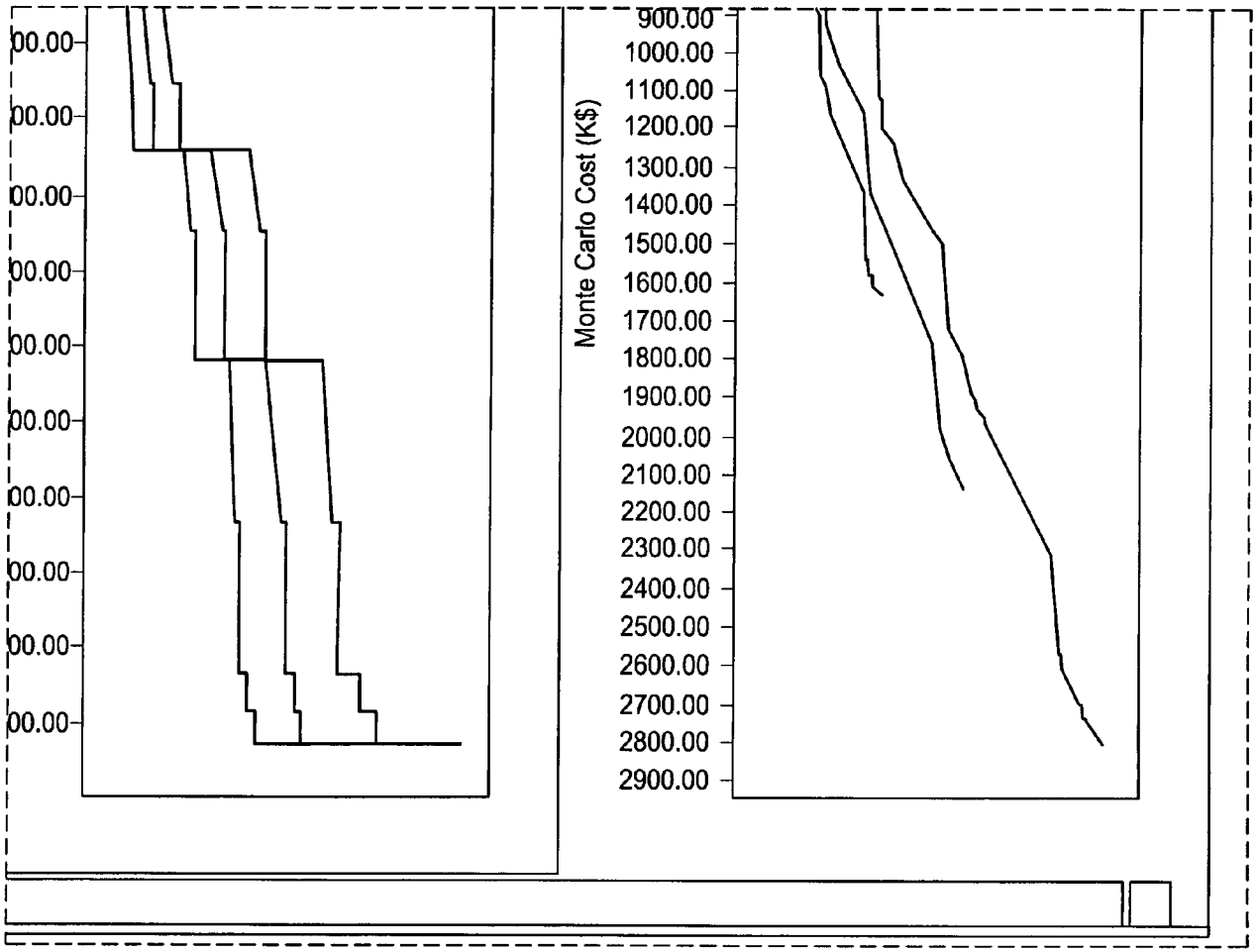

Referring to FIG. 6, a display showing Probabilistic time and cost vs. depth is illustrated. In FIG. 6, this probabilistic analysis, used by the 'Automatic Well Planning Software System' of the present invention, allows quantifying the P10, P50 and P90 probabilities for time and cost.

Figure 7:
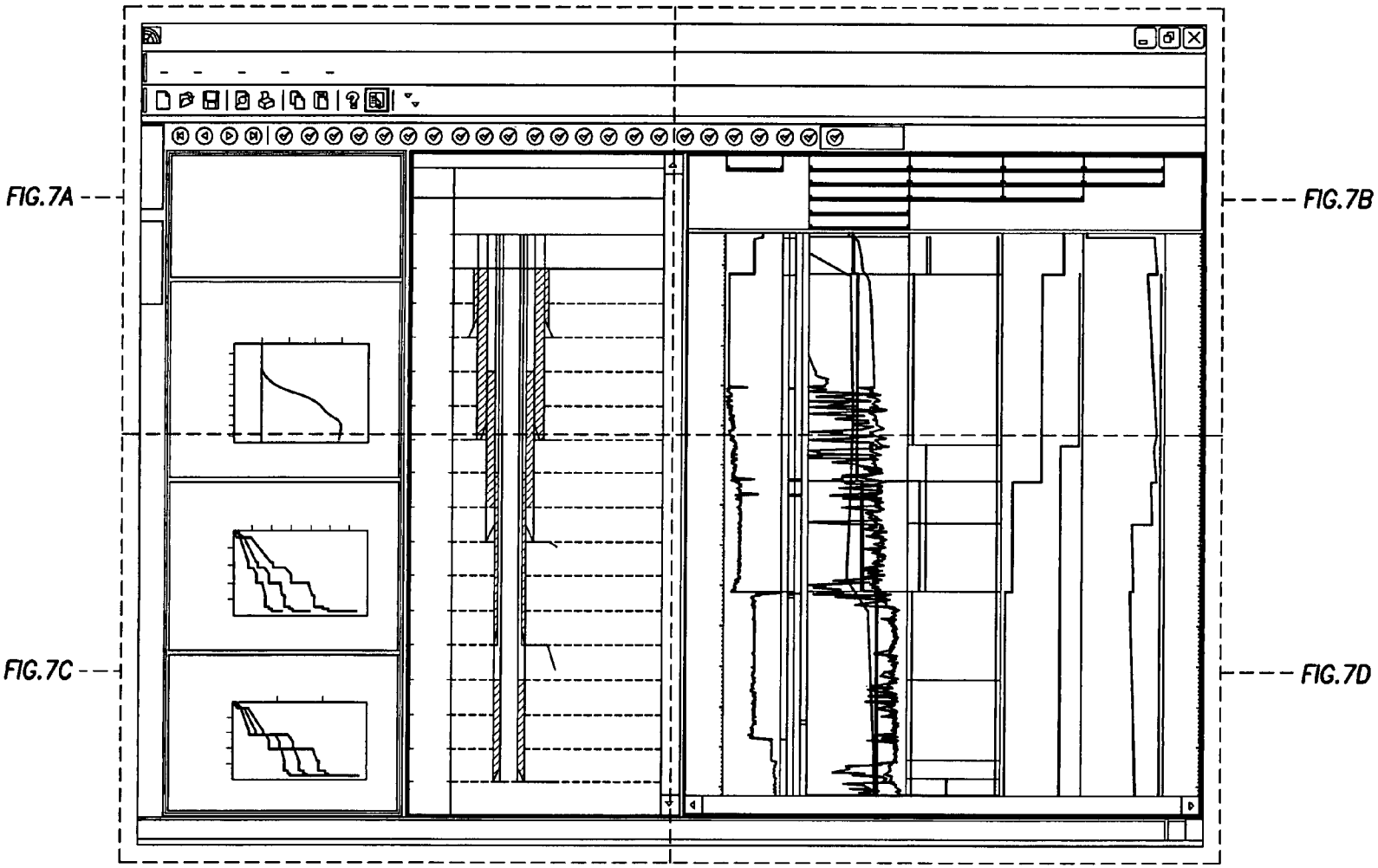
FIG. 7 including
Figure 7A:
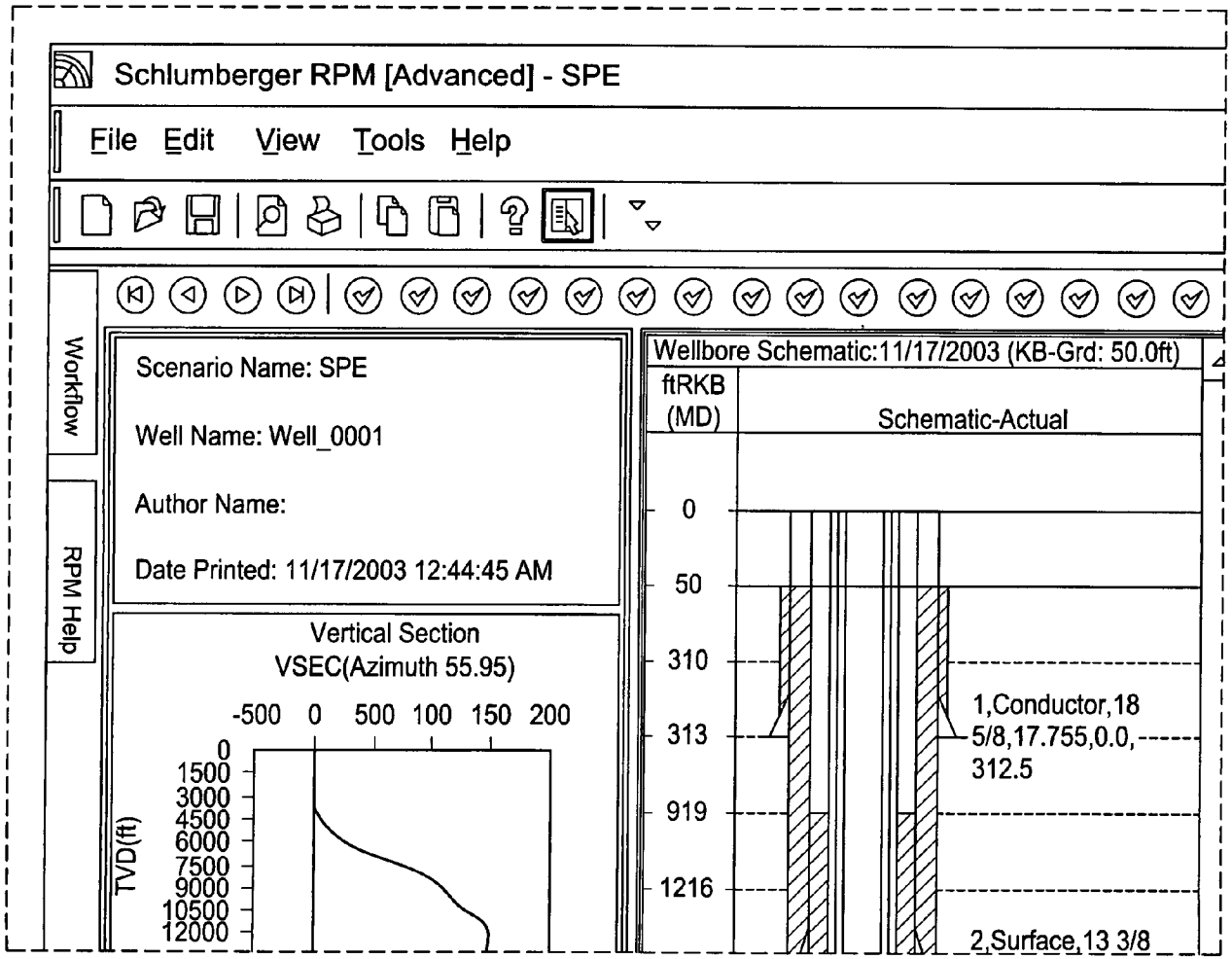
FIGS. 7A, 7B, 7C, and 7D illustrates a summary montage.
Figure 7B:
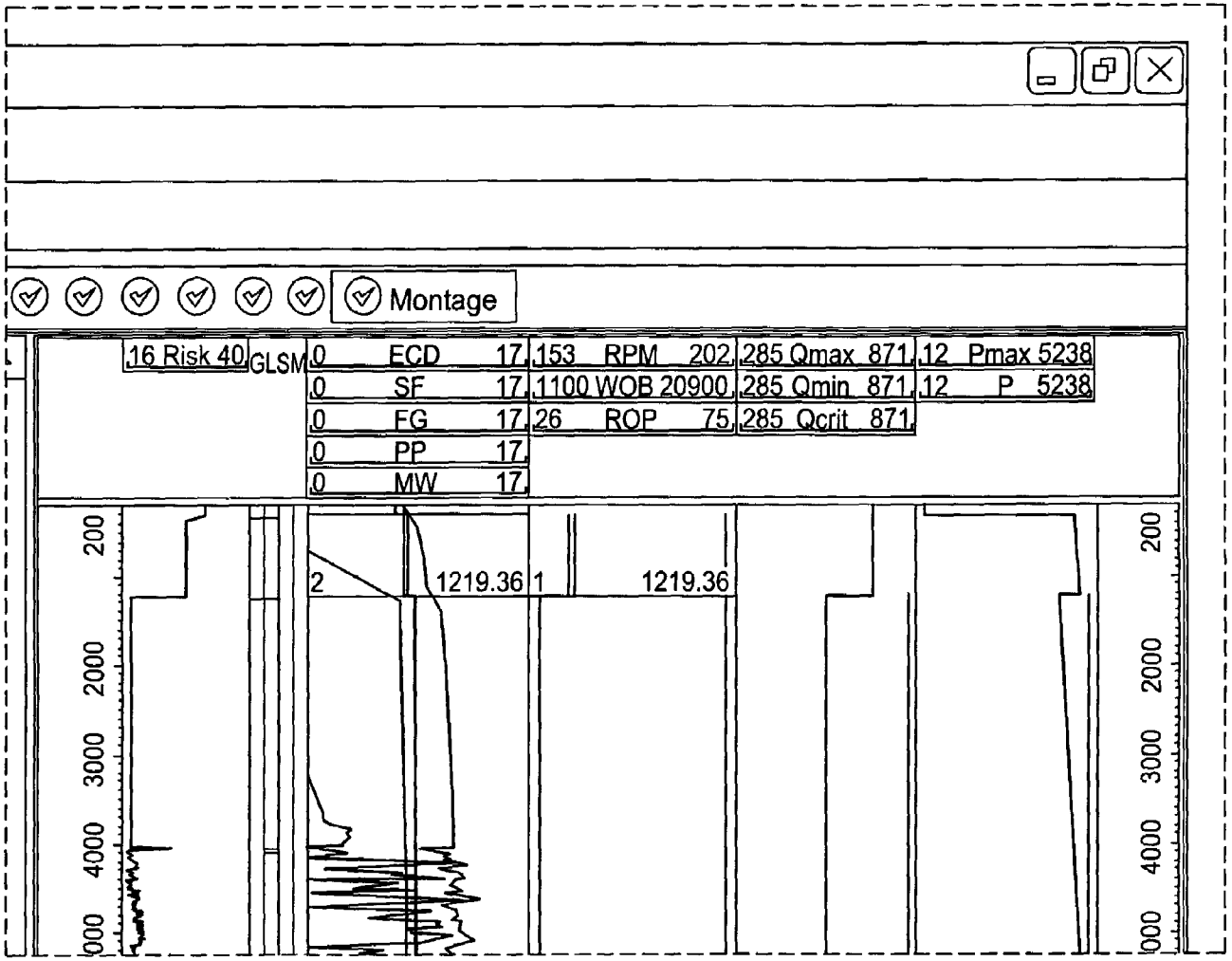
Figure 7C:
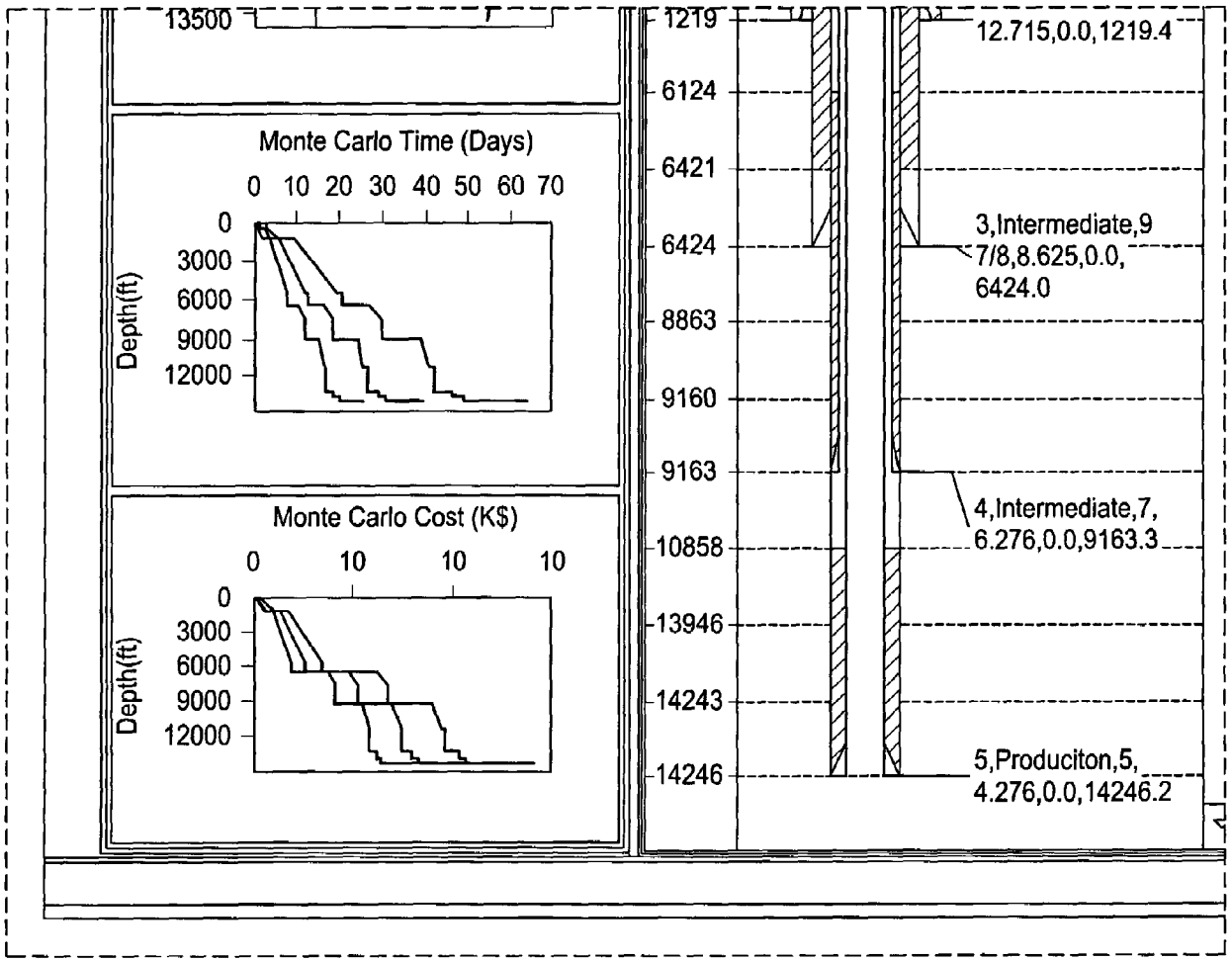
Figure 7D:
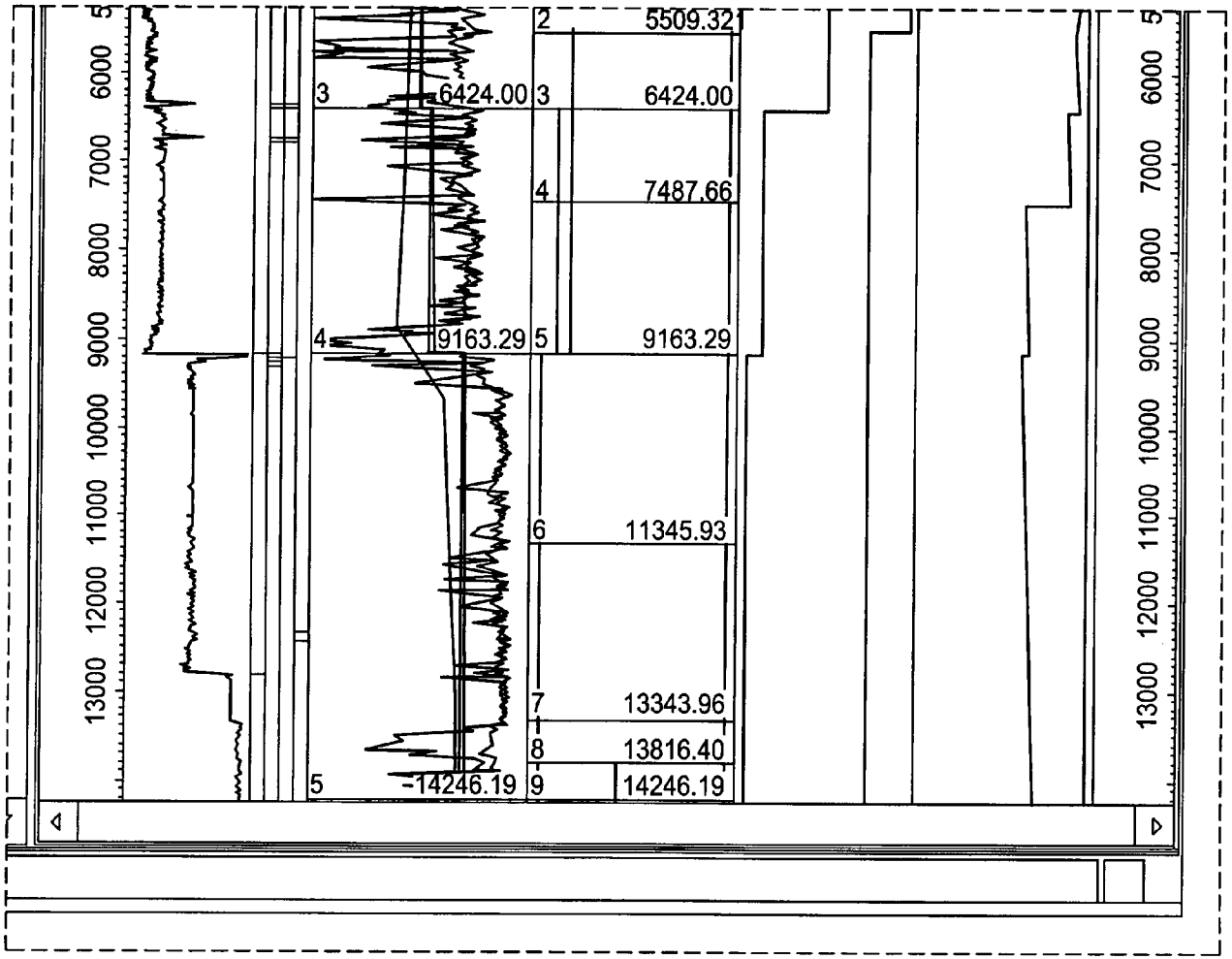

Referring to FIG. 7, a display showing a summary montage is illustrated. In FIG. 7, a comprehensive summary report and a montage display, utilized by the 'Automatic Well Planning Software System' of the present invention, can be printed or plotted in large scale and are also available as a standard result output.

Using its expert system and logic, the 'Automatic Well Planning Software System' disclosed in this specification automatically proposes sound technical solutions and provides a smooth path through the well planning workflow. Graphical interaction with the results of each task allows the user to efficiently fine-tune the results. In just minutes, asset teams, geoscientists, and drilling engineers can evaluate drilling projects and economics using probabilistic cost estimates based on solid engineering fundamentals instead of traditional, less rigorous estimation methods. The testing program combined with feedback received from other users of the program during the development of the software package made it possible to draw the following conclusions: (1) The 'Automatic Well Planning Software System' can be installed and used by inexperienced users with a minimum amount of training and by referencing the documentation provided, (2) The need for good earth property data enhances the link to geological and geomechanical models and encourages improved subsurface interpretation; it can also be used to quanitfy the value of acquiring additional information to reduce uncertainty, (3) With a minimum amount of input data, the 'Automatic Well Planning Software System' can create reasonable probabilistic time and cost estimates faithful to an engineered well design; based on the field test results, if the number of casing points and rig rates are accurate, the results will be within 20% of a fully engineered well design and AFE, (4) With additional customization and localization, predicted results compare to within 10% of a fully engineered well design AFE, (5) Once the 'Automatic Well Planning Software System' has been localized, the ability to quickly run new scenarios and assess the business impact and associated risks of applying new technologies, procedures or approaches to well designs is readily possible, (6) The speed of the 'Automatic Well Planning Software System' allows quick iteration and refinement of well plans and creation of different 'what if, scenarios for sensitivity analysis, (7) The 'Automatic Well Planning Software System' provides consistent and transparent well cost estimates to a process that has historically been arbitrary, inconsistent, and opaque; streamlining the workflow and eliminating human bias provides drilling staff the confidence to delegate and empower non-drilling staff to do their own scoping estimates, (8) The 'Automatic Well Planning Software System' provides unique understanding of drilling risk and uncertainty enabling more realistic economic modeling and improved decision making, (9) The risk assessment accurately identifies the type and location of risk in the wellbore enabling drilling engineers to focus their detailed engineering efforts most effectively, (10) It was possible to integrate and automate the well construction planning workflow based on an earth model and produce technically sound usable results, (11) The project was able to extensively use COTS technology to accelerate development of the software, and (12) The well engineering workflow interdependencies were able to be mapped and managed by the software.

The following nomenclature was used in this specification:

RT=Real-Time, usually used in the context of real-time data (while drilling).

G&G=Geological and Geophysical

SEM=Shared Earth Model

MEM=Mechanical Earth Model

NPT=Non Productive Time, when operations are not planned, or due to operational difficulties, the progress of the well has be delayed, also often referred to as Trouble Time.

NOT=Non Optimum Time, when operations take longer than they should for various reasons.

WOB=Weight on bit

ROP=Rate of penetration

RPM=Revolutions per minute

BHA=Bottom hole assembly

SMR=Software Modification Request

BOD=Basis of Design, document specifying the requirements for a well to be drilled.

AFE=Authorization for Expenditure

REFERENCES (1) Booth, J., Bradford, I. D. R., Cook, J. M., Dowell, J. D., Ritchie, G., Tuddenham, I.: 'Meeting Future Drilling Planning and Decision Support Requirements: A New Drilling Simulator', IADC/SPE 67816 presented at the 2001 IADC/SPE Drilling Conference, Amsterdam, The Netherlands, February 27–March 1.

(2) Luo, Y., Bern, P. A. and Chambers, B. D.: 'Flow-Rate Predictions for Cleaning Deviated Wells', paper IADC/SPE 23884 presented at the 1992 IADC/SPE Drilling Conference, New Orleans, La., February 18–21.

(3) Moore and Chien theory is published in 'Applied Drilling Engineering', Bourgoyne, A. T., Jr, et al., SPE Textbook Series Vo12.

A functional specification associated with the overall 'Automatic Well Planning Software System' (termed a 'use case') will be set forth in the following paragraphs. This functional specification relates to the overall 'Automatic Well Planning Software System'.

The following defines information that pertains to this particular 'use case'. Each piece of information is important in understanding the purpose behind the 'use Case'.

| | |
|---|---|
| Goal In Context: | Describe the full workflow for the low level user |
| Scope: | N/A |
| Level: | Low Level |
| Pre-Condition: | Geological targets pre-defined |
| Success End Condition: | Probability based time estimate with cost and risk |
| Failed End Condition: | Failure in calculations due to assumptions or if distribution of results is too large |
| Primary Actor: | Well Engineer |
| Trigger Event: | N/A |

Main Success Scenario—This Scenario describes the steps that are taken from trigger event to goal completion when everything works without failure. It also describes any required cleanup that is done after the goal has been reached. The steps are listed below:

1. User opens program, and system prompts user whether to open an old file or create a new one. User creates new model and system prompts user for well information (well name, field, country, coordinates). System prompts user to insert earth model. Window with different options appears and user selects data level. Secondary window appears where file is loaded or data inserted manually. System displays 3D view of earth model with key horizons, targets, anti-targets, markers, seismic, etc.
2. System prompts user for a well trajectory. The user either loads from a file or creates one in Caviar for Swordfish. System generates 3D view of trajectory in the earth model and 2D views, both plan and vertical section. User prompted to verify trajectory and modify if needed via direct interaction with 3D window.
3. The system will extract mechanical earth properties (PP, FG, WBS, lithology, density, strength, min/max horizontal stress, etc.) for every point along the trajectory and store it. These properties will either come from a populated mechanical earth model, from interpreted logs applied to this trajectory, or manually entered.
4. The system will prompt the user for the rig constraints. Rig specification options will be offered and the user will choose either the type of rig and basic configurations or insert data manually for a specific drilling unit.
5. The system will prompt the user to enter pore pressure data, if applicable, otherwise taken from the mechanical earth model previously inserted and a MW window will be generated using PP, FG, and WBS curves. The MW window will be displayed and allow interactive modification.
6. The system will automatically divide the well into hole/casing sections based on kick tolerance and trajectory sections and then propose a mud weight schedule. These will be displayed on the MW window and allow the user to interactively modify their values. The casing points can also be interactively modified on the 2D and 3D trajectory displays
7. The system will prompt the user for casing size constraints (tubing size, surface slot size, evaluation requirements), and based on the number of sections generate the appropriate hole size—casing size combinations. The hole/casing circle chart will be used, again allowing for interaction from the user to modify the hole/casing size progression.
8. The system will successively calculate casing grades, weights/wall thickness and connections based on the sizes selected and the depths. User will be able to interact and define availability of types of casing.
9. The system will generate a basic cementing program, with simple slurry designs and corresponding volumes.
10. The system will display the wellbore schematic based on the calculations previously performed and this interface will be fully interactive, allowing the user to click and drag hole & casing sizes, top & bottom setting depths, and recalculating based on these selections. System will flag user if the selection is not feasible.
11. The system will generate the appropriate mud types, corresponding rheology, and composition based on the lithology, previous calculations, and the users selection.
12. The system will successively split the well sections into bit runs, and based on the rock properties will select drilling bits for each section with ROP and drilling parameters.
13. The system will generate a basic BHA configuration, based on the bit section runs, trajectory and rock properties.

Items 14, 15, and 16 represent one task: Hydraulics.

14. The system will run a hole cleaning calculation, based on trajectory, wellbore geometry, BHA composition and MW characteristics.
15. The system will do an initial hydraulics/ECD calculation using statistical ROP data. This data will be either selected or user defined by the system based on smart table lookup.
16. Using the data generated on the first hydraulics calculation, the system will perform an ROP simulation based on drilling bit characteristics and rock properties.
17. The system will run a successive hydraulics/ECD calculation using the ROP simulation data. System will flag user if parameters are not feasible.
18. The system will calculate the drilling parameters and display them on a multi display panel. This display will be exportable, portable, and printable.
19. The system will generate an activity planning sequence using default activity sequences for similar hole sections and end conditions. This sequence will be fully modifiable by the user, permitting modification in sequence order and duration of the event. This sequence will be in the same standard as the Well Operations or Drilling Reporting software and will be interchangeable with the Well Operations or Drilling Reporting software. The durations of activities will be populated from tables containing default "best practice" data or from historical data (DIMS, Snapper . . . ).
20. The system will generate time vs. depth curve based on the activity planning details. The system will create a best, mean, and worst set of time curves using combinations of default and historical data. These curves will be exportable to other documents and printable.
21. The system will prompt the user to select probability points such as P10, P50, P90 and then run a Monte Carlo simulation to generate a probability distribution curve for the scenario highlighting the user selected reference points and corresponding values of time. The system will provide this as frequency data or cumulative probability curves. These curves will be again exportable and printable.
22. The system will generate a cost plan using default cost templates that are pre-configured by users and can be modified at this point. Many of the costs will reference durations of the entire well, hole sections, or specific activities to calculate the applied cost. The system will generate P10, P50, and P90 cost vs. depth curves.

23. The system will generate a summary of the well plan, in word format, along with the main display graphs. The user will select all that should be exported via a check box interface. The system will generate a large one-page summary of the whole process. This document will be as per a standard Well Operations Program template.

Figure 8:
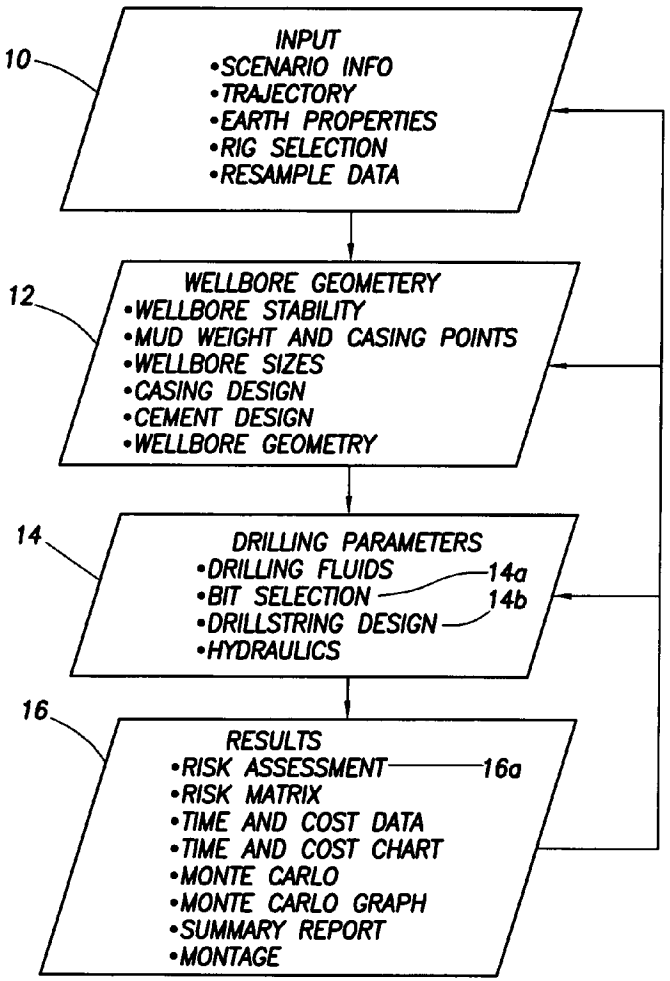
FIG. 8 illustrates a workflow in an 'Automatic Well Planning Software System'.

Referring to FIG. 8, as can be seen on the left side of the displays illustrated in FIGS. 2 through 6, the 'Automatic Well Planning Software System' includes a plurality of tasks. Each of those tasks are illustrated in FIG. 8. In FIG. 8, those plurality of tasks are divided into four groups: (1) Input task 10, where input data is provided, (2) Wellbore Geometry task 12 and Drilling Parameters task 14, where calculations are performed, and (3) a Results task 16, where a set of results are calculated and presented to a user. The Input task 10 includes the following sub-tasks: (1) scenario information, (2) trajectory, (3) Earth properties, (4) Rig selection, (5) Resample Data. The Wellbore Geometry task 12 includes the following sub-tasks: (1) Wellbore stability, (2) Mud weights and casing points, (3) Wellbore sizes, (4) Casing design, (5) Cement design, (6) Wellbore geometry. The Drilling Parameters task 14 includes the following sub-tasks: (1) Drilling fluids, (2) Bit selection 14*a*, (3) Drillstring design 14*b*, (4) Hydraulics. The Results task 16 includes the following sub-tasks: (1) Risk Assessment 16*a*, (2) Risk Matrix, (3) Time and cost data, (4) Time and cost chart, (5) Monte Carlo, (6) Monte Carlo graph, (7) Summary report, and (8) montage.

Recalling that the Results task 16 of FIG. 8 includes a 'Risk Assessment' sub-task 16*a*, the 'Risk Assessment' sub-task 16*a* will be discussed in detail in the following paragraphs with reference to FIGS. 9A, 9B, and 10.

Automatic Well Planning Software System—Risk Assessment sub-task 16*a*—Software Identifying the risks associated with drilling a well is probably the most subjective process in well planning today. This is based on a person recognizing part of a technical well design that is out of place relative to the earth properties or mechanical equipment to be used to drill the well. The identification of any risks is brought about by integrating all of the well, earth, and equipment information in the mind of a person and mentally sifting through all of the information, mapping the interdependencies, and based solely on personal experience extracting which parts of the project pose what potential risks to the overall success of that project. This is tremendously sensitive to human bias, the individual's ability to remember and integrate all of the data in their mind, and the individuals experience to enable them to recognize the conditions that trigger each drilling risk. Most people are not equipped to do this and those that do are very inconsistent unless strict process and checklists are followed. There are some drilling risk software systems in existence today, but they all require the same human process to identify and assess the likelihood of each individual risks and the consequences. They are simply a computer system for manually recording the results of the risk identification process.

The Risk Assessment sub-task 16*a* associated with the 'Automatic Well Planning Software System' of the present invention is a system that will automatically assess risks associated with the technical well design decisions in relation to the earth's geology and geomechanical properties and in relation to the mechanical limitations of the equipment specified or recommended for use.

Risks are calculated in four ways: (1) by 'Individual Risk Parameters', (2) by 'Risk Categories', (3) by 'Total Risk', and (4) the calculation of 'Qualitative Risk Indices' for each.

Individual Risk Parameters are calculated along the measured depth of the well and color coded into high, medium, or low risk for display to the user. Each risk will identify to the user: an explanation of exactly what is the risk violation, and the value and the task in the workflow controlling the risk. These risks are calculated consistently and transparently allowing users to see and understand all of the known risks and how they are identified. These risks also tell the users which aspects of the well justify further engineering effort to investigate in more detail.

Group/category risks are calculated by incorporating all of the individual risks in specific combinations. Each individual risk is a member of one or more Risk Categories. Four principal Risk Categories are defined as follows: (1) Gains, (2) Losses, (3) Stuck, and (4) Mechanical; since these four Rick Categories are the most common and costly groups of troublesome events in drilling worldwide.

The Total Risk for a scenario is calculated based on the cumulative results of all of the group/category risks along both the risk and depth axes.

Risk indexing—Each individual risk parameter is used to produce an individual risk index which is a relative indicator of the likelihood that a particular risk will occur. This is purely qualitative, but allows for comparison of the relative likelihood of one risk to another—this is especially indicative when looked at from a percentage change. Each Risk Category is used to produce a category risk index also indicating the likelihood of occurrence and useful for identifying the most likely types of trouble events to expect. Finally, a single risk index is produced for the scenario that is specifically useful for comparing the relative risk of one scenario to another.

The 'Automatic Well Planning Software System' of the present invention is capable of delivering a comprehensive technical risk assessment, and it can do this automatically. Lacking an integrated model of the technical well design to relate design decisions to associated risks, the 'Automatic Well Planning Software System' can attribute the risks to specific design decisions and it can direct users to the appropriate place to modify a design choice in efforts to modify the risk profile of the well.

Figure 9A:
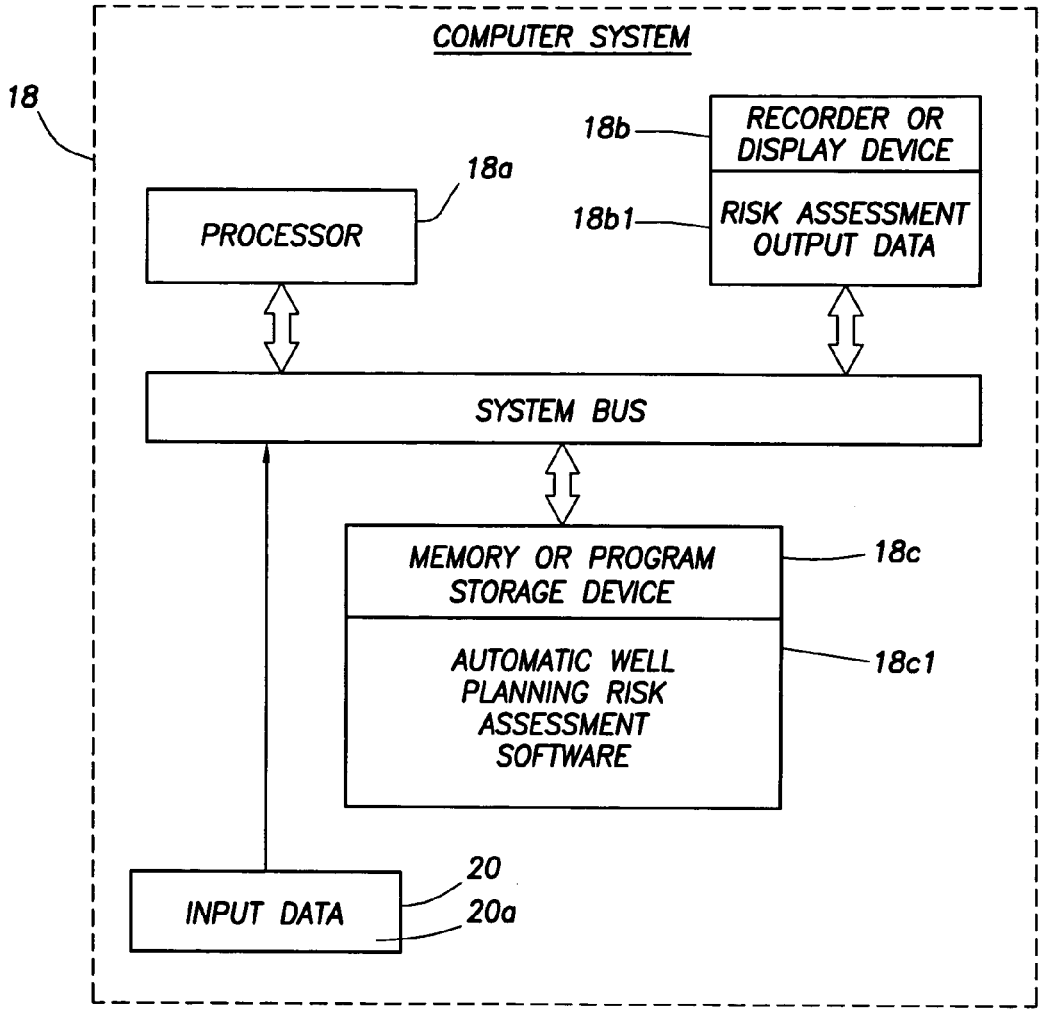
FIG. 9A illustrates a computer system which stores an Automatic Well Planning Risk Assessment Software.

Referring to FIG. 9A, a Computer System 18 is illustrated. The Computer System 18 includes a Processor 18*a* connected to a system bus, a Recorder or Display Device 18*b* connected to the system bus, and a Memory or Program Storage Device 18*c* connected to the system bus. The Recorder or Display Device 18*b* is adapted to display 'Risk Assessment Output Data' 18*b*1. The Memory or Program Storage Device 18*c* is adapted to store an 'Automatic Well Planning Risk Assessment Software' 18*c*1. The 'Automatic Well Planning Risk Assessment Software' 18*c*1 is originally stored on another 'program storage device', such as a hard disk; however, the hard disk was inserted into the Computer System 18 and the 'Automatic Well Planning Risk Assessment Software' 18*c*1 was loaded from the hard disk into the Memory or Program Storage Device 18*c* of the Computer System 18 of FIG. 9A. In addition, a Storage Medium 20 containing a plurality of 'Input Data' 20*a* is adapted to be connected to the system bus of the Computer System 18, the 'Input Data' 20*a* being accessible to the Processor 18*a* of the Computer System 18 when the Storage Medium 20 is connected to the system bus of the Computer System 18. In operation, the Processor 18*a* of the Computer System 18 will execute the Automatic Well Planning Risk Assessment Software 18*c*1 stored in the Memory or Program Storage Device 18*c* of the Computer System 18 while, simultaneously, using the 'Input Data' 20*a* stored in the Storage Medium 20 during that execution. When the Processor 18*a* completes the execution of the Automatic Well Planning Risk Assessment Software 18*c*1 stored in the Memory or Program Storage Device 18*c* (while using the 'Input Data' 20*a*), the Recorder or Display Device 18*b* will record or display the 'Risk Assessment Output Data' 18*b*1, as shown in FIG. 9A. For example the 'Risk Assessment Output Data' 18*b*1 can be displayed on a display screen of the Computer System 18, or the 'Risk Assessment Output Data' 18*b*1 can be recorded on a printout which is generated by the Computer System 18. The Computer System 18 of FIG. 9A may be a personal computer (PC). The Memory or Program Storage Device 18*c* is a computer readable medium or a program storage device which is readable by a machine, such as the processor 18*a*. The processor 18*a* may be, for example, a microprocessor, microcontroller, or a mainframe or workstation processor. The Memory or Program Storage Device 18*c*, which stores the 'Automatic Well Planning Risk Assessment Software' 18*c*1, may be, for example, a hard disk, ROM, CD-ROM, DRAM, or other RAM, flash memory, magnetic storage, optical storage, registers, or other volatile and/or non-volatile memory.

Figure 9B:
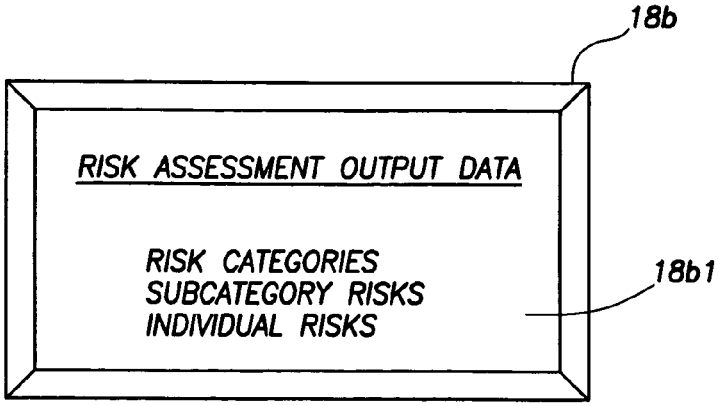
FIG. 9B illustrates a display as shown on a Recorder or Display device of the Computer System of FIG. 9A.

Referring to FIG. 9B, a larger view of the Recorder or Display Device 18*b* of FIG. 9A is illustrated. In FIG. 9B, the 'Risk Assessment Output Data' 18*b*1 includes: (1) a plurality or Risk Categories, (2) a plurality of Subcategory Risks (each of which have been ranked as either a High Risk or a Medium Risk or a Low Risk), and (3) a plurality of Individual Risks (each of which have been ranked as either a High Risk or a Medium Risk or a Low Risk). The Recorder or Display Device 18*b* of FIG. 9B will display or record the 'Risk Assessment Output Data' 18*b*1 including the Risk Categories, the Subcategory Risks, and the Individual Risks.

Figure 10:
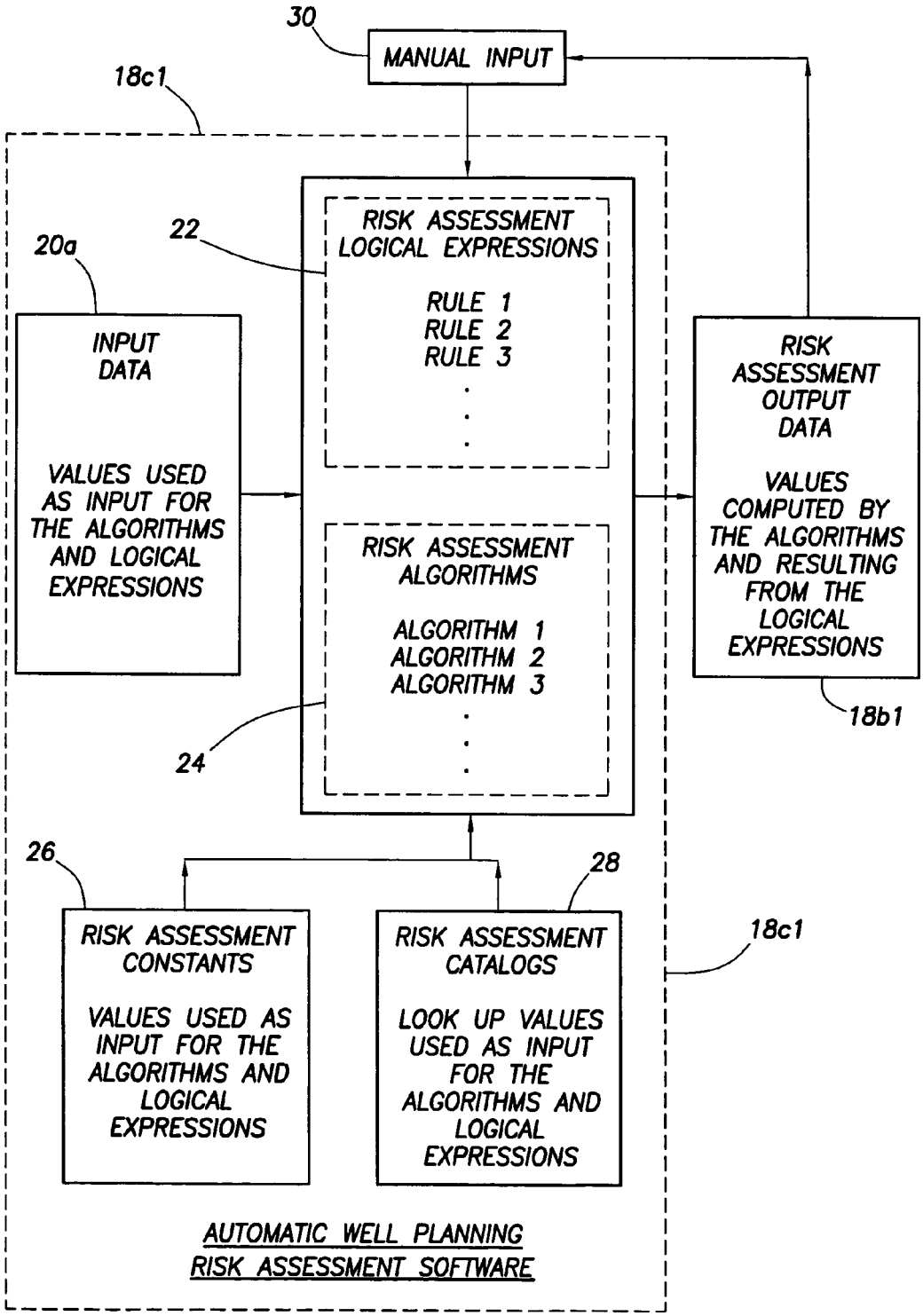
FIG. 10 illustrates a detailed construction of the Automatic Well Planning Risk Assessment Software stored in the Computer System of FIG. 9A.

Referring to FIG. 10, a detailed construction of the 'Automatic Well Planning Risk Assessment Software' 18*c*1 of FIG. 9A is illustrated. In FIG. 10, the 'Automatic Well Planning Risk Assessment Software' 18*c*1 includes a first block which stores the Input Data 20*a*, a second block 22 which stores a plurality of Risk Assessment Logical Expressions 22; a third block 24 which stores a plurality of Risk Assessment Algorithms 24, a fourth block 26 which stores a plurality of Risk Assessment Constants 26, and a fifth block 28 which stores a plurality of Risk Assessment Catalogs 28. The Risk Assessment Constants 26 include values which are used as input for the Risk Assessment Algorithms 24 and the Risk Assessment Logical Expressions 22. The Risk Assessment Catalogs 28 include look-up values which are used as input by the Risk Assessment Algorithms 24 and the Risk Assessment Logical Expressions 22. The 'Input Data' 20*a* includes values which are used as input for the Risk Assessment Algorithms 24 and the Risk Assessment Logical Expressions 22. The 'Risk Assessment Output Data' 18*b*1 includes values which are computed by the Risk Assessment Algorithms 24 and which result from the Risk Assessment Logical Expressions 22. In operation, referring to FIGS. 9 and 10, the Processor 18*a* of the Computer System 18 of FIG. 9A executes the Automatic Well Planning Risk Assessment Software 18*c*1 by executing the Risk Assessment Logical Expressions 22 and the Risk Assessment Algorithms 24 of the Risk Assessment Software 18*c*1 while, simultaneously, using the 'Input Data' 20*a*, the Risk Assessment Constants 26, and the values stored in the Risk Assessment Catalogs 28 as 'input data' for the Risk Assessment Logical Expressions 22 and the Risk Assessment Algorithms 24 during that execution. When that execution by the Processor 18*a* of the Risk Assessment Logical Expressions 22 and the Risk Assessment Algorithms 24 (while using the 'Input Data' 20*a*, Constants 26, and Catalogs 28) is completed, the 'Risk Assessment Output Data' 18*b*1 will be generated as a 'result'. That 'Risk Assessment Output Data' 18*b*1 is recorded or displayed on the Recorder or Display Device 18*b* of the Computer System 18 of FIG. 9A. In addition, that 'Risk Assessment Output Data' 18*b*1 can be manually input, by an operator, to the Risk Assessment Logical Expressions block 22 and the Risk Assessment Algorithms block 24 via a 'Manual Input' block 30 shown in FIG. 10.

Input Data 20*a*

The following paragraphs will set forth the 'Input Data' 20*a* which is used by the 'Risk Assessment Logical Expressions' 22 and the 'Risk Assessment Algorithms' 24. Values of the Input Data 20*a* that are used as input for the Risk Assessment Algorithms 24 and the Risk Assessment Logical Expressions 22 are as follows:

(1) Casing Point Depth
(2) Measured Depth
(3) True Vertical Depth
(4) Mud Weight
(5) Measured Depth
(6) ROP
(7) Pore Pressure
(8) Static Temperature
(9) Pump Rate
(10) Dog Leg Severity
(11) ECD
(12) Inclination
(13) Hole Size
(14) Casing Size
(15) Easting-westing
(16) Northing-Southing
(17) Water Depth
(18) Maximum Water Depth
(19) Maximum well Depth
(20) Kick Tolerance
(21) Drill Collar 1 Weight
(22) Drill Collar 2 Weight
(23) Drill Pipe Weight
(24) Heavy Weight Weight
(25) Drill Pipe Tensile Rating
(26) Upper Wellbore Stability Limit
(27) Lower Wellbore Stability Limit
(28) Unconfined Compressive Strength
(29) Bit Size
(30) Mechanical drilling energy (UCS integrated over distance drilled by the bit)
(31) Ratio of footage drilled compared to statistical footage
(32) Cumulative UCS
(33) Cumulative Excess UCS
(34) Cumulative UCS Ratio
(35) Average UCS of rock in section
(36) Bit Average UCS of rock in section
(37) Statistical Bit Hours
(38) Statistical Drilled Footage for the bit
(39) RPM
(40) On Bottom Hours
(41) Calculated Total Bit Revolutions
(42) Time to Trip
(43) Critical Flow Rate
(44) Maximum Flow Rate in hole section

(45) Minimum Flow Rate in hole section
(46) Flow Rate
(47) Total Nozzle Flow Area of bit
(48) Top Of Cement
(49) Top of Tail slurry
(50) Length of Lead slurry
(51) Length of Tail slurry
(52) Cement Density Of Lead
(53) Cement Density Of Tail slurry
(54) Casing Weight per foot
(55) Casing Burst Pressure
(56) Casing Collapse Pressure
(57) Casing Type Name
(58) Hydrostatic Pressure of Cement column
(59) Start Depth
(60) End Depth
(61) Conductor
(62) Hole Section Begin Depth
(63) Openhole Or Cased hole completion
(64) Casing Internal Diameter
(65) Casing Outer Diameter
(66) Mud Type
(67) Pore Pressure without Safety Margin
(68) Tubular Burst Design Factor
(69) Casing Collapse Pressure Design Factor
(70) Tubular Tension Design Factor
(71) Derrick Load Rating
(72) Drawworks Rating
(73) Motion Compensator Rating
(74) Tubular Tension rating
(75) Statistical Bit ROP
(76) Statistical Bit RPM
(77) Well Type
(78) Maximum Pressure
(79) Maximum Liner Pressure Rating
(80) Circulating Pressure
(81) Maximum UCS of bit
(82) Air Gap
(83) Casing Point Depth
(84) Presence of H2S
(85) Presence of CO2
(86) Offshore Well
(87) Flow Rate Maximum Limit Risk Assessment Constants 26

The following paragraphs will set forth the 'Risk Assessment Constants' 26 which are used by the 'Risk Assessment Logical Expressions' 22 and the 'Risk Assessment Algorithms' 24. Values of the Constants 26 that are used as input data for Risk Assessment Algorithms 24 and the Risk Assessment Logical Expressions 22 are as follows:

(1) Maximum Mud Weight Overbalance to Pore Pressure
(2) Minimum Required Collapse Design Factor
(3) Minimum Required Tension Design Factor
(4) Minimum Required Burst Design Factor
(5) Rock density
(6) Seawater density Risk Assessment Catalogs 28

The following paragraphs will set forth the 'Risk Assessment Catalogs' 28 which are used by the 'Risk Assessment Logical Expressions' 22 and the 'Risk Assessment Algorithms' 24. Values of the Catalogs 28 that are used as input data for Risk Assessment Algorithms 24 and the Risk Assessment Logical Expressions 22 include the following:

(1) Risk Matrix Catalog
(2) Risk Calculation Catalog
(3) Drillstring component catalog
(4) Drill Bit Catalog
(5) Clearance Factor Catalog
(6) Drill Collar Catalog
(7) Drill Pipes Catalog
(8) Minimum and maximum flow rate catalog
(9) Pump catalog
(10) Rig Catalog
(11) Constants and variables Settings catalog
(12) Tubular Catalog Risk Assessment Output Data **18*b*1**

The following paragraphs will set forth the 'Risk Assessment Output Data' **18*b*1 which are generated by the 'Risk Assessment Algorithms' 24. The 'Risk Assessment Output Data' 18*b*1, which is generated by the 'Risk Assessment Algorithms' 24, includes the following types of output data: (1) Risk Categories, (2) Subcategory Risks, and (3) Individual Risks. The 'Risk Categories', 'Subcategory Risks', and 'Individual Risks' included within the 'Risk Assessment Output Data' 18*b*1** comprise the following:

The following 'Risk Categories' are calculated:

(1) Individual Risk
(2) Average Individual Risk
(3) Subcategory Risk
(4) Average Subcategory Risk
(5) Total risk
(6) Average total risk
(7) Potential risk for each design task
(8) Actual risk for each design task The following 'Subcategory Risks' are calculated (1) Gains risks
(2) Losses risks
(3) Stuck Pipe risks
(4) Mechanical risks The following 'Individual Risks' are calculated (1) H2S and CO2,
(2) Hydrates,
(3) Well water depth,
(4) Tortuosity,
(5) Dogleg severity,
(6) Directional Drilling Index,
(7) Inclination,
(8) Horizontal displacement,
(9) Casing Wear,
(10) High pore pressure,
(11) Low pore pressure,
(12) Hard rock,
(13) Soft Rock,
(14) High temperature,
(15) Water-depth to rig rating,
(16) Well depth to rig rating,
(17) mud weight to kick,
(18) mud weight to losses,
(19) mud weight to fracture,
(20) mud weight window,
(21) Wellbore stability window,
(22) wellbore stability,
(23) Hole section length,
(24) Casing design factor,
(25) Hole to casing clearance,
(26) casing to casing clearance,
(27) casing to bit clearance,
(28) casing linear weight,
(29) Casing maximum overpull,
(30) Low top of cement,
(31) Cement to kick,
(32) cement to losses,

(33) cement to fracture,
(34) Bit excess work,
(35) Bit work,
(36) Bit footage,
(37) bit hours,
(38) Bit revolutions,
(39) Bit ROP,
(40) Drillstring maximum overputt,
(41) Bit compressive strength,
(42) Kick tolerance,
(43) Critical flow rate,
(44) Maximum flow rate,
(45) Small nozzle area,
(46) Standpipe pressure,
(47) ECD to fracture,
(48) ECD to losses,
(49) Subsea BOP,
(50) Large Hole,
(51) Small Hole,
(52) Number of casing strings,
(53) Drillstring parting,
(54) Cuttings.

Risk Assessment Logical Expressions 22

The following paragraphs will set forth the 'Risk Assessment Logical Expressions' 22. The 'Risk Assessment Logical-Expressions' 22 will: (1) receive the 'Input Data 20*a*' including a 'plurality of Input Data calculation results' that has been generated by the 'Input Data 20*a*'; (2) determine whether each of the 'plurality of Input Data calculation results' represent a high risk, a medium risk, or a low risk; and (3) generate a 'plurality of Risk Values' (also known as a 'plurality of Individual Risks), in response thereto, each of the plurality of Risk Values/plurality of Individual Risks representing a 'an Input Data calculation result' that has been 'ranked' as either a 'high risk', a 'medium risk', or a 'low risk'.

The Risk Assessment Logical Expressions 22 include the following:

Task: Scenario
Description: H2S and CO2 present for scenario indicated by user (per well)
Short Name: H2S_CO2
Data Name: H2S
Calculation: H2S and CO2 check boxes checked yes
Calculation Name: CalculateH2S_CO2
High: Both selected
Medium: Either one selected
Low: Neither selected
Unit: unitless Task: Scenario
Description: Hydrate development (per well)
Short Name: Hydrates
Data Name: Water Depth
Calculation: =Water Depth
Calculation Name: CalculateHydrates
High: >=3000
Medium: >=2000
Low: <2000
Unit: ft Task: Scenario
Description: Hydrate development (per well)
Short Name: Well_WD
Data Name: Water Depth
Calculation: =WaterDepth
Calculation Name: CalculateHydrates
High: >=5000
Medium: >=1000
Low: <1000
Unit: ft Task: Trajectory
Description: Dogleg severity (per depth)
Short Name: DLS
Data Name: Dog Leg Severity
Calculation: NA
Calculation Name: CalculateRisk
High: >=6
Medium: >=4
Low: <4
Unit: deg/100 ft Task: Trajectory
Description: Tortuosity (per depth)
Short Name: TORT
Data Name: Dog Leg Severity
Calculation: Summation of DLS
Calculation Name: CalculateTort
High: >=90
Medium: >=60
Low: <60
Unit: deg Task: Trajectory
Description: Inclination (per depth)
Short Name: INC
Data Name: Inclination
Calculation: NA
Calculation Name: CalculateRisk
High: >=65
Medium: >=40
Low: <40
Unit: deg Task: Trajectory
Description: Well inclinations with difficult cuttings transport conditions (per depth)
Short Name: Cutting
Data Name: Inclination
Calculation: NA
Calculation Name: CalculateCutting
High: >=45
Medium: >65
Low: <45
Unit: deg Task: Trajectory
Description: Horizontal to vertical ratio (per depth)
Short Name: Hor_Disp
Data Name: Inclination
Calculation: =Horizontal Displacement/True Vertical Depth
Calculation Name: CalculateHor Disp
High: >=1.0
Medium: >=0.5
Low: <0.5
Unit: Ratio Task: Trajectory
Description: Directional Drillability Index (per depth) Fake Threshold
Short Name: DDI
Data Name: Inclination
Calculation: =Calculate DDI using Resample data
Calculation Name: CalculateDDI
High: >6.8
Medium: >=6.0

Low: <6.0
Unit: unitless

Task: EarthModel
Description: High or supernormal Pore Pressure (per depth)
Short Name: PP_High
Data Name: Pore Pressure without Safety Margin
Calculation: =PP
Calculation Name: CalculateRisk
High: >=16
Medium: >=12
Low: <12
Unit: ppg Task: EarthModel
Description: Depleted or subnormal Pore Pressure (per depth)
Short Name: PP_Low
Data Name: Pore Pressure without Safety Margin
Calculation: =Pore Pressure without Safety Margin
Calculation Name: CalculateRisk
High: <=8.33
Medium: <=8.65
Low: >8.65
Unit: ppg Task: EarthModel
Description: Superhard rock (per depth)
Short Name: RockHard
Data Name: Unconfined Compressive Strength
Calculation: =Unconfined Compressive Strength
Calculation Name: CalculateRisk
High: >=25
Medium: >=16
Low: <16
Unit: kpsi Task: EarthModel
Description: Gumbo (per depth)
Short Name: RockSoft
Data Name: Unconfined Compressive Strength
Calculation: =Unconfined Compressive Strength
Calculation Name: CalculateRisk
High: <=2
Medium: <=4
Low: >4
Unit: kpsi Task: EarthModel
Description: High Geothermal Temperature (per depth)
Short Name: TempHigh
Data Name: StaticTemperature
Calculation: =Temp
Calculation Name: CalculateRisk
High: >=280
Medium: >=220
Low: <220
Unit: degF Task: RigConstraint
Description: Water depth as a ratio to the maximum water depth rating of the rig (per depth)
Short Name: Rig_WD
Data Name:
Calculation: =WD, Rig WD rating
Calculation Name: CalculateRig_WD
High: >=0.75
Medium: >=0.5
Low: <0.5
Unit: Ratio Task: RigConstraint
Description: Total measured depth as a ratio to the maximum depth rating of the rig (per depth)
Short Name: Rig_MD
Data Name:
Calculation: =MD/Rig MD rating
Calculation Name: CalculateRig_MD
High: >=0.75
Medium: >=0.5
Low: <0.5
Unit: Ratio Task: RigConstraint
"Description: Subsea BOP or wellhead (per well), not quite sure how to compute it"
Short Name: SS_BOP
Data Name: Water Depth
Calculation: =
Calculation Name: CalculateHydrates
High: >=3000
Medium: >=1000
Low: <1000
Unit: ft Task: MudWindow
Description: Kick potential where Mud Weight is too low relative to Pore Pressure (per depth)
Short Name: MW_Kick
Data Name:
Calculation: =Mud Weight−Pore Pressure
Calculation Name: CalculateMW_Kick
High: <=0.3
Medium: <=0.5
Low: >0.5
Unit: ppg Task: MudWindow
Description: Loss potential where Hydrostatic Pressure is too high relative to Pore Pressure (per depth)
Short Name: MW_Loss
Data Name:
Calculation: =Hydrostatic Pressure−Pore Pressure
Calculation Name: CalculateMW_Loss
"PreCondition: =Mud Type (HP-WBM, ND-WBM, D-WBM)"
High: >=2500
Medium: >=2000
Low: <2000
Unit: psi Task: MudWindow
Description: Loss potential where Hydrostatic Pressure is too high relative to Pore Pressure (per depth)
Short Name: MW_Loss
Data Name:
Calculation: =Hydrostatic Pressure−Pore Pressure
Calculation Method: CalculateMW_Loss "PreCondition: =Mud Type (OBM, MOBM, SOBM)"
High: >=2000
Medium: >=1500
Low: <1500
Unit: psi Task: MudWindow
Description: Loss potential where Mud Weight is too high relative to Fracture Gradient (per depth)
Short Name: MW_Frac
Data Name:
Calculation: =Upper Bound−Mud Weight Calculation Method: CalculateMW_Frac
High: <=0.2
Medium: <=0.5
Low: >0.5
Unit: ppg Task: MudWindow
Description: Narrow mud weight window (per depth)
Short Name: MWW
Data Name:
Calculation: =Upper Wellbore Stability Limit−Pore Pressure without Safety Margin
Calculation Method: CalculateMWW
High: <=0.5
Medium: <=1.0
Low: >1.0
Unit: ppg Task: MudWindow
Description: Narrow wellbore stability window (per depth)
Short Name: WBSW
Data Name:
Calculation: =Upper Bound−Lower Bound
Calculation Method: CalculateWBSW
"PreCondition: =Mud Type (OBM, MOBM, SOBM)"
High: <=0.3
Medium: <=0.6
Low: >0.6
Unit: ppg Task: MudWindow
Description: Narrow wellbore stability window (per depth)
Short Name: WBSW
Data Name:
Calculation: =Upper Bound−Lower Bound
Calculation Method: CalculateWBSW
"PreCondition: =Mud Type (HP-WBM, ND-WBM, D-WBM)"
High: <=0.4
Medium: <=0.8
Low: >0.8
Unit: ppg Task: MudWindow
Description: Wellbore Stability (per depth)
Short Name: WBS
Data Name: Pore Pressure without Safety Margin
Calculation: =Pore Pressure without Safety Margin
Calculation Method: CalculateWBS
High: LB>=MW>=PP
Medium: MW>=LB>=PP
Low: MW>=PP>=LB
Unit: unitless Task: MudWindow
Description: Hole section length (per hole section)
Short Name: HSLength
Data Name:
Calculation: =HoleEnd−HoleStart
Calculation Method: CalculateHSLength
High: >=8000
Medium: >=7001
Low: <7001
Unit: ft Task: MudWindow
Description: Dogleg severity at Casing points for casing wear (per hole section)
Short Name: Csg_Wear
Data Name: Dog Leg Severity
Calculation: =Hole diameter
Calculation Method: CalculateCsg_Wear
High: >=4
Medium: >=3
Low: <3
Unit: deg/100 ft Task: MudWindow
Description: Number of Casing strings (per hole section)
Short Name: Csg_Count
Data Name: Casing Point Depth
Calculation: =Number of Casing strings
Calculation Method: CalculateCsg_Count
High: >=6
Medium: >=4
Low: <4
Unit: unitless Task: WellboreSizes
Description: Large Hole size (per hole section)
Short Name: Hole_Big
Data Name: Hole Size
Calculation: =Hole diameter
Calculation Method: CalculateHoleSectionRisk
High: >=24
Medium: >=18.625
Low: <18.625
Unit: in Task: WellboreSizes
Description: Small Hole size (per hole section)
Short Name: Hole_Sm
Data Name: Hole Size
Calculation: =Hole diameter
Calculation Method: CalculateHole_Sm
PreCondition: Onshore
High: <=4.75
Medium: <=6.5
Low: >6.5
Unit: in Task: WellboreSizes
Description: Small Hole size (per hole section)
Short Name: Hole_Sm
Data Name: Hole Size
Calculation: =Hole diameter
Calculation Method: CalculateHole_Sm
PreCondition: Offshore
High: <=6.5
Medium: <=7.875
Low: >7.875
Unit: in Task: TubularDesign
"Description: Casing Design Factors for Burst, Collapse, & Tension (per hole section), DFb,c,t<=1.0 for High, DFb, c,t<=1.1 for Medium, DFb,c,t>1.1 for Low"
Short Name: Csg_DF
Data Name:
Calculation: =DF/Design Factor
Calculation Method: CalculateCsg_DF
High: <=1.0
Medium: <=1.1
Low: >1.1
Unit: unitless Task: TubularDesign
Description: Casing string weight relative to rig lifting capabilities (per casing string)
Short Name: Csg_Wt Data Name:
Calculation: =CasingWeight/RigMinRating
Calculation Method: CalculateCsg_Wt
High: >=0.95
Medium: <0.95
Low: <0.8
Unit: Ratio Task: TubularDesign
Description: Casing string allowable Margin of Overpull (per casing string)
Short Name: Csg_MOP
Data Name:
Calculation: =Tubular Tension rating-CasingWeight
Calculation Method: CalculateCsg_MOP
High: <=50
Medium: <=100
Low: >100
Unit: klbs Task: WellboreSizes
Description: Clearance between hole size and casing max OD (per hole section)
Short Name: Hole_Csg
Data Name:
Calculation: =Area of hole size, Area of casing size (max OD)
Calculation Method: CalculateHole_Csg
High: <=1.1
Medium: <=1.25
Low: >1.25
Unit: Ratio Task: WellboreSizes
Description:
Short Name: Csg_Csg
Data Name:
Calculation: =CainsgID/NextMaxCasingSize
Calculation Method: CalculateCsg_Csg
High: <=1.05
Medium: <=1.1
Low: >1.1
Unit: Ratio Task: WellboreSizes
Description: Clearance between casing inside diameter and subsequent bit size (per bit run)
Short Name: Csg_Bit
Data Name:
Calculation: =CainsgID/NextBit Size
Calculation Method: CalculateCsg_Bit
High: <=1.05
Medium: <=1.1
Low: >1.1
Unit: Ratio Task: CementDesign
Description: Cement height relative to design guidelines for each string type (per hole section)
Short Name: TOC_Low
Data Name:
Calculation: =CasingBottomDepth−TopDepthOfCement
Calculation Method: CalculateTOC_Low
High: <=0.75
Medium: <=1.0
Low: >1.0
Unit: Ratio Task: CementDesign
Description: Kick potential where Hydrostatic Pressure is too low relative to Pore Pressure (per depth)
Short Name: Cmt_Kick
Data Name:
Calculation: =(Cementing Hydrostatic Pressure−Pore Pressure)/TVD
Calculation Method: CalculateCmt_Kick
High: <=0.3
Medium: <=0.5
Low: >0.5
Unit: ppg Task: CementDesign
Description: Loss potential where Hydrostatic Pressure is too high relative to Pore Pressure (per depth)
Short Name: Cmt_Loss
Data Name:
Calculation: =Cementing Hydrostatic Pressure−Pore Pressure
Calculation Method: CalculateCmt_Loss
High: >=2500
Medium: >=2000
Low: <2000
Unit: psi Task: CementDesign
Description: Loss potential where Hydrostatic Pressure is too high relative to Fracture Gradient (per depth)
Short Name: Cmt_Frac
Data Name:
Calculation: =(UpperBound−Cementing Hydrostatic Pressure)/TVD
Calculation Method: CalculateCmt_Frac
High: <=0.2
Medium: <=0.5
Low: >0.5
Unit: ppg Task: BitsSelection
Description: Excess bit work as a ratio to the Cumulative Mechanical drilling energy (UCS integrated over distance drilled by the bit)
Short Name: Bit_WkXS
Data Name: CumExcessCumulative UCSRatio
Calculation: =CumExcess/Cumulative UCS
Calculation Method: CalculateBitSectionRisk
High: >=0.2
Medium:>=0.1
Low: <0.1
Unit: Ratio Task: BitsSelection
Description: Cumulative bit work as a ratio to the bit catalog average Mechanical drilling energy (UCS integrated over distance drilled by the bit)
Short Name: Bit_Wk
Data Name:
Calculation: =Cumulative UCS/Mechanical drilling energy (UCS integrated over distance drilled by the bit)
Calculation Method: CalculateBit_Wk
High: >=1.5
Medium: >=1.25
Low: <1.25
Unit: Ratio Task: BitsSelection
Description: Cumulative bit footage as a ratio to the bit catalog average footage (drilled length) (per depth)

Short Name: Bit_Ftg
Data Name: Ratio of footage drilled compared to statistical footage
Calculation: =Ratio of footage drilled compared to statistical footage
Calculation Method: CalculateBitSectionRisk
High: >=2
Medium: >=1.5
Low: <1.5
Unit: Ratio Task: BitsSelection
Description: Cumulative bit hours as a ratio to the bit catalog average hours (on bottom rotating time) (per depth)
Short Name: Bit_Hrs
Data Name: Bit_Ftg
Calculation: =On Bottom Hours/Statistical Bit Hours
Calculation Method: CalculateBit_Hrs
High: >=2
Medium: >=1.5
Low: <1.5
Unit: Ratio Task: BitsSelection
Description: Cumulative bit Krevs as a ratio to the bit catalog average Krevs (RPM*hours) (per depth)
Short Name: Bit_Krev
Data Name:
Calculation: =Cumulative Krevs, Bit average Krevs
Calculation Method: CalculateBit_Krev
High: >=2
Medium: >=1.5
Low: <1.5
Unit: Ratio Task: BitsSelection
Description: Bit ROP as a ratio to the bit catalog average ROP (per bit run)
Short Name: Bit_ROP
Data Name:
Calculation: =ROP/Statistical Bit ROP
Calculation Method: CalculateBit_ROP
High: >=1.5
Medium: >=1.25
Low: <1.25
Unit: Ratio Task: BitsSelection
Description: UCS relative to Bit UCS and Max Bit UCS (per depth)
Short Name: Bit_UCS
Data Name:
Calculation: =UCS
Calculation Method: CalculateBit_UCS
High: UCS>=Max Bit UCS>=Bit UCS
Medium: Max Bit UCS>=UCS>=Bit UCS
Low: Max Bit UCS>=Bit UCS>=UCS
Unit: Ratio Task: DrillstringDesign
Description: Drillstring allowable Margin of Overpull (per bit run)
Short Name: DS_MOP
Data Name:
Calculation: =MOP
Calculation Method: CalculateDS_MOP
High: <=50
Medium: <=100
Low: >100
Unit: klbs Task: DrillstringDesign
"Description: Potential parting of the drillstrings where required tension approaches mechanical tension limits of drill pipe, heavy weight, drill pipe, drill collars, or connections (per bit run)"
Short Name: DS_Part
Data Name:
Calculation: =Required Tension (including MOP)/Tension limit of drilling component (DP)
Calculation Method: CalculateDS_Part
High: >=0.9
Medium: >=0.8
Low: >0.8
Unit: ratio Task: DrillstringDesign
Description: Kick Tolerance (per hole section)
Short Name: Kick_Tol
Data Name: Bit_UCS
"Calculation: NA (already calculated), Exploration/Development"
Calculation Method: CalculateKick_Tol
PreCondition: Exporation
High: <=50
Medium: <=100
Low: >100
Unit: bbl Task: DrillstringDesign
Description: Kick Tolerance (per hole section)
Short Name: Kick_Tol
Data Name: Bit_UCS
"Calculation: NA (already calculated), Exploration/Development"
Calculation Method: CalculateKick_Tol
PreCondition: Development
High: <=25
Medium: <=50
Low: >50
Unit: bbl Task: Hydraulics
Description: Flow rate for hole cleaning (per depth)
Short Name: Q_Crit
"Data Name: Flow Rate, Critical Flow Rate"
Calculation: =Flow Rate/Critical Flow Rate
Calculation Method: CalculateQ_Crit
High: <=1.0
Medium: <=1.1
Low: >1.1
Unit: Ratio Task: Hydraulics
Description: Flow rate relative to pump capabilities(per depth)
Short Name: Q_Max
Data Name: Bit_UCS
Calculation: =Q/Qmax
Calculation Method: CalculateQ_Max
High: >=1.0
Medium: >=0.9
Low: <0.9
Unit: Ratio Task: Hydraulics
"Description: TFA size relative to minimum TFA (per bit run), 0.2301=3 of 10/32 inch, 0.3313=3 of 12/32 inch"
Short Name: TFA_Low Data Name: Bit_UCS
Calculation: TFA
Calculation Method: CalculateTFA_Low
High: <=0.2301
Medium: <=0.3313
Low: >0.3313
Unit: inch Task: Hydraulics
Description: Circulating pressure relative to rig and pump maximum pressure (per depth)
Short Name: P_Max
Data Name: Bit_UCS
Calculation: P_Max
Calculation Method: CalculateP_Max
High: >=1.0
Medium: >=0.9
Low: <0.9
Unit: Ratio Task: Hydraulics
Description: Loss potential where ECD is too high relative to Fracture Gradient (per depth)
Short Name: ECD_Frac
Data Name: Bit_UCS
Calculation: UpperBound-ECD
Calculation Method: CalculateECD_Frac
High: <=0.0
Medium: <=0.2
Low: >0.2
Unit: ppg Task: Hydraulics
Description: Loss potential where ECD is too high relative to Pore Pressure (per depth)
Short Name: ECD_Loss
Data Name: Bit_UCS
Calculation: =ECD−Pore Pressure
Calculation Method: CalculateECD_Loss
"PreCondition: Mud Type (HP-WBM, ND-WBM, D-WBM)"
High: >=2500
Medium: >=2000
Low: <2000
Unit: psi Task: Hydraulics
Description: Loss potential where ECD is too high relative to Pore Pressure (per depth)
Short Name: ECD_Loss
Data Name: Bit_UCS
Calculation: =ECD−Pore Pressure
Calculation Method: CalculateECD_Loss
"PreCondition: Mud Type (OBM, MOBM, SOBM)"
High: >=2000
Medium: >=1500
Low: <1500
Unit: psi Risk Assessment Algorithms 24

Recall that the 'Risk Assessment Logical Expressions' 22 will: (1) receive the 'Input Data 20*a*' including a 'plurality of Input Data calculation results' that has been generated by the 'Input Data 20*a*'; (2) determine whether each of the 'plurality of Input Data calculation results' represent a high risk, a medium risk, or a low risk; and (3) generate a plurality of Risk Values/plurality of Individual Risks in response thereto, where each of the plurality of Risk Values/plurality of Individual Risks represents a 'an Input Data calculation result' that has been 'ranked' as either a 'high risk', a 'medium risk', or a 'low risk'. For example, recall the following task:

Task: Hydraulics
Description: Loss potential where ECD is too high relative to Pore Pressure (per depth)
Short Name: ECD_Loss
Data Name: Bit _UCS
Calculation: =ECD−Pore Pressure
Calculation Method: CalculateECD_Loss
"PreCondition: Mud Type (OBM, MOBM, SOBM)"
High: >=2000
Medium: >=1500
Low: <1500
Unit: psi When the Calculation 'ECD−Pore Pressure' associated with the above referenced Hydraulics task is >=2000, a 'high' rank is assigned to that calculation; but if the Calculation 'ECD−Pore Pressure' is >=1500, a 'medium' rank is assigned to that calculation, but if the Calculation 'ECD−Pore Pressure' is <1500, a 'low' rank is assigned to that calculation.

Therefore, the 'Risk Assessment Logical Expressions' 22 will rank each of the 'Input Data calculation results' as either a 'high risk' or a 'medium risk' or a 'low risk' thereby generating a 'plurality of ranked Risk Values', also known as a 'plurality of ranked Individual Risks'. In response to the 'plurality of ranked Individual Risks' received from the Logical Expressions 22, the 'Risk Assessment Logical Algorithms' 24 will then assign a 'value' and a 'color' to each of the plurality of ranked Individual Risks received from the Logical Expressions 22, where the 'value' and the 'color' depends upon the particular ranking (i.e., the 'high risk' rank, or the 'medium risk' rank, or the 'low risk' rank) that is associated with each of the plurality of ranked Individual Risks. The 'value' and the 'color' is assigned, by the 'Risk Assessment Algorithms' 24, to each of the plurality of Individual Risks received from the Logical Expressions 22 in the following manner:

Risk Calculation #1—Individual Risk Calculation:

Referring to the 'Risk Assessment Output Data' 18*b*1 set forth above, there are fifty-four (54) 'Individual Risks' currently specified. For an 'Individual Risk':

a High risk=90,
a Medium risk=70, and
a Low risk=10
High risk color code=Red
Medium risk color code=Yellow
Low risk color code=Green If the 'Risk Assessment Logical Expressions' 22 assigns a 'high risk' rank to a particular 'Input Data calculation result', the 'Risk Assessment Algorithms' 24 will then assign a value '90' to that 'Input Data calculation result' and a color 'red' to that 'Input Data calculation result'.

If the 'Risk Assessment Logical Expressions' 22 assigns a 'medium risk' rank to a particular 'Input Data calculation result', the 'Risk Assessment Algorithms' 24 will then assign a value '70' to that 'Input Data calculation result' and a color 'yellow' to that 'Input Data calculation result'.

If the 'Risk Assessment Logical Expressions' 22 assigns a 'low risk' rank to a particular 'Input Data calculation result', the 'Risk Assessment Algorithms' 24 will then assign a value '10' to that 'Input Data calculation result' and a color 'green' to that 'Input Data calculation result'.

Therefore, in response to the 'Ranked Individual Risks' from the Logical Expressions 22, the Risk Assessment Algorithms 24 will assign to each of the 'Ranked Individual Risks' a value of 90 and a color 'red' for a high risk, a value of 70 and a color 'yellow' for the medium risk, and a value of 10 and a color 'green' for the low risk. However, in addition, in response to the 'Ranked Individual Risks' from the Logical Expressions 22, the Risk Assessment Algorithms 24 will also generate a plurality of ranked 'Risk Categories' and a plurality of ranked 'Subcategory Risks'

Referring to the 'Risk Assessment Output Data' **18*b*1 set forth above, the 'Risk Assessment Output Data' 18*b*1** includes: (1) eight 'Risk Categories', (2) four 'Subcategory Risks', and (3) fifty-four (54) 'Individual Risks' [ that is, 54 individual risks plus 2 'gains' plus 2 'losses' plus 2 'stuck' plus 2 'mechanical' plus 1 'total'=63 risks].

The eight 'Risk Categories' include the following: (1) an Individual Risk, (2) an Average Individual Risk, (3) a Risk Subcategory (or Subcategory Risk), (4) an Average Subcategory Risk, (5) a Risk Total (or Total Risk), (6) an Average Total Risk, (7) a potential Risk for each design task, and (8) an Actual Risk for each design task.

Recalling that the 'Risk Assessment Algorithms' 24 have already established and generated the above referenced 'Risk Category (1)' [i.e., the plurality of ranked Individual Risks'] by assigning a value of 90 and a color 'red' to a high risk 'Input Data calculation result', a value of 70 and a color 'yellow' to a medium risk 'Input Data calculation result', and a value of 10 and a color 'green' to a low risk 'Input Data calculation result', the 'Risk Assessment Algorithms' 24 will now calculate and establish and generate the above referenced 'Risk Categories (2) through (8)' in response to the plurality of Risk Values/plurality of Individual Risks received from the 'Risk Assessment Logical Expressions' 22 in the following manner:

Risk Calculation #2—Average Individual Risk:

The average of all of the 'Risk Values' is calculated as follows:

$$\text{Average individual risk} = \frac{\sum_{i}^{n} Riskvalue_i}{n}$$

In order to determine the 'Average Individual Risk', sum the above referenced 'Risk Values' and then divide by the number of such 'Risk Values', where i=number of sample points. The value for the 'Average Individual Risk' is displayed at the bottom of the colored individual risk track.

Risk Calculation #3—Risk Subcategory

Referring to the 'Risk Assessment Output Data' **18*b*1** set forth above, the following 'Subcategory Risks' are defined: (a) gains, (b) losses, (c) stuck and (d) mechanical, where a 'Subcategory Risk' (or 'Risk Subcategory') is defined as follows:

$$\text{Risk Subcategory} = \frac{\sum_{j}^{n} (Riskvalue_j \times severity_j \times N_j)}{\sum_{j} (severity_j \times N_j)}$$

j=number of individual risks,

0≦Severity≦5, and $N_j$=either 1 or 0 depending on whether the Risk $Value_j$ contributes to the sub category $Severity_j$=from the risk matrix catalog.

Red risk display for Risk Subcategory≧40

Yellow risk display for 20≦Risk Subcategory<40

Green risk display for Risk Subcategory<20

Risk Calculation #4—Average Subcategory Risk:

$$\text{Average subcategory risk} = \frac{\sum_{i}^{n} (\text{Risk } Subcategory_i \times \text{risk } multiplier_i)}{\sum_{1}^{n} \text{risk } multiplier_i}$$

n=number of sample points.

The value for the average subcategory risk is displayed at the bottom of the colored subcategory risk track.

Risk Multiplier=3 for Risk Subcategory≧40,

Risk Multiplier=2 for 20≦Risk Subcategory<40

Risk Multiplier=1 for Risk Subcategory<20

Risk Calculation #5—Total Risk

The total risk calculation is based on the following categories: (a) gains, (b) losses, (c) stuck, and (d) mechanical.

$$\text{Risk Total} = \frac{\sum_{1}^{4} \text{Risk } subcategory_k}{4} \quad \text{where } k = \text{number of subcategories}$$

Red risk display for Risk total≧40

Yellow risk display for 20≦Risk Total<40

Green risk display for Risk Total<20

Risk Calculation #6—Average Total Risk $$\text{Average total risk} = \frac{\sum_{i}^{n} (\text{Risk } Subcategory_i \times \text{risk } multiplier_i)}{\sum_{1}^{n} \text{risk } multiplier_i}$$

n=number of sample points.

Risk Multiplier=3 for Risk Subcategory≧40,

Risk Multiplier=2 for 20≦Risk Subcategory<40

Risk Multiplier=1 for Risk Subcategory<20

The value for the average total risk is displayed at the bottom of the colored total risk track.

Risk calculation #7—Risks per Design Task:

The following 14 design tasks have been defined: Scenario, Trajectory, Mechanical Earth Model, Rig, Wellbore stability, Mud weight and casing points, Wellbore Sizes, Casing, Cement, Mud, Bit, Drillstring, Hydraulics, and Time design. There are currently 54 individual risks specified.

Risk calculation #7A—Potential Maximum Risk per Design Task $$\text{Potential } Risk_k = \frac{\sum_{j=1}^{55} (90 \times Severity_{k,j} \times N_{k,j})}{\sum_{j=1}^{55} (Severity_{k,j} \times N_{k,j})}$$

k=index of design tasks, there are 14 design tasks, $N_j$=either 0 or 1 depending on whether the Risk Value$_j$ contributes to the design task.

$0 \leqq \text{Severity} \leqq 5$

Risk calculation #7B—Actual Risk per Design Task $$\text{Actual } Risk_k = \frac{\sum_{j=1}^{55} (\text{Average Individual } Risk_j \times Severity_{,j} \times N_{k,j})}{\sum_{j=1}^{55} (Severity_j \times N_{k,j})}$$

k=index of design tasks, there are 14 design tasks $N_{k,j} \in [0, \ldots, M]$ $0 \leqq \text{Severity}_j \leqq 5$ The 'Severity' in the above equations are defined as follows:

| Risk | Severity |
|---|---|
| H2S_C02 | 2.67 |
| Hydrates | 3.33 |
| Well_WD | 3.67 |
| DLS | 3 |
| TORT | 3 |
| Well_MD | 4.33 |
| INC | 3 |
| Hor_Disp | 4.67 |
| DDI | 4.33 |
| PP_High | 4.33 |
| PP_Low | 2.67 |
| RockHard | 2 |
| RockSoft | 1.33 |
| TempHigh | 3 |
| Rig_WD | 5 |
| Rig_MD | 5 |
| SS_BOP | 3.67 |
| MW_Kick | 4 |
| MW_Loss | 3 |
| MW_Frac | 3.33 |
| MWW | 3.33 |
| WBS | 3 |
| WBSW | 3.33 |
| HSLength | 3 |
| Hole_Big | 2 |
| Hole_Sm | 2.67 |
| Hole_Csg | 2.67 |
| Csg_Csg | 2.33 |
| Csg_Bit | 1.67 |
| Csg_DF | 4 |
| Csg_Wt | 3 |
| Csg_MOP | 2.67 |
| Csg_Wear | 1.33 |
| Csg_Count | 4.33 |
| TOC_Low | 1.67 |
| Cmt_Kick | 3.33 |
| Cmt_Loss | 2.33 |
| Cmt_Frac | 3.33 |
| Bit_Wk | 2.33 |

-continued

| Risk | Severity |
|---|---|
| Bit_WkXS | 2.33 |
| Bit_Ftg | 2.33 |
| Bit_Hrs | 2 |
| Bit_Krev | 2 |
| Bit_ROP | 2 |
| Bit_UCS | 3 |
| DS_MOP | 3.67 |
| DS_Part | 3 |
| Kick_Tol | 4.33 |
| Q_Crit | 2.67 |
| Q_Max | 3.33 |
| Cutting | 3.33 |
| P_Max | 4 |
| TFA_Low | 1.33 |
| ECD_Frac | 4 |
| ECD_Loss | 3.33 |

Figure 11:
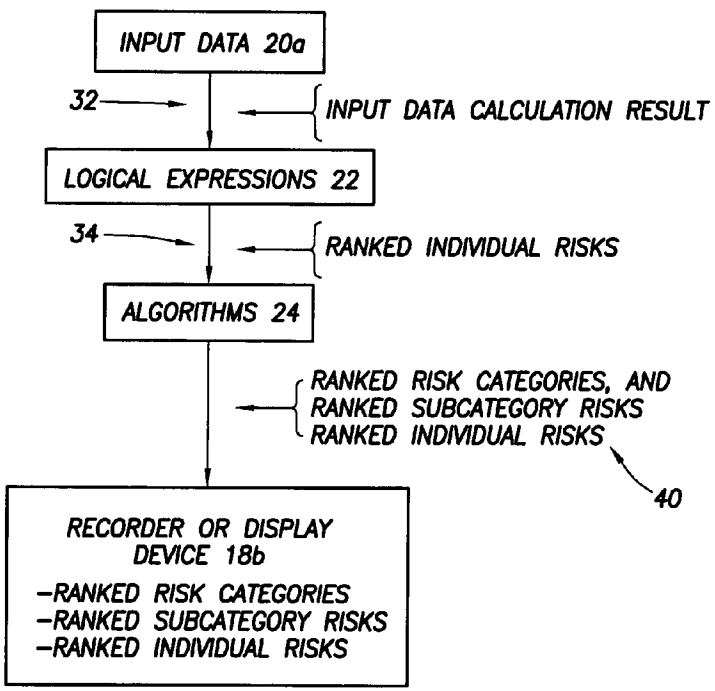
FIG. 11 illustrates a block diagram representing a construction of the Automatic Well Planning Risk Assessment software of FIG. 10 which is stored in the Computer System of FIG. 9A.

Refer now to FIG. 11 which will be used during the following functional description of the operation of the present invention.

A functional description of the operation of the 'Automatic Well Planning Risk Assessment Software' 18*c*1 will be set forth in the following paragraphs with reference to FIGS. 1 through 11 of the drawings.

The Input Data 20*a* shown in FIG. 9A will be introduced as 'input data' to the Computer System 18 of FIG. 9A. The Processor 18*a* will execute the Automatic Well Planning Risk Assessment Software 18*c*1, while using the Input Data 20*a*, and, responsive thereto, the Processor 18*a* will generate the Risk Assessment Output Data 18*b*1, the Risk Assessment Output Data 18*b*1 being recorded or displayed on the Recorder or Display Device 18*b* in the manner illustrated in FIG. 9B. The Risk Assessment Output Data 18*b*1 includes the 'Risk Categories', the 'Subcategory Risks', and the 'Individual Risks'. When the Automatic Well Planning Risk Assessment Software 18*c*1 is executed by the Processor 18*a* of FIG. 9A, referring to FIGS. 10 and 11, the Input Data 20*a* (and the Risk Assessment Constants 26 and the Risk Assessment Catalogs 28) are collectively provided as 'input data' to the Risk Assessment Logical Expressions 22. Recall that the Input Data 20*a* includes a 'plurality of Input Data Calculation results'. As a result, as denoted by element numeral 32 in FIG. 11, the 'plurality of Input Data Calculation results' associated with the Input Data 20*a* will be provided directly to the Logical Expressions block 22 in FIG. 11. During that execution of the Logical Expressions 22 by the Processor 18*a*, each of the 'plurality of Input Data Calculation results' from the Input Data 20*a* will be compared with each of the 'logical expressions' in the Risk Assessment Logical Expressions block 22 in FIG. 11. When a match is found between an 'Input Data Calculation result' from the Input Data 20*a* and an 'expression' in the Logical Expressions block 22, a 'Risk Value' or 'Individual Risk' 34 will be generated (by the Processor 18*a*) from the Logical Expressions block 22 in FIG. 11. As a result, since a 'plurality of Input Data Calculation results' 32 from the Input Data 20*a* have been compared with a 'plurality of expressions' in the Logical Expressions' block 22 in FIG. 11, the Logical Expressions block 22 will generate a plurality of Risk Values/plurality of Individual Risks 34 in FIG. 11, where each of the plurality of Risk Values/plurality of Individual Risks on line 34 in FIG. 11 that are generated by the Logical Expressions block 22 will represent an 'Input Data Calculation result' from the Input Data 20*a* that has been ranked as either a 'High Risk', or a 'Medium Risk', or a 'Low Risk' by the Logical Expressions block 22. Therefore, a 'Risk Value' or 'Individual Risk' is defined as an 'Input Data Calculation result' from the Input Data 20*a* that has been matched with one of the 'expressions' in the Logical Expressions 22 and ranked, by the Logical Expressions block 22, as either a 'High Risk', or a 'Medium Risk', or a 'Low Risk'. For example, consider the following 'expression' in the Logical Expressions' 22:

Task: MudWindow
Description: Hole section length (per hole section)
Short Name: HSLength
Data Name:
Calculation: =HoleEnd−HoleStart
Calculation Method: CalculateHSLength
High: >=8000
Medium: >=7001
Low: <7001

The 'Hole End−HoleStart' calculation is an 'Input Data Calculation result' from the Input Data 20*a*. The Processor 18*a* will find a match between the 'Hole End−HoleStart Input Data Calculation result' originating from the Input Data 20*a* and the above identified 'expression' in the Logical Expressions 22. As a result, the Logical Expressions block 22 will 'rank' the 'Hole End−HoleStart Input Data Calculation result' as either a 'High Risk', or a 'Medium Risk', or a 'Low Risk' depending upon the value of the 'Hole End−HoleStart Input Data Calculation result'.

When the 'Risk Assessment Logical Expressions' 22 ranks the 'Input Data calculation result' as either a 'high risk' or a 'medium risk' or a 'low risk' thereby generating a plurality of ranked Risk Values/plurality of ranked Individual Risks, the 'Risk Assessment Logical Algorithms' 24 will then assign a 'value' and a 'color' to that ranked 'Risk Value' or ranked 'Individual Risk', where the 'value' and the 'color' depends upon the particular ranking (i.e., the 'high risk' rank, or the 'medium risk' rank, or the 'low risk' rank) that is associated with that 'Risk Value' or 'Individual Risk'. The 'value' and the 'color' is assigned, by the 'Risk Assessment Logical Algorithms' 24, to the ranked 'Risk Values' or ranked 'Individual Risks' in the following manner:

a High risk=90,
a Medium risk=70, and
a Low risk=10
High risk color code=Red
Medium risk color code=Yellow
Low risk color code=Green If the 'Risk Assessment Logical Expressions' 22 assigns a 'high risk' rank to the 'Input Data calculation result' thereby generating a ranked 'Individual Risk', the 'Risk Assessment Logical Algorithms' 24 assigns a value '90' to that ranked 'Risk Value' or ranked 'Individual Risk' and a color 'red' to that ranked 'Risk Value' or that ranked 'Individual Risk'. If the 'Risk Assessment Logical Expressions' 22 assigns a 'medium risk' rank to the 'Input Data calculation result' thereby generating a ranked 'Individual Risk', the 'Risk Assessment Logical Algorithms' 24 assigns a value '70' to that ranked 'Risk Value' or ranked 'Individual Risk' and a color 'yellow' to that ranked 'Risk Value' or that ranked 'Individual Risk'. If the 'Risk Assessment Logical Expressions' 22 assigns a 'low risk' rank to the 'Input Data calculation result' thereby generating a ranked 'Individual Risk', the 'Risk Assessment Logical Algorithms' 24 assigns a value '10' to that ranked 'Risk Value' or ranked 'Individual Risk' and a color 'green' to that ranked 'Risk Value' or that ranked 'Individual Risk'.

Therefore, in FIG. 11, a plurality of ranked Individual Risks (or ranked Risk Values) is generated, along line 34, by the Logical Expressions block 22, the plurality of ranked Individual Risks (which forms a part of the 'Risk Assessment Output Data' 18*b*1) being provided directly to the 'Risk Assessment Algorithms' block 24. The 'Risk Assessment Algorithms' block 24 will receive the plurality of ranked Individual Risks' from line 34 and, responsive thereto, the 'Risk Assessment Algorithms' 24 will: (1) generate the 'Ranked Individual Risks' including the 'values' and 'colors' associated therewith in the manner described above, and, in addition, (2) calculate and generate the 'Ranked Risk Categories' 40 and the 'Ranked Subcategory Risks' 40 associated with the 'Risk Assessment Output Data' 18*b*1. The 'Ranked Risk Categories' 40 and the 'Ranked Subcategory Risks' 40 and the 'Ranked Individual Risks' 40 can now be recorded or displayed on the Recorder or Display device 18b. Recall that the 'Ranked Risk Categories' 40 include: an Average Individual Risk, an Average Subcategory Risk, a Risk Total (or Total Risk), an Average Total Risk, a potential Risk for each design task, and an Actual Risk for each design task. Recall that the 'Ranked Subcategory Risks' 40 include: a Risk Subcategory (or Subcategory Risk).

As a result, recalling that the 'Risk Assessment Output Data' 18*b*1 includes 'one or more Risk Categories' and 'one or more Subcategory Risks' and 'one or more Individual Risks', the 'Risk Assessment Output Data' 18*b*1, which includes the Risk Categories 40 and the Subcategory Risks 40 and the Individual Risks 40, can now be recorded or displayed on the Recorder or Display Device 18*b* of the Computer System 18 shown in FIG. 9A.

As noted earlier, the 'Risk Assessment Algorithms' 24 will receive the 'Ranked Individual Risks' from the Logical Expressions 22 along line 34 in FIG. 1; and, responsive thereto, the 'Risk Assessment Algorithms' 24 will (1) assign the 'values' and the 'colors' to the 'Ranked Individual Risks' in the manner described above, and, in addition, (2) calculate and generate the 'one or more Risk Categories' 40 and the 'one or more Subcategory Risks' 40 by using the following equations (set forth above).

The average Individual Risk is calculated from the 'Risk Values' as follows:

$$\text{Average individual risk} = \frac{\sum_{i}^{n} Riskvalue_i}{n}$$

The Subcategory Risk, or Risk Subcategory, is calculated from the 'Risk Values' and the 'Severity', as defined above, as follows:

$$\text{Risk Subcategory} = \frac{\sum_{j}^{n} (Riskvalue_j \times severity_j \times N_j)}{\sum_{j} (severity_j \times N_j)}$$

The Average Subcategory Risk is calculated from the Risk Subcategory in the following manner, as follows:

$$\text{Average subcategory risk} = \frac{\sum_{i}^{n} (\text{Risk } Subcategory_i \times \text{risk } multiplier_i)}{\sum_{1}^{n} \text{risk } multiplier_i}$$

The Risk Total is calculated from the Risk Subcategory in the following manner, as follows:

$$\text{Risk Total} = \frac{\sum_{1}^{4} \text{Risk } subcategory_k}{4}$$

The Average Total Risk is calculated from the Risk Subcategory in the following manner, as follows:

$$\text{Average total risk} = \frac{\sum_{i}^{n} (\text{Risk } Subcategory_i \times \text{risk } multiplier_i)}{\sum_{1}^{n} risk\ multiplier_i}$$

The Potential Risk is calculated from the Severity, as defined above, as follow:

$$\text{Potential } Risk_k = \frac{\sum_{j=1}^{55} (90 \times Severity_{k,j} \times N_{k,j})}{\sum_{j=1}^{55} (Severity_{k,j} \times N_{k,j})}$$

The Actual Risk is calculated from the Average Individual Risk and the Severity (defined above) as follows:

$$\text{Actual } Risk_k = \frac{\sum_{j=1}^{55} (\text{Average Individual } Risk_j \times Severity_{,j} \times N_{k,j})}{\sum_{j=1}^{55} (Severity_j \times N_{k,j})}$$

Recall that the Logical Expressions block 22 will generate a 'plurality of Risk Values/Ranked Individual Risks' along line 34 in FIG. 11, where each of the 'plurality of Risk Values/Ranked Individual Risks' generated along line 34 represents a received 'Input Data Calculation result' from the Input Data 20*a* that has been 'ranked' as either a 'High Risk', or a 'Medium Risk', or a 'Low Risk' by the Logical Expressions 22. A 'High Risk' will be assigned a 'Red' color, and a 'Medium Risk' will be assigned a 'Yellow' color, and a 'Low Risk' will be assigned a 'Green' color. Therefore, noting the word 'rank' in the following, the Logical Expressions block 22 will generate (along line 34 in FIG. 11) a 'plurality of ranked Risk Values/ranked Individual Risks'.

In addition, in FIG. 11, recall that the 'Risk Assessment Algorithms' block 24 will receive (from line 34) the 'plurality of ranked Risk Values/ranked Individual Risks' from the Logical Expressions block 22. In response thereto, noting the word 'rank' in the following, the 'Risk Assessment Algorithms' block 24 will generate: (1) the 'one or more Individual Risks having 'values' and 'colors' assigned thereto, (2) the 'one or more ranked Risk Categories' 40, and (3) the 'one or more ranked Subcategory Risks' 40. Since the 'Risk Categories' and the 'Subcategory Risks' are each 'ranked', a 'High Risk' (associated with a Risk Category 40 or a Subcategory Risk 40) will be assigned a 'Red' color, and a 'Medium Risk' will be assigned a 'Yellow' color, and a 'Low Risk' will be assigned a 'Green' color. In view of the above 'rankings' and the colors associated therewith, the 'Risk Assessment Output Data' 18*b*1, including the 'ranked' Risk Categories 40 and the 'ranked' Subcategory Risks 40 and the 'ranked' Individual Risks 38, will be recorded or displayed on the Recorder or Display Device 18*b* of the Computer System 18 shown in FIG. 9A in the manner illustrated in FIG. 9B.

Automatic Well Planning Software System—Bit Selection sub-task 14*a*

In FIG. 8, the Bit Selection sub-task 14*a* is illustrated.

The selection of Drill bits is a manual subjective process based heavily on personal, previous experiences. The experience of the individual recommending or selecting the drill bits can have a large impact on the drilling performance for the better or for the worse. The fact that bit selection is done primarily based on personal experiences and uses little information of the actual rock to be drilled makes it very easy to choose the incorrect bit for the application.

The Bit Selection sub-task 14*a* utilizes an 'Automatic Well Planning Bit Selection software', in accordance with the present invention, to automatically generate the required drill bits to drill the specified hole sizes through the specified hole section at unspecified intervals of earth. The 'Automatic Well Planning Bit Selection software' of the present invention includes a piece of software (called an 'algorithm') that is adapted for automatically selecting the required sequence of drill bits to drill each hole section (defined by a top/bottom depth interval and diameter) in the well. It uses statistical processing of historical bit performance data and several specific Key Performance Indicators (KPI) to match the earth properties and rock strength data to the appropriate bit while optimizing the aggregate time and cost to drill each hole section. It determines the bit life and corresponding depths to pull and replace a bit based on proprietary algorithms, statistics, logic, and risk factors.

Figure 12:
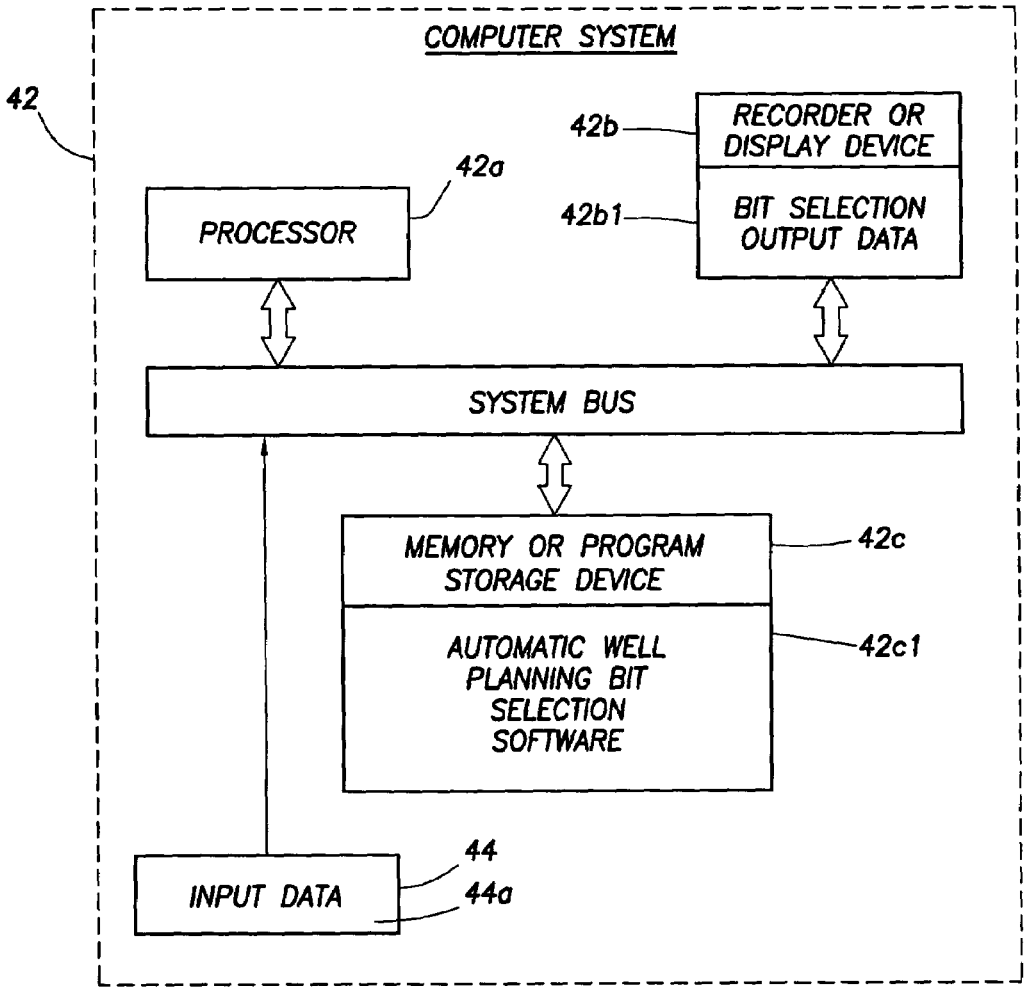
FIG. 12 illustrates a Computer System which stores an Automatic Well Planning Bit Selection software in accordance with the present invention.

Referring to FIG. 12, a Computer System 42 is illustrated. The Computer System 42 includes a Processor 42*a* connected to a system bus, a Recorder or Display Device 42*b* connected to the system bus, and a Memory or Program Storage Device 42*c* connected to the system bus. The Recorder or Display Device 42*b* is adapted to display 'Bit Selection Output Data' 42*b*1. The Memory or Program Storage Device 42*c* is adapted to store an 'Automatic Well Planning Bit selection Software' 42*c*1. The 'Automatic Well Planning Bit selection Software' 42*c*1 is originally stored on another 'program storage device', such as a hard disk; however, the hard disk was inserted into the Computer System 42 and the 'Automatic Well Planning Bit selection Software' 42*c*1 was loaded from the hard disk into the Memory or Program Storage Device 42*c* of the Computer System 42 of FIG. 12. In addition, a Storage Medium 44 containing a plurality of 'Input Data' 44*a* is adapted to be connected to the system bus of the Computer System 42, the 'Input Data' 44*a* being accessible to the Processor 42*a* of the Computer System 42 when the Storage Medium 44 is connected to the system bus of the Computer System 42. In operation, the Processor 42*a* of the Computer System 42 will execute the Automatic Well Planning Bit selection Software 42*c*1 stored in the Memory or Program Storage Device 42*c* of the Computer System 42 while, simultaneously, using the 'Input Data' 44*a* stored in the Storage Medium 44 during that execution. When the Processor 42*a* completes the execution of the Automatic Well Planning Bit selection Software 42*c*1 stored in the Memory or Program Storage Device 42*c* (while using the 'Input Data' 44*a*), the Recorder or Display Device 42*b* will record or display the 'Bit selection Output Data' 42*b*1, as shown in FIG. 12. For example the 'Bit selection Output Data' 42*b*1 can be displayed on a display screen of the Computer System 42, or the 'Bit selection Output Data' 42*b*1 can be recorded on a printout which is generated by the Computer System 42. The 'Input Data' 44*a* and the 'Bit Selection Output Data' 42*b*1 will be discussed and specifically identified in the following paragraphs of this specification. The 'Automatic Well Planning Bit Selection software' 42*c*1 will also be discussed in the following paragraphs of this specification. The Computer System 42 of FIG. 12 may be a personal computer (PC). The Memory or Program Storage Device 42*c* is a computer readable medium or a program storage device which is readable by a machine, such as the processor 42*a*. The processor 42*a* may be, for example, a microprocessor, a microcontroller, or a mainframe or workstation processor. The Memory or Program Storage Device 42*c*, which stores the 'Automatic Well Planning Bit selection Software' 42*c*1, may be, for example, a hard disk, ROM, CD-ROM, DRAM, or other RAM, flash memory, magnetic storage, optical storage, registers, or other volatile and/or non-volatile memory.

Figure 13:
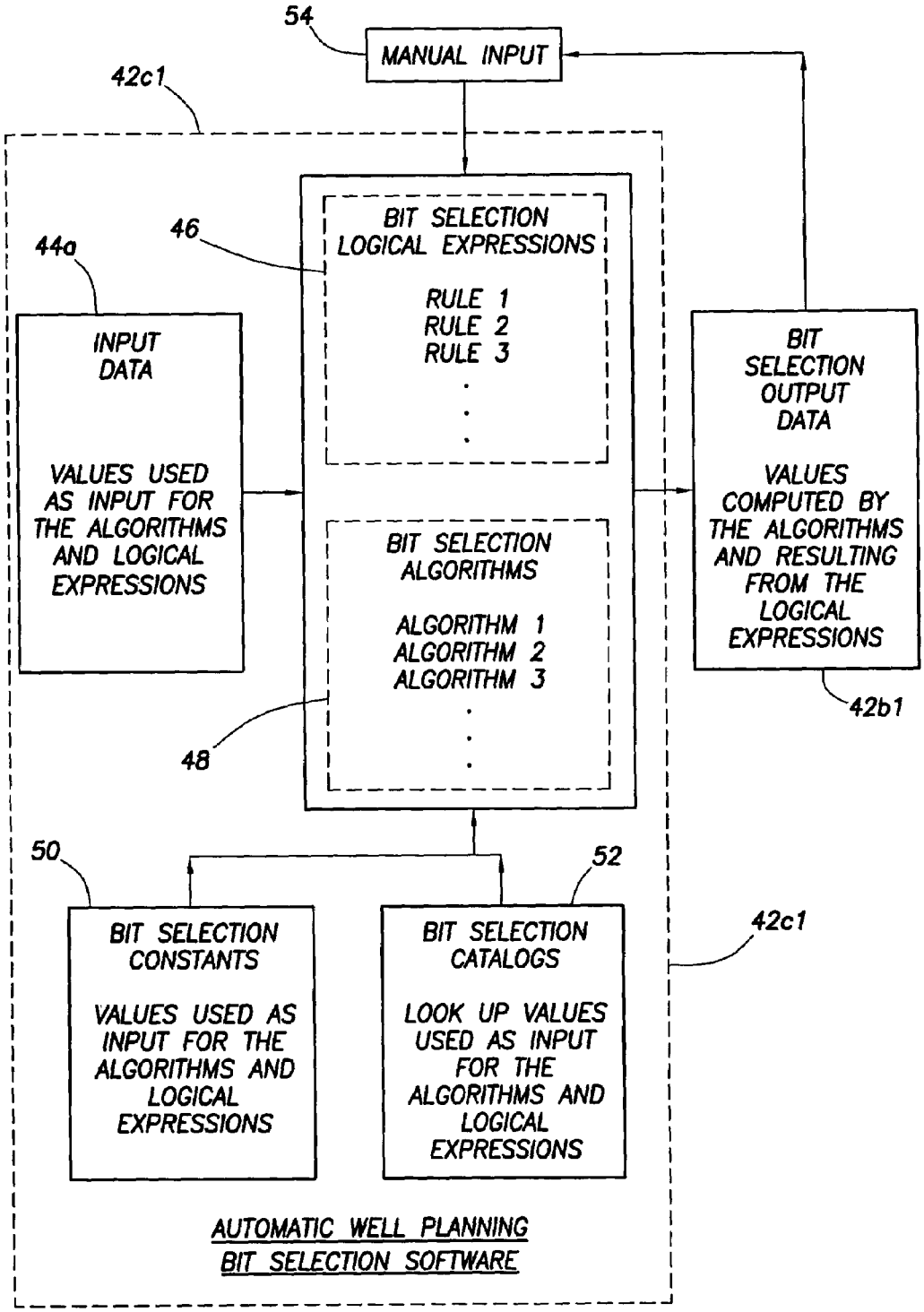
FIG. 13 illustrates a detailed construction of the Automatic Well Planning Bit Selection Software stored in the Computer System of FIG. 12 in accordance with the present invention.

Referring to FIG. 13, a detailed construction of the 'Automatic Well Planning Bit selection Software' 42*c*1 of FIG. 12 is illustrated. In FIG. 13, the 'Automatic Well Planning Bit selection Software' 42*c*1 includes a first block which stores the Input Data 44*a*, a second block 46 which stores a plurality of Bit selection Logical Expressions 46; a third block 48 which stores a plurality of Bit selection Algorithms 48, a fourth block 50 which stores a plurality of Bit selection Constants 50, and a fifth block 52 which stores a plurality of Bit selection Catalogs 52. The Bit selection Constants 50 include values which are used as input for the Bit selection Algorithms 48 and the Bit selection Logical Expressions 46. The Bit selection Catalogs 52 include look-up values which are used as input by the Bit selection Algorithms 48 and the Bit selection Logical Expressions 46. The 'Input Data' 44*a* includes values which are used as input for the Bit selection Algorithms 48 and the Bit selection Logical Expressions 46. The 'Bit selection Output Data' 42*b*1 includes values which are computed by the Bit selection Algorithms 48 and which result from the Bit selection Logical Expressions 46. In operation, referring to FIGS. 12 and 13, the Processor 42*a* of the Computer System 42 of FIG. 12 executes the Automatic Well Planning Bit selection Software 42*c*1 by executing the Bit selection Logical Expressions 46 and the Bit selection Algorithms 48 of the Bit selection Software 42*c*1 while, simultaneously, using the 'Input Data' 44*a*, the Bit selection Constants 50, and the values stored in the Bit selection Catalogs 52 as 'input data' for the Bit selection Logical Expressions 46 and the Bit selection Algorithms 48 during that execution. When that execution by the Processor 42*a* of the Bit selection Logical Expressions 46 and the Bit selection Algorithms 48 (while using the 'Input Data' 44*a*, Constants 50, and Catalogs 52) is completed, the 'Bit selection Output Data' 42*b*1 will be generated as a 'result'. The 'Bit selection Output Data' 42*b*1 is recorded or displayed on the Recorder or Display Device 42*b* of the Computer System 42 of FIG. 12. In addition, that 'Bit selection Output Data' 42*b*1 can be manually input, by an operator, to the Bit selection Logical Expressions block 46 and the Bit selection Algorithms block 48 via a 'Manual Input' block 54 shown in FIG. 13.

Input Data 44*a*

The following paragraphs will set forth the 'Input Data' 44*a* which is used by the 'Bit Selection Logical Expressions' 46 and the 'Bit Selection Algorithms' 48. Values of the Input Data 44*a* that are used as input for the Bit Selection Algorithms 48 and the Bit Selection Logical Expressions 46 include the following:

(1) Measured Depth
(2) Unconfined Compressive Strength
(3) Casing Point Depth
(4) Hole Size
(5) Conductor
(6) Casing Type Name
(7) Casing Point
(8) Day Rate Rig
(9) Spread Rate Rig
(10) Hole Section Name Bit Selection Constants 50

The 'Bit Selection Constants' 50 are used by the 'Bit selection Logical Expressions' 46 and the 'Bit selection Algorithms' 48. The values of the 'Bit Selection Constants 50 that are used as input data for Bit selection Algorithms 48 and the Bit selection Logical Expressions 46 include the following: Trip Speed Bit selection Catalogs 52

The 'Bit selection Catalogs' 52 are used by the 'Bit selection Logical Expressions' 46 and the 'Bit selection Algorithms' 48. The values of the Catalogs 52 that are used as input data for Bit selection Algorithms 48 and the Bit selection Logical Expressions 46 include the following: Bit Catalog Bit selection Output Data 42*b*1

The 'Bit selection Output Data' 42*b*1 is generated by the 'Bit selection Algorithms' 48. The 'Bit selection Output Data' 42*b*1, that is generated by the 'Bit selection Algorithms' 48, includes the following types of output data:

(1) Measured Depth
(2) Cumulative Unconfined Compressive Strength (UCS)
(3) Cumulative Excess UCS
(4) Bit Size
(5) Bit Type
(6) Start Depth
(7) End Depth
(8) Hole Section Begin Depth
(9) Average UCS of rock in section
(10) Maximum UCS of bit
(11) BitAverage UCS of rock in section
(12) Footage
(13) Statistical Drilled Footage for the bit
(14) Ratio of footage drilled compared to statistical footage
(15) Statistical Bit Hours
(16) On Bottom Hours
(17) Rate of Penetration (ROP)
(18) Statistical Bit Rate of Penetration (ROP)
(19) Mechanical drilling energy (UCS integrated over distance drilled by the bit)
(20) Weight On Bit

(21) Revolutions per Minute (RPM)
(22) Statistical Bit RPM
(23) Calculated Total Bit Revolutions
(24) Time to Trip
(25) Cumulative Excess as a ration to the Cumulative UCS
(26) Bit Cost
(27) Hole Section Name Bit Selection Logical Expressions 46

The following paragraphs will set forth the 'Bit selection Logical Expressions' 46. The 'Bit selection Logical Expressions' 46 will: (1) receive the 'Input Data 44a', including a 'plurality of Input Data calculation results' that has been generated by the 'Input Data 44a'; and (2) evaluate the 'Input Data calculation results' during the processing of the 'Input Data'.

The Bit Selection Logical Expressions 46, which evaluate the processing of the Input Data 44*a*, include the following:

(1) Verify the hole size and filter out the bit sizes that do not match the hole size.
(2) Check if the bit is not drilling beyond the casing point.
(3) Check the cumulative mechanical drilling energy for the bit run and compare it with the statistical mechanical drilling energy for that bit, and assign the proper risk to the bit run.
(4) Check the cumulative bit revolutions and compare it with the statistical bit revolutions for that bit type and assign the proper risk to the bit run.
(5) Verify that the encountered rock strength is not outside the range of rock strengths that is optimum for the selected bit type.
(6) Extend footage by 25% in case the casing point could be reached by the last selected bit.

Bit Selection Algorithms 48

The following paragraphs will set forth the 'Bit Selection Algorithms' 48. The 'Bit Selection Algorithms' 48 will receive the output from the 'Bit Selection Logical Expressions' 46 and process that 'output from the Bit Selection Logical Expressions 46' in the following manner:

(1) Read variables and constants
(2) Read catalogs
(3) Build cumulative rock strength curve from casing point to casing point.

$$CumUCS = \int_{start}^{end} (UCS)d\,\text{ft}$$

(4) Determine the required hole size
(5) Find the bit candidates that match the closest unconfined compressive strength of the rock to drill.
(6) Determine the end depth of the bit by comparing the historical drilling energy with the cumulative rock strength curve for all bit candidates.
(7) Calculate the cost per foot for each bit candidate taking into accounts the rig rate, trip speed and drilling rate of penetration.

$$TOT\ \text{Cost} = (\text{RIG RATE} + \text{SPREAD RATE})\left(\text{T_TripIn} + \frac{\text{footage}}{ROP} + \text{T_Trip}\right) + \text{Bit Cost}$$

(8) Evaluate which bit candidate is most economic.
(9) Calculate the remaining cumulative rock strength to casing point.
(10) Repeat step 5 to 9 until the end of the hole section
(11) Build cumulative UCS
(12) Select bits—display bit performance and operating parameters
(13) Remove sub-optimum bits
(14) Find most economic bit based on cost per foot Refer now to FIGS. 14A and 14B which will be used during the following functional description of the operation of the present invention.

A functional description of the operation of the 'Automatic Well Planning Bit Selection Software' 42*c*1 will be set forth in the following paragraphs with reference to FIGS. 1 through 14B of the drawings.

Recall that the selection of Drill bits is a manual subjective process based heavily on personal, previous experiences. The experience of the individual recommending or selecting the drill bits can have a large impact on the drilling performance for the better or for the worse. The fact that bit selection is done primarily based on personal experiences and uses little information of the actual rock to be drilled makes it very easy to choose the incorrect bit for the application. Recall that the Bit Selection sub-task 14*a* utilizes an 'Automatic Well Planning Bit Selection software' 42*c*1, in accordance with the present invention, to automatically generate the required roller cone drill bits or fixed cutter drill bits (e.g., PDC bits) to drill the specified hole sizes through the specified hole section at unspecified intervals of earth. The 'Automatic Well Planning Bit Selection software' 42*c*1 of the present invention include the 'Bit Selection Logical Expressions' 46 and the 'Bit Selection Algorithms' 48 that are adapted for automatically selecting the required sequence of drill bits to drill each hole section (defined by a top/bottom depth interval and diameter) in the well. The 'Automatic Well Planning Bit Selection software' 42*c*1 uses statistical processing of historical bit performance data and several specific Key Performance Indicators (KPI) to match the earth properties and rock strength data to the appropriate bit while optimizing the aggregate time and cost to drill each hole section. It determines the bit life and corresponding depths to pull and replace a bit based on proprietary algorithms, statistics, logic, and risk factors.

Figure 14A:
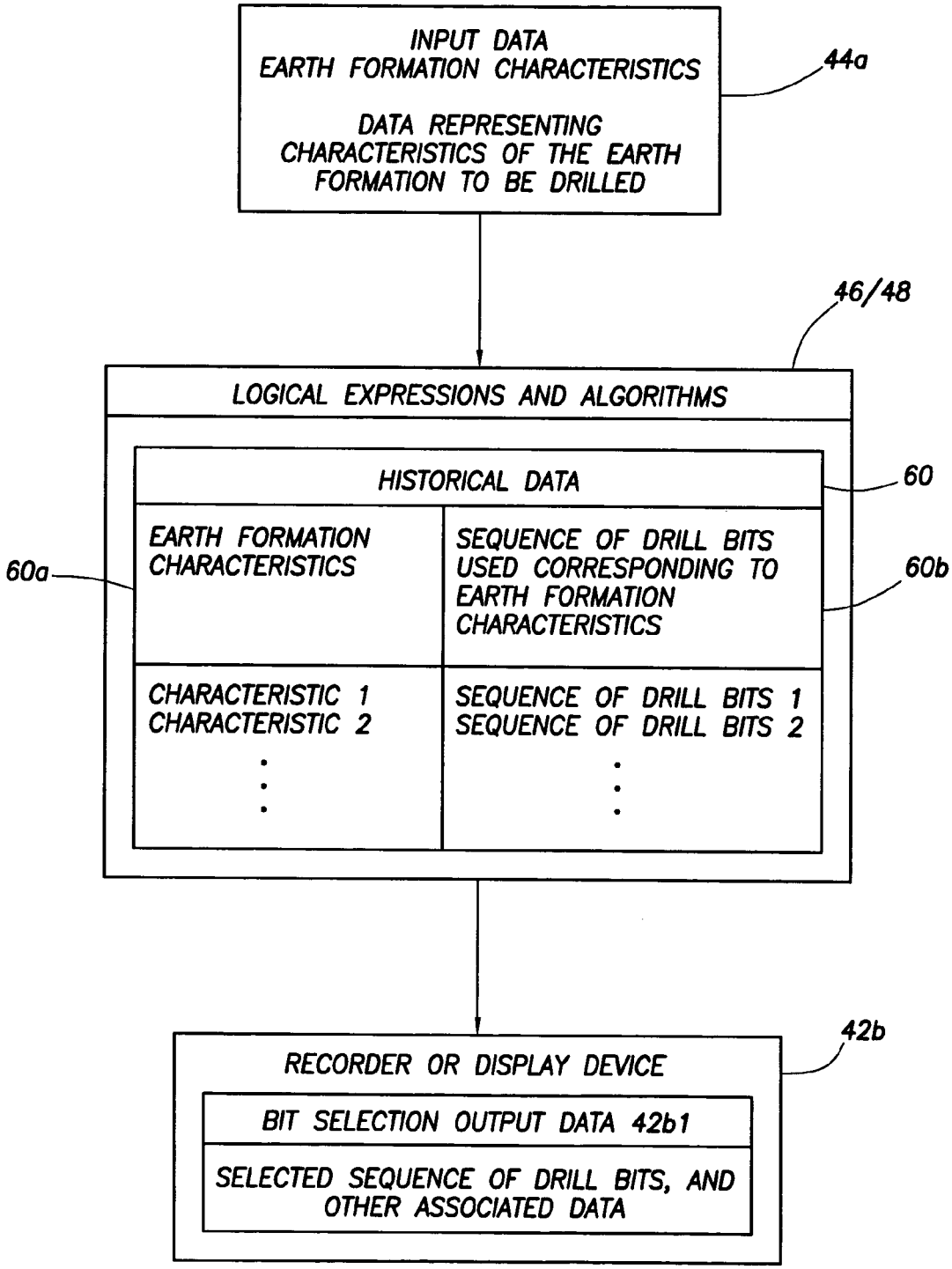
FIG. 14A illustrates a block diagram representing a functional operation of the Automatic Well Planning Bit Selection software of FIG. 13 of the present invention.
Figures 15, 15A, 15B, 15C, 15D:
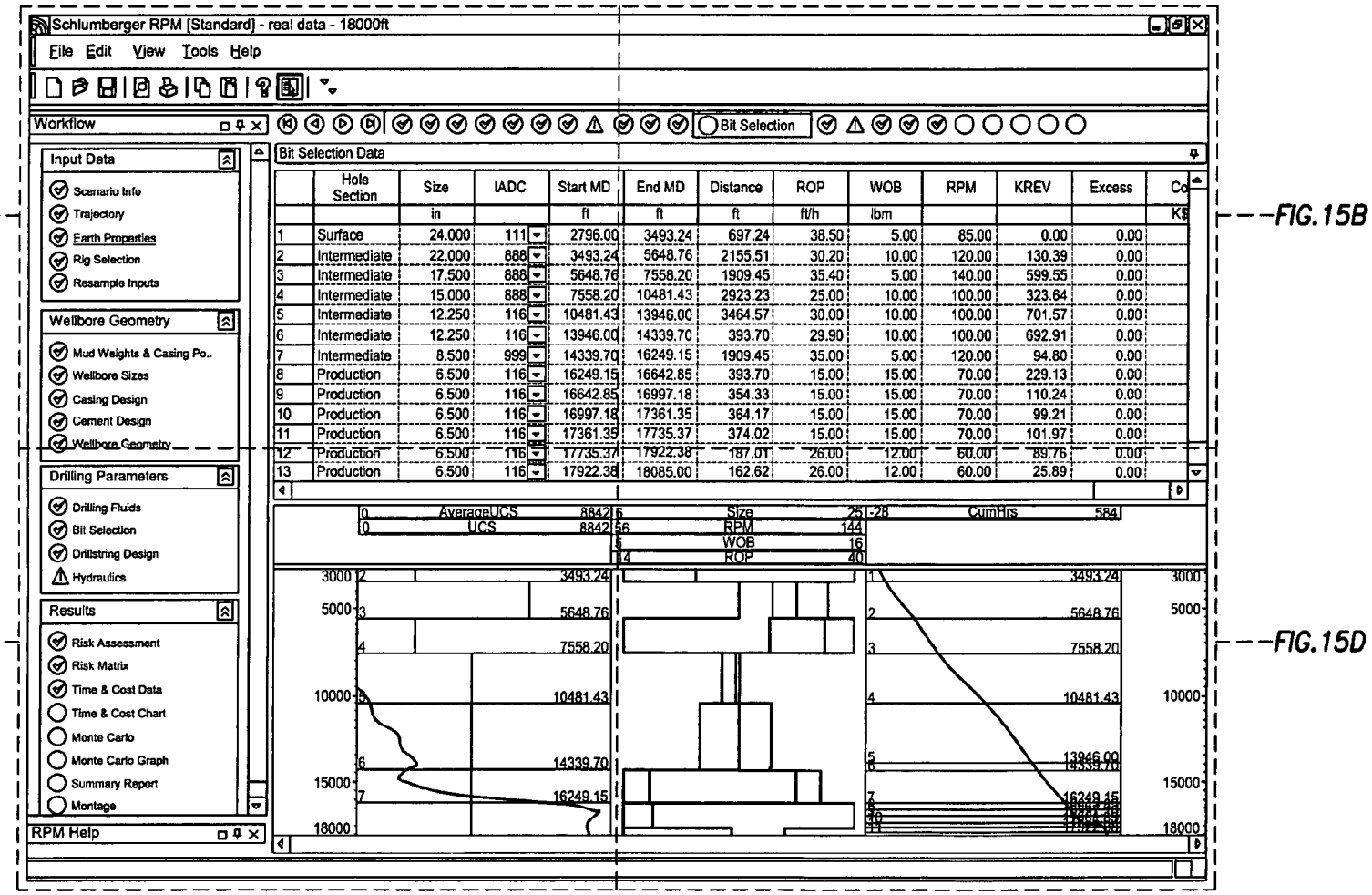
FIG. 15 including
FIGS. 15A, 15B, 15C, and 15D illustrates a Bit Selection display which is generated by a Recorder or Display device associated with the Computer System of FIG. 12 which stores the Automatic Well Planning Bit Selection software in accordance with the present invention.
Figure 15A:
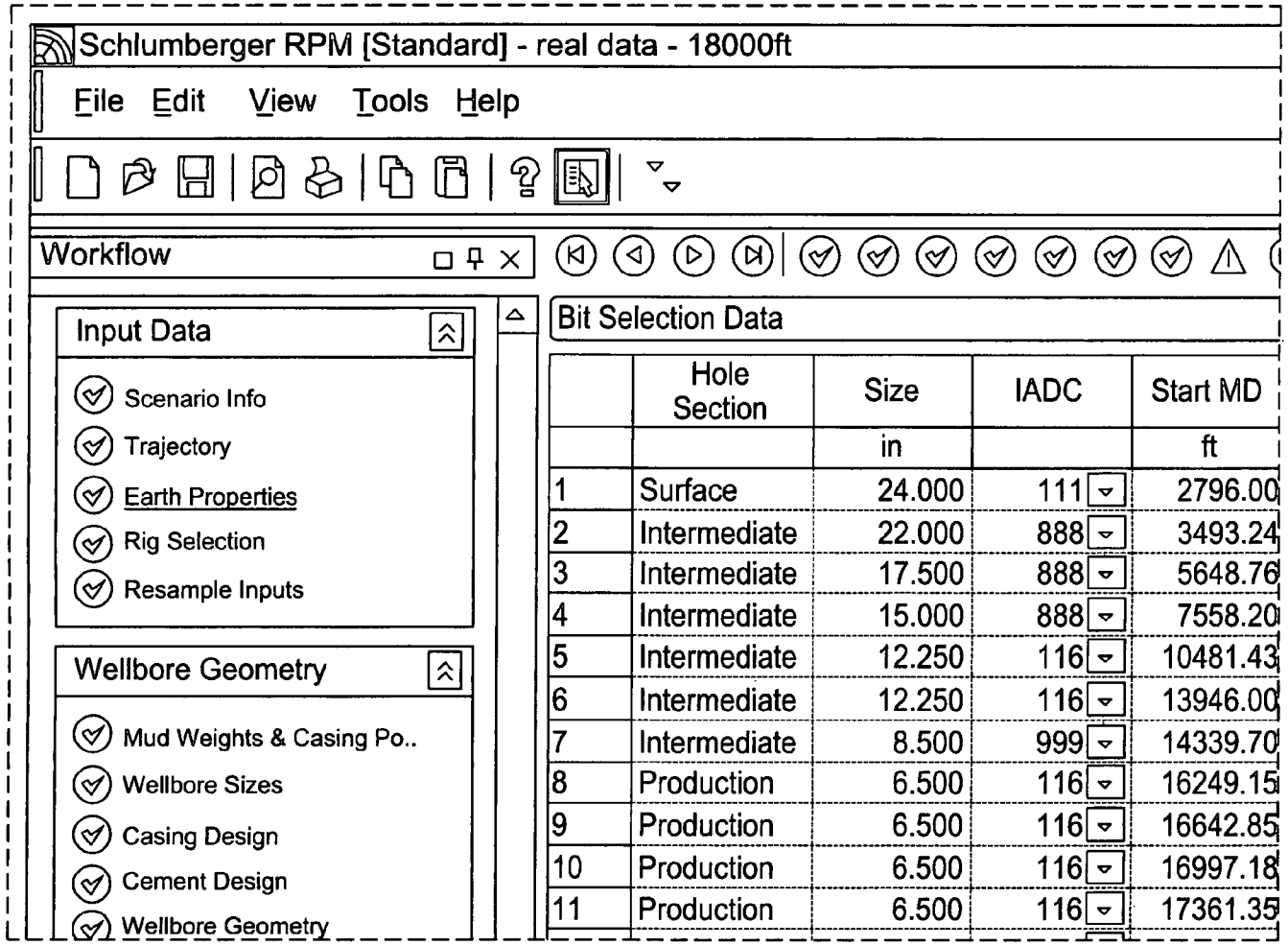
Figure 15C:
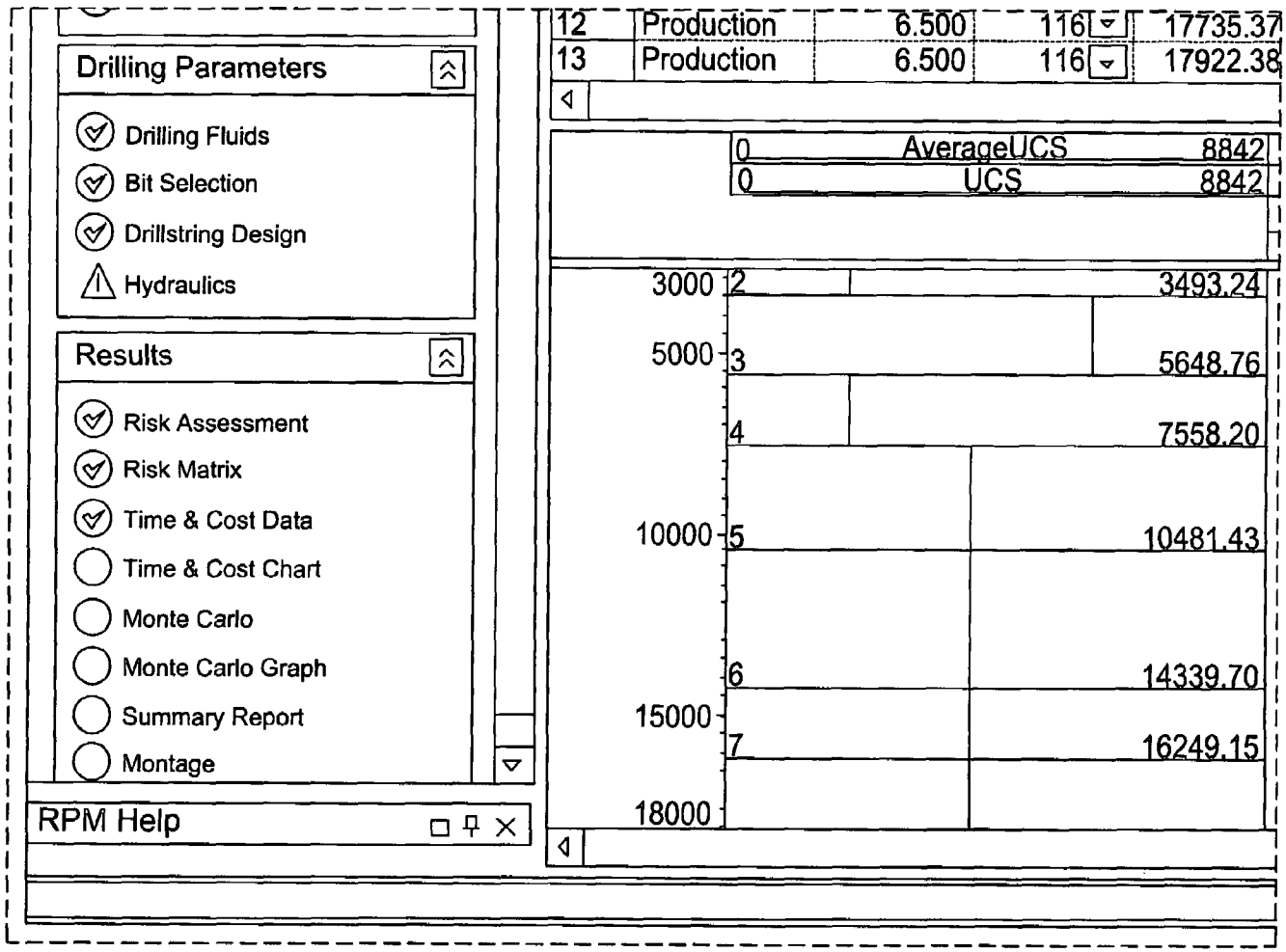
Figure 15D:
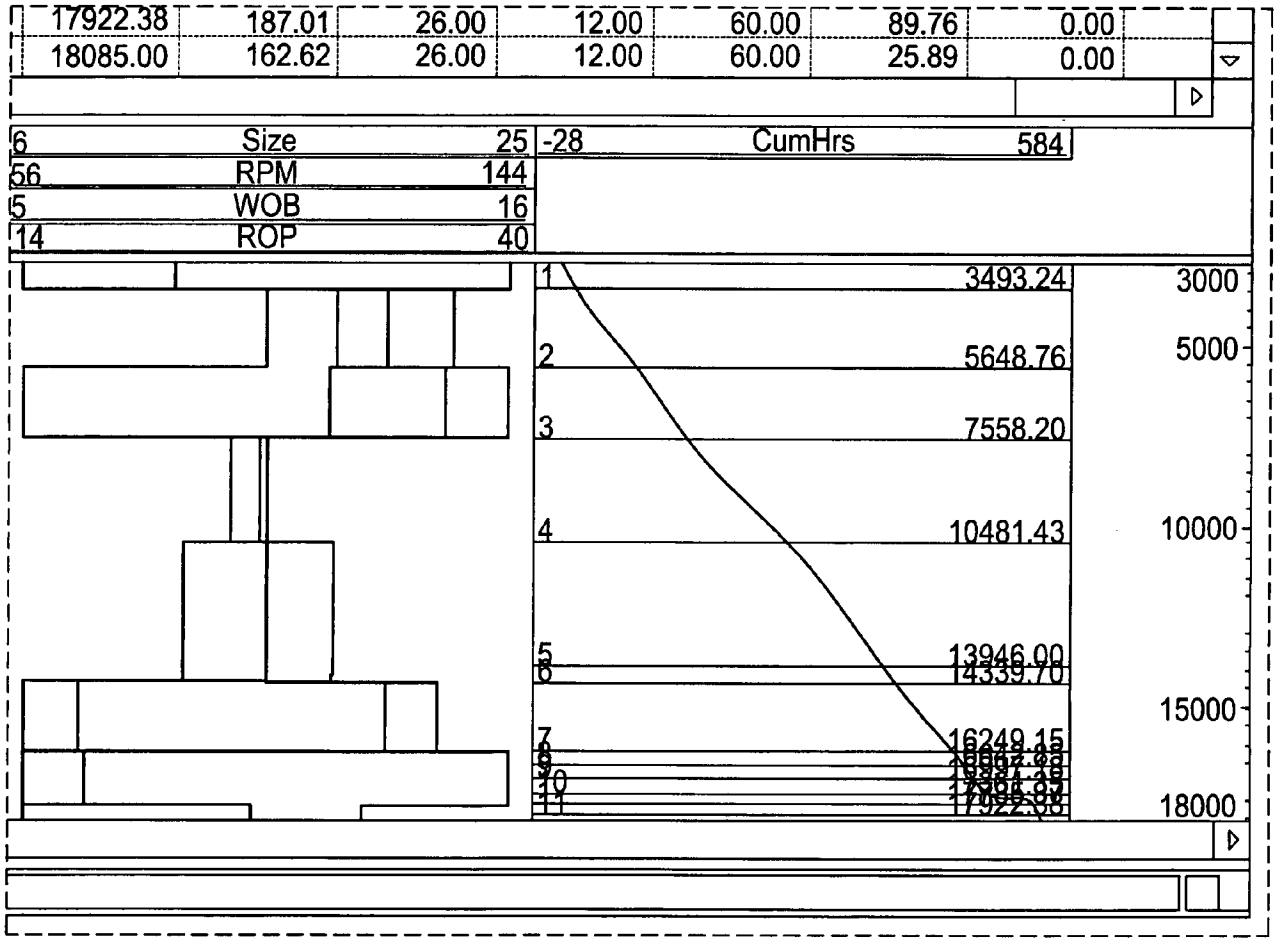

In FIG. 14A, the Input Data 44*a* represents a set of Earth formation characteristics, where the Earth formation characteristics are comprised of data representing characteristics of a particular Earth formation 'To Be Drilled'. The Logical Expressions and Algorithms 46/48 are comprised of Historical Data 60, where the Historical Data 60 can be viewed as a table consisting of two columns: a first column 60*a* including 'historical Earth formation characteristics', and a second column 60*b* including 'sequences of drill bits used corresponding to the historical Earth formation characteristics'. The Recorder or Display device 42*b* will record or display 'Bit Selection Output Data' 42*b*, where the 'Bit Selection Output Data' 42*b* is comprised of the 'Selected Sequence of Drill Bits, and other associated data'. In operation, referring to FIG. 14A, the Input Data 44*a* represents a set of Earth formation characteristics associated with an Earth formation 'To Be Drilled'. The 'Earth formation characteristics (associated with a section of Earth Formation 'to be drilled') corresponding to the Input Data 44*a*' is compared with each 'characteristic in column 60a associated with the Historical Data 60' of the Logical Expressions and Algorithms 46/48. When a match (or a substantial match) is found between the 'Earth formation characteristics (associated with a section of Earth Formation 'to be drilled')

corresponding to the Input Data 44*a*' and a 'characteristic in column 60*a* associated with the Historical Data 60', a 'Sequence of Drill Bits' (called a 'selected sequence of drill bits') corresponding to that 'characteristic in column 60*a* associated with the Historical Data 60' is generated as an output from the Logical Expressions and Algorithms block 46/48 in FIG. 14A. The aforementioned 'selected sequence of drill bits along with other data associated with the selected sequence of drill bits' is generated as an 'output' by the Recorder or Display device 42*b* of the Computer System 42 in FIG. 12. See FIG. 15 for an example of that 'output'. The 'output' can be a 'display' (as illustrated in FIG. 15) that is displayed on a computer display screen, or it can be an 'output record' printed by the Recorder or Display device 42*b*.

The functions discussed above with reference to FIG. 14A, pertaining to the manner by which the 'Logical Expressions and Algorithms' 46/48 will generate the 'Bit Selection Output Data' 42*b*1 in response to the 'Input Data' 44*a*, will be discussed in greater detail below with reference to FIG. 14B.

Figure 14B:
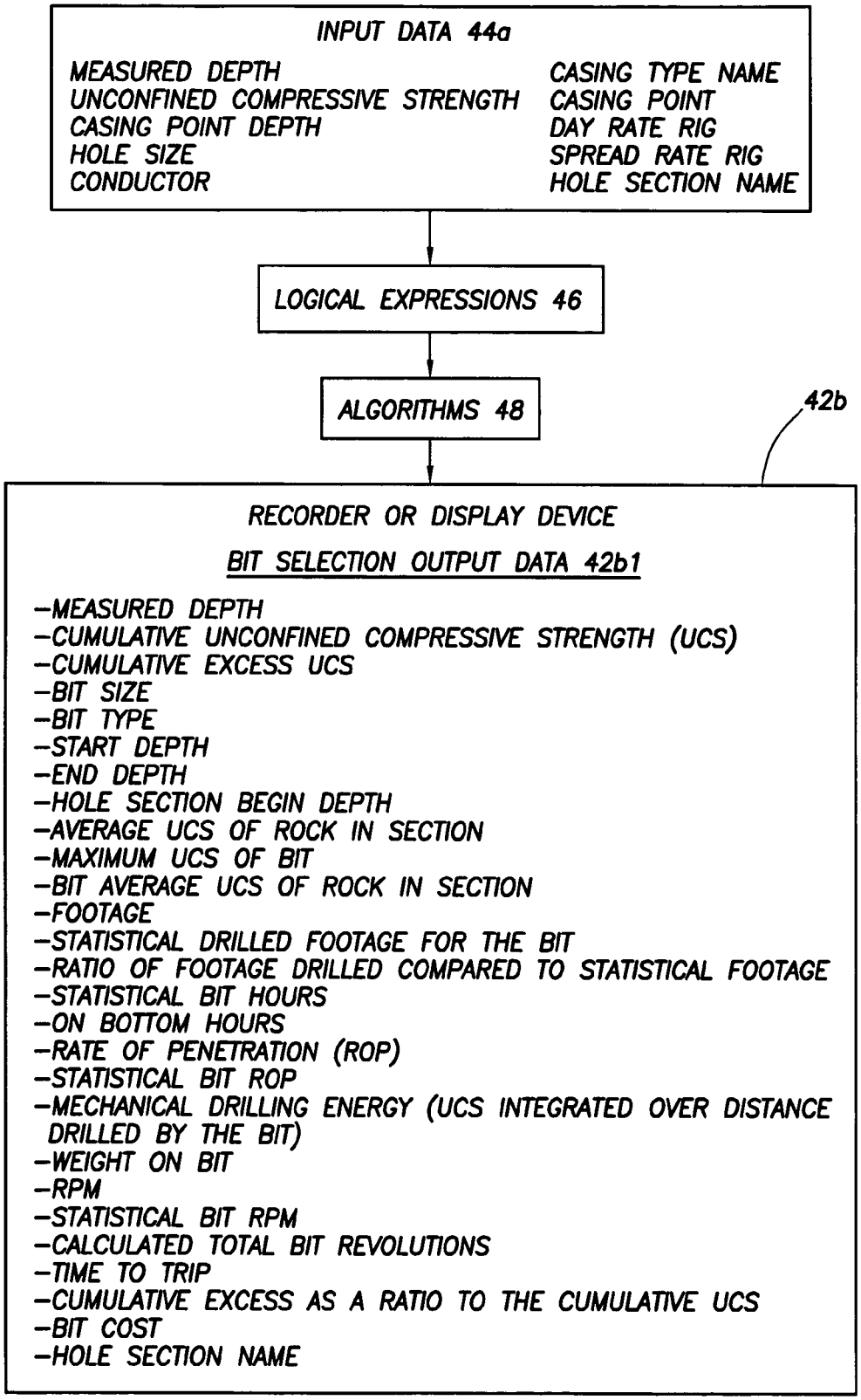
FIG. 14B illustrates another block diagram representing a functional operation of the Automatic Well Planning Bit Selection software of FIG. 13 of the present invention.

In FIG. 14B, recall that the Input Data 44*a* represents a set of 'Earth formation characteristics', where the 'Earth formation characteristics' are comprised of data representing characteristics of a particular Earth formation 'To Be Drilled'. As a result, the Input Data 44*a* is comprised of the following specific data: Measured Depth, Unconfined Compressive Strength, Casing Point Depth, Hole Size, Conductor, Casing Type Name, Casing Point, Day Rate Rig, Spread Rate Rig, and Hole Section Name.

In FIG. 14B, recall that the Logical Expressions 46 and Algorithms 48 will respond to the Input Data 44*a* by generating a set of 'Bit Selection Output Data' 42*b*1, where the 'Bit Selection Output Data' 42*b*1 represents the aforementioned 'selected drill bit along with other data associated with the selected drill bit'. As a result, the 'Bit Selection Output Data' 42*b*1 is comprised of the following specific data: Measured Depth, Cumulative Unconfined Compressive Strength (UCS), Cumulative Excess UCS, Bit Size, Bit Type, Start Depth, End Depth, Hole Section Begin Depth, Average UCS of rock in section, Maximum UCS of bit, Bit Average UCS of rock in section, Footage, Statistical Drilled Footage for the bit, Ratio of footage drilled compared to statistical footage, Statistical Bit Hours, On Bottom Hours, Rate of Penetration (ROP), Statistical Bit Rate of Penetration (ROP), Mechanical drilling energy (UCS integrated over distance drilled by the bit), Weight On Bit, Revolutions per Minute (RPM), Statistical Bit RPM, Calculated Total Bit Revolutions, Time to Trip, Cumulative Excess as a ration to the Cumulative UCS, Bit Cost, and Hole Section Name.

In order to generate the 'Bit Selection Output Data' 42*b*1 in response to the 'Input Data' 44*a*, the Logical Expressions 46 and the Algorithms 48 must perform the following functions, which are set forth in the following paragraphs.

The Bit Selection Logical Expressions 46 will perform the following functions. The Bit Selection Logical Expressions 46 will: (1) Verify the hole size and filter out the bit sizes that do not match the hole size, (2) Check if the bit is not drilling beyond the casing point, (3) Check the cumulative mechanical drilling energy for the bit run and compare it with the statistical mechanical drilling energy for that bit, and assign the proper risk to the bit run, (4) Check the cumulative bit revolutions and compare it with the statistical bit revolutions for that bit type and assign the proper risk to the bit run, (5) Verify that the encountered rock strength is not outside the range of rock strengths that is optimum for the selected bit type, and (6) Extend footage by 25% in case the casing point could be reached by the last selected bit.

The Bit Selection Algorithms 48 will perform the following functions. The Bit Selection Algorithms 48 will: (1) Read variables and constants, (2) Read catalogs, (3) Build cumulative rock strength curve from casing point to casing point, using the following equation:

$$CumUCS = \int_{start}^{end} (UCS)d\,\text{ft},$$

(4) Determine the required hole size, (5) Find the bit candidates that match the closest unconfined compressive strength of the rock to drill, (6) Determine the end depth of the bit by comparing the historical drilling energy with the cumulative rock strength curve for all bit candidates, (7) Calculate the cost per foot for each bit candidate taking into accounts the rig rate, trip speed and drilling rate of penetration by using the following equation:

$$TOT\ \text{Cost} = (\text{RIG RATE} + \text{SPREAD RATE})\left(\text{T_TripIn} + \frac{\text{footage}}{ROP} + \text{T_Trip}\right) + \text{Bit Cost}$$

(8) Evaluate which bit candidate is most economic, (9) Calculate the remaining cumulative rock strength to casing point, (10) Repeat step 5 to 9 until the end of the hole section, (11) Build cumulative UCS, (12) Select bits—display bit performance and operating parameters, (13) Remove sub-optimum bits, and (14) Find the most economic bit based on cost per foot.

The following discussion set forth in the following paragraphs will describe how the 'Automatic Well Planning Bit Selection software' of the present invention will generate a 'Selected Sequence of Drill Bits' in response to 'Input Data'.

The 'Input Data' is loaded, the 'Input Data' including the 'trajectory' data and Earth formation property data. The main characteristic of the Earth formation property data, which was loaded as input data, is the rock strength. The 'Automatic Well Planning Bit Selection' software of the present invention has calculated the casing points, and the number of 'hole sizes' is also known. The casing sizes are known and, therefore, the wellbore sizes are also known. The number of 'hole sections' are known, and the size of the 'hole sections' are also known. The drilling fluids are also known. The most important part of the 'input data' is the 'hole section length', the 'hole section size', and the 'rock hardness' (also known as the 'Unconfined Compressive Strength' or 'UCS') associated with the rock that exists in the hole sections. In addition, the 'input data' includes 'historical bit performance data'. The 'Bit Assessment Catalogs' include: bit sizes, bit-types, and the relative performance of the bit types. The 'historical bit performance data' includes the footage that the bit drills associated with each bit-type. The 'Automatic Well Planning Bit Selection software' in accordance with the present invention starts by determining the average rock hardness that the bit-type can drill. The bit-types have been classified in the 'International Association for Drilling Contractors (IADC)' bit classification. Therefore, there exists a 'classification' for each 'bit-type'. In accordance with one aspect of the present invention, we assign an 'average UCS' (that is, an 'average rock strength') to the bit-type. In addition, we assign a minimum and a maximum rock strength to each of the bit-types. Therefore, each 'bit type' has been assigned the following information: (1) the 'softest rock that each bit type can drill', (2) the 'hardest rock that each bit type can drill', and (3) the 'average or the optimum hardness that each bit type can drill'. All 'bit sizes' associated with the 'bit types' are examined for the wellbore 'hole section' that will be drilled (electronically) when the 'Automatic Well Planning Bit Selection software' of the present invention is executed. Some 'particular bit types', from the Bit Selection Catalog, will filtered-out because those 'particular bit types' do not have the appropriate size for use in connection with the hole section that we are going to drill (electronically). As a result, a 'list of bit candidates' is generated. When the drilling of the rock (electronically—in the software) begins, for each foot of the rock, a 'rock strength' is defined, where the 'rock strength' has units of 'pressure' in 'psi'. For each foot of rock that we (electronically) drill, the 'Automatic Well Planning Bit Selection software' of the present invention will perform a mathematical integration to determine the 'cumulative rock strength' by using the following equation:

$$CumUCS = \int_{start}^{end} (UCS)d \text{ ft}$$

where:

'CumUCS' is the 'cumulative rock strength', and

'UCS' (Unconfined Compressive Strength') is the 'average rock strength' per 'bit candidate', and 'd' is the drilling distance using that 'bit candidate'.

Thus, if the 'average rock strength/foot' is 1000 psi/foot, and we drill 10 feet of rock, then, the 'cumulative rock strength' is (1000 psi/foot)(10 feet)=10000 psi 'cumulative rock strength'. If the next 10 feet of rock has an 'average rock strength/foot' of 2000 psi/foot, that next 10 feet will take (2000 psi/foot)(10 feet)=20000 psi 'cumulative rock strength'; then, when we add the 10000 psi 'cumulative rock strength' that we already drilled, the resultant 'cumulative rock strength' for the 20 feet equals 30000 psi. Drilling (electronically—in the software) continues. At this point, compare the 30000 psi 'cumulative rock strength' for the 20 feet of drilling with the 'statistical performance of the bit'. For example, if, for a 'particular bit', the 'statistical performance of the bit' indicates that, statistically, 'particular bit' can drill fifty (50) feet in a 'particular rock', where the 'particular rock' has 'rock strength' of 1000 psi/foot. In that case, the 'particular bit' has a 'statistical amount of energy that the particular bit is capable of drilling' which equals (50 feet)(1000 psi/foot)=50000 psi. Compare the previously calculated 'cumulative rock strength' of 30000 psi with the aforementioned 'statistical amount of energy that the particular bit is capable of drilling' of 50000 psi. Even though 'actual energy' (the 30000 psi) was used to drill the first 20 feet of the rock, there still exists a 'residual energy' in the 'particular bit' (the 'residual energy' being the difference between 50000 psi and 30000 psi). As a result, from 20 feet to 30 feet, we use the 'particular bit' to drill once again (electronically—in the software) an additional 10 feet. Assume the 'rock strength' is 2000 psi. Determine the 'cumulative rock strength' by multiplying (2000 psi/foot)(10 additional feet)=20000 psi. Therefore, the 'cumulative rock strength' for the additional 10 feet is 20000 psi. Add the 20000 psi 'cumulative rock strength' (for the additional 10 feet) to the previously calculated 30000 psi 'cumulative rock strength' (for the first 20 feet) that we already drilled. The result will yield a 'resultant cumulative rock strength' of 50000 psi' associated with 30 feet of drilling. Compare the aforementioned 'resultant cumulative rock strength' of 50000 psi with the 'statistical amount of energy that the particular bit is capable of drilling' of 50000 psi. As a result, there is only one conclusion: the bit life of the 'particular bit' ends and terminates at 50000 psi; and, in addition, the 'particular bit' can drill up to 30 feet. If the aforementioned 'particular bit' is 'bit candidate A', there is only one conclusion: 'bit candidate A' can drill 30 feet of rock. We now go to the next 'bit candidate' for the same size category and repeat the same process. We continue to drill (electronically—in the software) from point A to point B in the rock, and integrate the energy as previously described (as 'footage' in units of 'psi') until the life of the bit has terminated. The above mentioned process is repeated for each 'bit candidate' in the aforementioned 'list of bit candidates'. We now have the 'footage' computed (in units of psi) for each 'bit candidate' on the 'list of bit candidates'. The next step involves selecting which bit (among the 'list of bit candidates') is the 'optimum bit candidate'. One would think that the 'optimum bit candidate' would be the one with the maximum footage. However, how fast the bit drills (i.e., the Rate of Penetration or ROP) is also a factor. Therefore, a cost computation or economic analysis must be performed. In that economic analysis, when drilling, a rig is used, and, as a result, rig time is consumed which has a cost associated therewith, and a bit is also consumed which also has a certain cost associated therewith. If we (electronically) drill from point A to point B, it is necessary to first run into the hole where point A starts, and this consumes 'tripping time'. Then, drilling time is consumed. When (electronic) drilling is done, pull the bit out of the hole from point B to the surface, and additional rig time is also consumed. Thus, a 'total time in drilling' can be computed from point A to point B, that 'total time in drilling' being converted into 'dollars'. To those 'dollars', the bit cost is added. This calculation will yield: a 'total cost to drill that certain footage (from point A to B)'. The 'total cost to drill that certain footage (from point A to B)' is normalized by converting the 'total cost to drill that certain footage (from point A to B)' to a number which represents 'what it costs to drill one foot'. This operation is performed for each bit candidate. At this point, the following evaluation is performed: 'which bit candidate drills the cheapest per foot'. Of all the 'bit candidates' on the 'list of bit candidates', we select the 'most economic bit candidate'. Although we computed the cost to drill from point A to point B, it is now necessary to consider drilling to point C or point D in the hole. In that case, the Automatic Well Planning Bit Selection software will conduct the same steps as previously described by evaluating which bit candidate is the most suitable in terms of energy potential to drill that hole section; and, in addition, the software will perform an economic evaluation to determine which bit candidate is the cheapest. As a result, when (electronically) drilling from point A to point B to point C, the 'Automatic Well Planning Bit Selection software' of the present invention will perform the following functions: (1) determine if 'one or two or more bits' are necessary to satisfy the requirements to drill each hole section, and, responsive thereto, (2) select the 'optimum bit candidates' associated with the 'one or two or more bits' for each hole section.

In connection with the Bit Selection Catalogs 52, the Catalogs 52 include a 'list of bit candidates'. The 'Automatic Well Planning Bit Selection software' of the present invention will disregard certain bit candidates based on: the classification of each bit candidate and the minimum and maximum rock strength that the bit candidate can handle. In addition, the software will disregard the bit candidates which are not serving our purpose in terms of (electronically) drill from point A to point B. If rocks are encountered which have a UCS which exceeds the UCS rating for that 'particular bit candidate', that 'particular bit candidate' will not qualify. In addition, if the rock strength is considerably less than the minimum rock strength for that 'particular bit candidate', disregard that 'particular bit candidate'.

In connection with the Input Data 44*a*, the Input Data 44*a* includes the following data: which hole section to drill, where the hole starts and where it stops, the length of the entire hole, the size of the hole in order to determine the correct size of the bit, and the rock strength (UCS) for each foot of the hole section. In addition, for each foot of rock being drilled, the following data is known: the rock strength (UCS), the trip speed, the footage that a bit drills, the minimum and maximum UCS for which that the bit is designed, the Rate of Penetration (ROP), and the drilling performance. When selecting the bit candidates, the 'historical performance' of the 'bit candidate' in terms of Rate of Penetration (ROP) is known. The drilling parameters are known, such as the 'weight on bit' or WOB, and the Revolutions per Minute (RPM) to turn the bit is also known.

In connection with the Bit Selection Output Data 42*b*1, since each bit drills a hole section, the output data includes a start point and an end point in the hole section for each bit. The difference between the start point and the end point is the 'distance that the bit will drill'. Therefore, the output data further includes the 'distance that the drill bit will drill'. In addition, the output data includes: the 'performance of the bit in terms of Rate of Penetration (ROP)' and the 'bit cost'.

In summary, the Automatic Well Planning Bit Selection software 42*c*1 will: (1) suggest the right type of bit for the right formation, (2) determine longevity for each bit, (3) determine how far can that bit drill, and (3) determine and generate 'bit performance' data based on historical data for each bit.

Referring to FIG. 15, the 'Automatic Well Planning Bit Selection Software' 42*c*1 of the present invention will generate the display illustrated in FIG. 15, the display of FIG. 15 illustrating 'Bit Selection Output Data 42b1' representing the selected sequence of drill bits which are selected by the 'Automatic Well Planning Bit Selection Software' 42*c*1 in accordance with the present invention.

Figure 16:
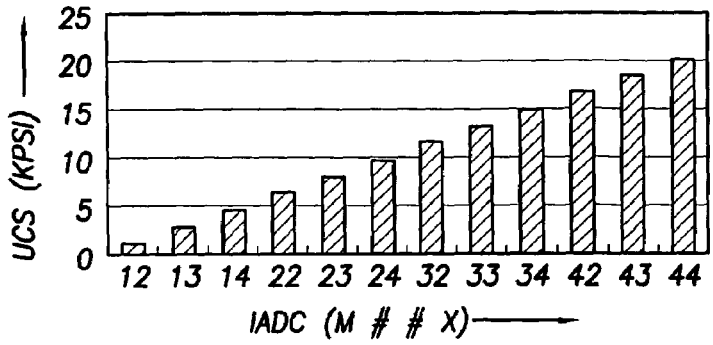
FIG. 16 is used in a functional specification disclosed in this specification.

Refer now to FIG. 16.

A functional specification associated with the 'Automatic Well Planning Bit Selection Software' 42*c*1 of the present invention will be set forth in the following paragraphs with reference to FIG. 16.

Select Drilling Bits

Characteristic Information

| | |
|---|---|
| Goal In Context: | This use case describes the process to select drilling bits Right Click the Mouse to 'accept changes'. |
| Scope: | Select Drilling Bits |
| Level: | Task |
| Pre-Condition: | The user has completed prior use cases and has data for lithology, UCS, and BitTRAK bit catalog. |
| Success End Condition: | The system confirms to the user that IADC Code per section, estimated ROP and drilling section has been determined including the operating parameter ranges WOB, RPM. |
| Failed End Condition: | The system indicates to the user that the selection has failed. |
| Primary Actor: | The User |
| Trigger Event: | The user completed the cementing program |

Main Success Scenario

| Step | Actor Action | System Response |
|---|---|---|
| 1 | The user accepts the mud design. | The system uses the algorithm listed below to split the hole sections into bit runs and selects the drilling bits for each section based on rock properties, forecasted ROP and bit life and economics.<br>The system displays in a grid:<br>Bit size, IADC code, bit section end depth, footage, ROP, WOB, RPM, WOB, Total revolutions, Cumulative excess ratio, bit cost.<br>The system displays in 3 different graphs:<br>Graph 1:<br>MD, UCS, Bit Average UCS, casing point and interactively the bit section end depth.<br>Graph 2:<br>ROP, RPM, WOB (all interactive) and bit size<br>Graph 3:<br>Hours on bottom vs measured depth, horizontal lines for bit section end depth and casing points. All non-interactive.<br>The system displays the UCS, the bit sections with IADC codes, the proposed RPM & WOB, and the anticipated ROP for each bit. |

Scenario Extensions

| Step | Condition | Action Description |
|---|---|---|

Scenario Variations

| Step | Variable | Possible Variations |
|---|---|---|
| 1 | Conductor pipe is not drilled but jetted or driven. | No bits for this section. |
| 2 | The user may modify before accepting: bit selection (IADC), ROP, bit-section length (=footage), or drilling parameters (WOB, RPM, ROP) | The system updates the bit selections. The system confirms to the user the selection has been saved successfully. The use case ends successfully. |

Related Information

| | |
|---|---|
| Schedule: | Version 1.1 |
| Priority: | Must |
| Performance Target: | N/A |

-continued

| Select Drilling Bits | |
|---|---|
| Frequency: | N/A |
| Super Use Case: | Swordfish Use Case IPM III - Design the Well Candidate |
| Sub Use Case(s): | N/A |
| Channel To Primary Actor: | N/A |
| Secondary Actor(s): | N/A |
| Channel(s) To Secondary Actor(s): | N/A |

Business Rules

BIT 1 Cumulative number of revolutions for a roller cone bit for risk estimation.

| | |
|---|---|
| Rule | |
| Short Description | Cumulative number of revolutions for a roller cone |
| Description | The risk of seal failure of a roller cone bit is increasing with increasing number of revolutions of the (sealed journal) roller cone bearing. In real life, the bearing can not exceed 750,000 revolutions. The total number of revolutions is used for risk calculations, |
| Formula | 1.1.1.1.Total revolutions = RPM*60*Hrs < 750,000 revolutions |
| Score | Calculate and display for each selected bit the number of revolutions. Risk is low for less than 600,000 revolutions Risk is medium for 600,000–700,000 revs Risk is high for more than 700,000 revs. |

BIT 2 Minimum Total Flow area

| | |
|---|---|
| Rule | |
| Short Description | Minimum nozzle size and Total Flow area |
| Description | The minimum nozzle size is 3 × 10/32 inch nozzles. Consequently the minimum Total Flow area is 0.23 sqinch |
| Formula | |
| Score | |

BIT 3 Extent bit section length in case casing point is within 125%

| | |
|---|---|
| Rule | |
| Short Description | Extent bit section length in case casing point is within 125% |
| Description | In order to prevent a short bit run to reach the casing point, the system should suggest to extent the proposed bit section length. The amount to extent should be limited to 1.25 times the originally proposed footage. Consequently, the risk is increased. |
| Formula | |
| Score | |

1. Tripping for bit . . . economics of pulling a bit versus continuing to drill . . . version 1.5

BIT 4 Hole sizes for bicenter and ream-while-drilling tools.

| | |
|---|---|
| Rule | |
| Short Description | Hole sizes for bicenter and ream-while-drilling tools. |
| Description | Bicenters and reamers can be used to drill a larger hole than the drift diameter of the previous casing. The "pass through" diameter needs to be smaller than the drift of the previous casing. ROP data should be based on hole diameter instead of pass through diameter. |

-continued

| Select Drilling Bits | Pass Through | Hole Diameter |
|---|---|---|
| | 17½ | 22 |
| | 14¾ | 17½ |
| | 12¼ | 14¾ |
| | 10⅝ | 12¼ |
| | 8½ | 9⅞ |
| | 6 | 7¼ |
| | 4¼ | 6¼ |
| Formula | | |
| Score | | |

Note that the pass through diameter corresponds with the nominal size of common drill bits.

The following information is optional, and is used only to populate WOB and RPM data in the Catalog:

$$WOB=-6.6067(UCS)^2+1231.9(UCS)+5000$$

$$RPM=0.0148(UCS)^2-2.997(UCS)+200$$

(for bits larger than 8½")

$$WOB=-1.8375UCS^2+424.81UCS+2000$$

$$RPM=0.0148UCS^2-2.997UCS+200$$

(for bits smaller than 8½")

Build in logic if UCS exceeds 100 kpsi than drilling parameters remain constant.

| Common bit sizes |
|---|
| Inch |
| 4½ |
| 4⅝ |
| 4¾ |
| 5⅝ |
| 5⅞ |
| 6 |
| 6⅛ |
| 6¼ |
| 6½ |
| 6¾ |
| 7⅝ |
| 7⅞ |
| 8⅜ |
| 8⅝ |
| 8¾ |
| 9 |
| 9½ |
| 9⅝ |
| 9⅞ |
| 10⅝ |
| 11 |
| 12 |
| 12¼ |
| 13¼ |
| 14½ |
| 14¾ |
| 15 |
| 16 |
| 17½ |
| 18½ |
| 20 |
| 22 |
| 24 |
| 26 |
| 36 |

Mining the BitTRAK Database:

Bits larger than 4½"

Only new bit, disregard the rerun bits (RR's)

The following are optional, used only to populate data in the Catalog:

Use only the records with a non-empty data field for the 1) IADC code 2) WOB Max, and 3) RPM Max Only bit sizes with more than 50 records Only records since January 1999. (note that the spud date has a lot of blank fields)

"Depth in" is positive number. If Depth In is negative, disregard the record

Footage is larger than 25 ft

Only hours larger than 10

Use "WOB Max" and "RPM Max" to calculate the average drilling parameters.

Ensure that the following rounding errors are not occurring. Obviously the records should be merged. The bit size should be expressible as a fraction. Enforce the closest fraction to the bit size.

4.75558 instead of 4¾

6.00456 instead of 6"

6.13064 instead of 6.125 (6⅛")

6.25672 instead of 6¼"

7.88 instead of 7.875 (or 7⅞")

8.50646 instead of 8½"

8.75862 instead of8¾"

etc

[1] Drill Bit Selection

Assumptions:

The following assumptions limits the number of bits in the BitTRAK catalog.

No air cooled bearings.

No roller bearing with gage protection: upgrade to the sealed roller bearing with gage protection.

Only sealed friction bearings with gage protection instead of the sealed friction bearings without gage protection.

Files to Use

The following files can be used to build the bit selector

1. "roller cone table vx"
2. "UCS to IADC"
3. "UCS data from earth model"

1.2. Selection Method

1. Select in the bit table the correct bit size.

For example a 12¼" bit (see Table 7 12¼" bits roller cone bits.).

2. Select the bit with the minimum KPSIFT for that bit size

For example: a IACD111 bit with 2134 KPSIFT with a footage of 1067 ft see Table 7 12¼" bits roller cone bits.

3. Compute from the UCS log:
   a. The cumulative KPSIFT (calculated by the sum of the multiplication of the UCS (in KPSI) and the depth interval (in feet)
   b. Determine the footage while the value of the cumulative KPSIFT is not exceeding the KPSIFT from the bit table.
   c. Determine that the UCS-footage corresponding to the cumulative KPSIFT is not exceeding the hole section footage In the example:

TABLE 1

UCS data related to IACD111 bit.

| Footage | KPSIFT | Excess | Cum KPSIFT |
|---|---|---|---|
| 650 | 39.72458 | 39.72458 | 1996.902 |
| 659 | 42.35698 | 42.35698 | 2039.259 |
| 669 | 14.2982 | 0 | 2053.557 |
| 679 | 14.26794 | 0 | 2067.825 |
| 689 | 115.5774 | 115.5774 | 2183.402 |
| 699 | 86.10659 | 86.10659 | 2269.509 |
| 709 | 125.4547 | 125.4547 | 2394.964 |

The cumulative KPSIFT of 2067 is the closest fit to the 2134 KPSIFT for the bit.

The corresponding calculated footage is 679 ft, less than the bit footage of 1067 ft.

d. If the bit footage exceeds the footage with equal KPSIFT, a bit with higher KPSIFT need to be selected. (or, alternatively a bit with a higher IADC classification. This needs to be investigated and addressed below.) As long as the footage is not exceeding the hole section repeat the described sequence with a second bit.

e. Ensure when selecting the IADC code for a bit, that it meets the following two criteria:
   1. The bit is not encountering formations exceeding the maximum UCS for more than 20 ft
   2. The bit is not encountering formations with a UCS lower than the specified minimum over a interval exceeding 50 ft.

In case the bit footage is less than the calculated footage from the UCS data, a bit with higher KPSIFT needs to be selected. In the example, the next 12¼" bit is an IACD115 with 2732 KPSIFT with a footage of 1366 ft.

TABLE 2

UCS data related to IADC115 and IADC117

| Footage | KPSIFT | Excess | Cum KPSIFT |
|---|---|---|---|
| 768 | 14.93143 | 0 | 2584.996 |
| 778 | 45.01108 | 45.01108 | 2630.007 |
| 787 | 45.52515 | 45.52515 | 2675.532 |
| 797 | 14.82596 | 0 | 2690.358 |
| 807 | 65.05947 | 65.05947 | 2755.418 |
| 817 | 14.26794 | 0 | 2769.686 |
| 827 | 220.1043 | 220.1043 | 2989.79 |
| 837 | 104.2346 | 104.2346 | 3094.025 |
| 846 | 38.57671 | 38.57671 | 3132.601 |
| 856 | 184.551 | 184.551 | 3317.152 |
| 866 | 14.26794 | 0 | 3331.42 |

The second bit corresponds with a cumulative KPSIFT of 2690, with 797 ft footage. This is still less than the average 1366 ft for this bit type. The third bit from the catalog is an IADC117 with 2904 KPSIFT and 1452 ft footage. This corresponds with 2770 KPSIFT and 817 ft, which is still less than the bit's footage. The forth bit has a cumulative KPSIFT of 8528 and 1066 for footage. Now, the footage of 1752 (with corresponding 8525 KPSIFT) exceeds the bit's footage.

TABLE 3

| UCS data related to IADC417 bit | | | |
|---|---|---|---|
| Footage | KPSIFT | Excess | Cum KPSIFT |
| 1713 | 114.8937 | 114.8937 | 8245.098 |
| 1722 | 72.11995 | 72.11995 | 8317.218 |
| 1732 | 76.65248 | 76.65248 | 8393.87 |
| 1742 | 57.09546 | 57.09546 | 8450.966 |
| 1752 | 74.17749 | 74.17749 | 8525.143 |
| 1762 | 61.46744 | 61.46744 | 8586.611 |
| 1772 | 66.07676 | 66.07676 | 8652.687 |
| 1781 | 79.78368 | 79.78368 | 8732.471 |

4. Compute the excess UCS over the bit's threshold. The bit selection is reduced to two candidates, each with a maximum UCS. In case the actual UCS per foot exceeds the maximum UCS of the particular bit, the summation of the difference is calculated. Negative difference between the actual UCS and bit's UCS is set to zero. The bit with the smallest cumulative excess over its threshold is selected for drilling the section.

In the example: The second criterion is used to make a choice between the third (IADC 117) and the forth bit (IADC417). The threshold for the IADC 117 is 2 KPSI, and the calculated cumulative excess pressure is 159 KPSI. The threshold for the IADC417 is 8 KPSI, and the calculated cumulative excess pressure is 125 KPSI. Therefore the IADC417 is selected. Note that in case the IADC137 (one category more aggressive than the IADC 117) was selected, the resulting footage would have been 2736 ft with an excess of 354 KPSI. In case of the next IADC code, the more aggressive bit.

TABLE 5

| Relation between the IADC code and the formation UCS including lower and upper limits | | | | | | |
|---|---|---|---|---|---|---|
| Min UCS | Max UCS | Avg UCS | IADC 1 | IADC 2 | IADC 3 | More than 50 ft under minimum, or more than 20 ft over the maximum |
| 0 | 25 | 2 | 117 | 111 | 115 | (111 for top hole. 117 is most common for 17 ½" and smaller) |
| 0 | 25 | 4 | 127 | 121 | | (121 only in 22" size. 127 is 5 times more common, especially in smaller sizes) |
| 0 | 25 | 6 | 131 | 135 | 137 | (not available in every size) |
| 0 | 30 | 8 | 417 | | | (415 is not that common, only in 17.5) |
| 0 | 35 | 10 | 427 | | | |
| 0 | 40 | 12 | 437 | 435 | | (437 is 8 times more common) |
| 0 | 40 | 14 | 447 | 445 | | (447 is 5 times more common than 445) |
| 5 | 50 | 16 | 517 | 515 | | (517 is 74 times more common than 515) |
| 5 | 50 | 18 | 527 | | | |
| 5 | 50 | 20 | 537 | 535 | | (537 is 177 times more common than 535) |
| 5 | 50 | 22 | 547 | | | |
| 10 | 60 | 24 | 617 | | | |
| 10 | 60 | 26 | 627 | | | |
| 10 | 60 | 28 | 637 | | | |
| 60 | 60 | 30 | 647 | | | |
| 15 | 70 | 33 | 717 | | | |
| 15 | 70 | 36 | 737 | | | |
| 15 | 70 | 40 | 747 | | | |
| 15 | 100 | 50 | 817 | | | |
| 20 | 100 | 60 | 837 | | | If formation contains >20 ft of chert, or pyrite, or quartzite |

TABLE 4

| UCS data related to IADC137 bit | | | |
|---|---|---|---|
| Footage | KPSIFT | Excess | Cum KPSIFT |
| 2707 | 78.74228 | 78.74228 | 14675.89 |
| 2717 | 62.11594 | 62.11594 | 14738.01 |
| 2726 | 72.90075 | 72.90075 | 14810.91 |
| 2736 | 158.7009 | 158.7009 | 14969.61 |
| 2746 | 117.0117 | 117.0117 | 15086.62 |
| 2756 | 96.08162 | 96.08162 | 15182.7 |
| 2766 | 20.21608 | 0 | 15202.92 |

5. Select the next bit to drill the remainder of the hole section. In order to select the next bit, the Cumulative K 1.2.1. Algorithm Refinements:

If the hole size is not present in the BitTRAK table then select the following bit size:

Select the bit size that is closest to the required hole size

With two candidates that are equally close to the required hole size, select the smallest bit size from the BitTRAK table If there is only one bit in the BitTRAK table for the required size that the algorithm has to select the bit (and use the calculated earth model KPSIFT)

1.2.2. Risk Assessment

Risk related to formation hardness is:

Low for Excess KPSIFT<10% of cumulative KPSIFT

Med for Excess KPSIFT>10% and <20% of cumulative KPSIFT

High for Excess KPSIFT>10% of cumulative KPSIFT

Risk related to bit footage is:

Low for UCS cumulative footage<1.2×bit table footage

Med for UCS cumulative footage<1.5×bit table footage

High for UCS cumulative footage<2×bit table footage

Summary Table

The '417 IADC code' bit set forth in the table below has the lowest excess KPSI and therefore the lowest risk. Swordfish should suggest the IADC417 bit. The method is to follow the sequence of bits with an increasing KPSIFT and not necessarily increasing IADC code.

TABLE 6

Summary table of bit selection

| | Bit table | | UCS data | | |
|---|---|---|---|---|---|
| IADC code | Bit KPSIFT | Bit Footage | Cum KPSIFT | Cum Footage | Excess KPSI |
| 111 | 2134 | 1067 | 2067 | 679 | N/A |
| 115 | 2732 | 1366 | 2690 | 797 | N/A |
| 117 | 2904 | 1452 | 2770 | 817 | 159 |
| 137 | 14952 | 2726 | 14810 | 2726 | 354 |
| 417 | 8528 | 1066 | 8525 | 1752 | 125 |

TABLE 7

12¼" bits roller cone bits.

| BIT_SIZE | IADC_ | # Record | Depth in | Depth Out | Footage | STDDEV | Footage Hours | ROP | Max UCS | KPSIFT |
|---|---|---|---|---|---|---|---|---|---|---|
| 12.25 | 111 | 414 | 2602 | 1870 | 1067 | 26.21 | 20.99 | 34.6 | 2 | 2134 |
| 12.25 | 115 | 172 | 5640 | 1827 | 1366 | 41.75 | 27.51 | 40.9 | 2 | 2732 |
| 12.25 | 117 | 1384 | 5731 | 2084 | 1452 | 48.29 | 36.85 | 38.5 | 2 | 2904 |
| 12.25 | 417 | 169 | 4252 | 1411 | 1066 | 41.47 | 26.42 | 32.8 | 8 | 8528 |
| 12.25 | 435 | 99 | 6638 | 1136 | 988 | 51.58 | 31.01 | 26.1 | 12 | 11856 |
| 12.25 | 515 | 53 | 6018 | 878 | 778 | 41.78 | 25.84 | 35.8 | 16 | 12448 |
| 12.25 | 427 | 63 | 7904 | 1776 | 1271 | 59.06 | 27.83 | 27.8 | 10 | 12710 |
| 12.25 | 137 | 88 | 5645 | 2432 | 2492 | 52.24 | 38.93 | 44.7 | 6 | 14952 |
| 12.25 | 437 | 992 | 7160 | 1638 | 1466 | 59.06 | 37.86 | 28 | 12 | 17592 |
| 12.25 | 445 | 132 | 6664 | 1598 | 1370 | 54.38 | 36.95 | 31.8 | 14 | 19180 |
| 12.25 | 517 | 1550 | 3521 | 6872 | 1340 | 1214 | 67.44 | 24.1 | 16 | 21440 |
| 12.25 | 547 | 658 | 5191 | 2280 | 1152 | 102.82 | 51.3 | 13.7 | 22 | 25344 |
| 12.25 | 737 | 54 | 7465 | 1869 | 926 | 100.03 | 46.59 | 15.9 | 36 | 33336 |
| 12.25 | 537 | 1212 | 3764 | 6437 | 1740 | 1360 | 77.58 | 26 | 20 | 34800 |
| 12.25 | 527 | 930 | 530 | 4936 | 2182 | 1307 | 98.5 | 26 | 18 | 39276 |
| 12.25 | 647 | 97 | 9684 | 923 | 1358 | 55.23 | 39.09 | 22.3 | 30 | 40740 |
| 12.25 | 617 | 449 | 7980 | 7181 | 1747 | 1460 | 86.11 | 22.3 | 24 | 41928 |
| 12.25 | 627 | 574 | 445 | 8202 | 1627 | 950 | 99.81 | 17.4 | 26 | 42302 |
| 12.25 | 447 | 548 | 7904 | 1377 | 3499 | 57.91 | 30.4 | 76.1 | 14 | 48986 |
| 12.25 | 637 | 96 | 7644 | 1923 | 2238 | 77.66 | 61.87 | 26.7 | 28 | 62664 |

1.2.3. RPM for PDM's.

In case a PDM is selected in the BHA design, the RPM differs from the lookup table. For the selected PDM (size and type), the RPM is calculated:

RPM = 60 + Qtest(Rev/Gal)

| Size | OD | Lobes | Stages | dPtest | Qtest | MW | dP w/H2O | Min flow | Max flow | Rev/gal |
|---|---|---|---|---|---|---|---|---|---|---|
| A287 | 2.875 | 5/6 | 3.3 | 140 | 80 | 8.34 | 190 | 20 | 130 | 6 |
| | 2.875 | 5/6 | 7.0 | 194 | 80 | 8.34 | 244 | 20 | 130 | 5.8 |
| | 2.875 | 7/8 | 3.2 | 191 | 90 | 8.34 | 241 | 30 | 130 | 4.2 |
| A350 | 3.5 | 4/5 | 5.0 | 138 | 100 | 8.34 | 188 | 30 | 160 | 3.3 |
| | 3.5 | 7/8 | 3.0 | 168 | 110 | 8.34 | 218 | 30 | 160 | 1.6 |
| A475 | 4.75 | 4/5 | 3.5 | 115 | 250 | 8.34 | 165 | 100 | 350 | 1.1 |
| | 4.75 | 4/5 | 6.0 | 151 | 250 | 8.34 | 201 | 100 | 350 | 1.1 |
| | 4.75 | 7/8 | 2.2 | 170 | 250 | 8.34 | 220 | 100 | 350 | 0.6 |
| A675 | 6.75 | 4/5 | 4.8 | 152 | 600 | 8.34 | 202 | 300 | 700 | 0.5 |
| | 6.75 | 4/5 | 7.0 | 184 | 600 | 8.34 | 234 | 300 | 700 | 0.5 |
| | 6.75 | 7/8 | 3.0 | 181 | 600 | 8.34 | 231 | 300 | 700 | 0.3 |
| | 6.75 | 7/8 | 5.0 | 210 | 600 | 8.34 | 260 | 300 | 700 | 0.3 |
| A800 | 8 | 4/5 | 3.6 | 151 | 900 | 8.34 | 201 | 300 | 1100 | 0.3 |
| | 8 | 4/5 | 5.3 | 175 | 900 | 8.34 | 225 | 300 | 1100 | 0.3 |

-continued

| | | | | | | | | | | |
|---|---|---|---|---|---|---|---|---|---|---|
| | | | | RPM = 60 + Qtest(Rev/Gal) | | | | | | |
| Size | OD | Lobes | Stages | dPtest | Qtest | MW | dP w/H2O | Min flow | Max flow | Rev/gal |
| | 8 | ⅞ | 3.0 | 218 | 900 | 8.34 | 268 | 300 | 1100 | 0.2 |
| | 8 | ⅞ | 4.0 | 233 | 900 | 8.34 | 283 | 300 | 1100 | 0.2 |
| A962 | 9.625 | ¾ | 4.5 | 300 | 900 | 8.34 | 350 | 600 | 1500 | 0.2 |
| | 9.625 | ¾ | 6.0 | 570 | 900 | 8.34 | 620 | 600 | 1500 | 0.2 |
| | 9.625 | ⅚ | 3.0 | 280 | 900 | 8.34 | 330 | 600 | 1500 | 0.1 |
| | 9.625 | ⅚ | 4.0 | 305 | 900 | 8.34 | 355 | 600 | 1500 | 0.1 |
| A1125 | 11.25 | ¾ | 3.6 | 395 | 1250 | 8.34 | 445 | 1000 | 1700 | 0.1 |

PDC Bit Selection

1. Characteristic Information

The following defines information that pertains to this particular use case. Each piece of information is important in understanding the purpose behind the Use Case.

| | |
|---|---|
| Goal In Context: | This use case describes the selection of PDC bits |
| Scope: | |
| Level: | Task |
| Pre-Condition: | The user has completed prior use cases and has data for mudline, total depth, UCS, and bit catalogs. |
| Success End Condition: | The system confirms to the user that IADC Code per section, estimated ROP and drilling section has been determined including the operating parameter ranges WOB, RPM. |
| Failed End Condition: | The system indicates to the user that the selection has failed. |
| Primary Actor: | The User |
| Trigger Event: | The user accepts the drill fluid selection |

Main Success Scenario

This Scenario describes the steps that are taken from trigger event to goal completion when everything works without failure. It also describes any required cleanup that is done after the goal has been reached. The steps are listed below:

| Step | Actor Action | System Response |
|---|---|---|
| 1 | The user accepts the last end condition | The system uses the algorithm described below to split the hole sections into bit runs and selects the appropriate drilling bits (including PDC bits) for each section based on rock properties, forecasts ROP and predicts bit life.<br>The system displays the results similar to the results currently displayed for the roller cone bits. |

Scenario Extensions

This is a listing of how each step in the Main Success Scenario can be extended. Another way to think of this is how can things go wrong. The extensions are followed until either the Main Success Scenario is rejoined or the Failed End Condition is met. The Step refers to the Failed Step in the Main Success Scenario and has a letter associated with it. I.E if Step 3 fails the Extension Step is 3a.

| Step | Condition | Action Description |
|---|---|---|
| 2a | | |
| 3a | | |

If a variation can occur in how a step is performed it will be listed here.

| Step | Variable | Possible Variations |
|---|---|---|
| | User modifies drilling performance | System updates the drilling performance |

Related Information

The following table gives the information that is related to the Use Case.

| | |
|---|---|
| Schedule: | Version 2004.1 |
| Priority: | Must |
| Performance Target: | N/A |
| Frequency: | Every time a new scenario is started. |
| Super Use Case: | Swordfish Use Case IPM I - Generate Well Inputs |
| Sub Use Case(s): | Roller cone bit selection |
| Channel To Primary Actor: | N/A |
| Secondary Actor(s): | N/A |
| Channel(s) To Secondary Actor(s): | N/A |

2. Assumptions and Limitations

Only PDC fixed cutter bits, no impregnated bits

The algorithm does not select between matrix or steel body PDC bits. However, the algorithm should be able to handle either one The PDC cutter size is assumed to be an indicator for the formation hardness. The reasoning is that most bits have a combination of cutter sizes and that a relative larger number of small cutters equips the bit to drill harder formations.

3. IADC Classification

The IADC classification consists of four characters, A, B, C and D.

| A Bit body | | B Formation type | | C Cutting structure | | D Bit profile. | |
|---|---|---|---|---|---|---|---|
| "M" | Matrix | 1 | Very soft | 2 | PDC, 19 mm | 1 | Short fishtail |
| "S" | Steel | | | 3 | PDC, 13 mm | 2 | Short profile |
| "D" | Diamond | | | 4 | PDC, 8 mm | 3 | Medium profile |
| | Example | 2 | Soft | 2 | PDC, 19 mm | 4 | Long profile |
| M | Matrix | | | 3 | PDC, 13 mm | | |
| 4 | Medium | | | 4 | PDC, 8 mm | | |
| 3 | PDC 13 mm | 3 | Soft to medium | 2 | PDC, 19 mm | | |
| 4 | Long profile | | | 3 | PDC, 13 mm | | |
| | | | | 4 | PDC, 8 mm | | |
| | | 4 | Medium | 2 | PDC, 19 mm | | |
| | | | | 3 | PDC, 13 mm | | |
| | | | | 4 | PDC, 8 mm | | |

The first character (A) is either M for Matrix body or S for Steel body PDC bits
The second numeric (B) indicates the formation hardness,
while the third numeric character (C) describes the cutter size. Both characters B and c are used in the alogorithm for the formation hardness.
The forth character (D) describes the bit profile ranging from short to long profile.

The first character (A) is either M for Matrix body or S for Steel body PDC bits The second numeric (B) indicates the formation hardness, while the third numeric character (C) describes the cutter size. Both character B and C are used in the algorithm for the formation hardness. The forth character (D) describes the bit profile ranging from short to long profile.

4. Algorithm

Similar to the roller cone bit selection, there is a relation assumed between the IADC classification for PDC bits and the Unconfined Compressive rock strength. In the interval the PDC bit should not drill formations with a UCS below the minimum UCS or above the Maximum UCS. The average UCS is used to find the optimum bit candidate.

| IADC | IADC | MIN UCS | AVG UCS | MAX UCS |
|---|---|---|---|---|
| M12 | 12 | 0 | 1.00 | 4 |
| M13 | 13 | 0 | 2.73 | 5 |
| M14 | 14 | 1 | 4.45 | 7 |
| M22 | 22 | 2 | 6.18 | 9 |
| M23 | 23 | 3 | 7.91 | 12 |
| M24 | 24 | 3 | 9.64 | 13 |
| M32 | 32 | 4 | 11.36 | 14 |
| M33 | 33 | 4 | 13.09 | 16 |
| M34 | 34 | 5 | 14.82 | 19 |
| M42 | 42 | 5 | 16.55 | 20 |
| M43 | 43 | 6 | 18.27 | 22 |
| M44 | 44 | 7 | 20.00 | 24 |

Refer now to FIG. 16.

Bit Profile Selection

The bit profile (Character D) is selected by computing the Directional Drilling Index (DDI). The algorithms to calculate the DDI is already implemented in the risk assessment task and is described below to be complete.

For each PDC bit candidate (selected based on the UCS criteria) the DDI is calculated. The maximum value of the DDI is used to filter out the PDC bits that do not qualify based on bit profile.

| DDI from | DDI to | Bit Profile | Profile description |
|---|---|---|---|
| - Infinity | 4 | 4 | Long |
| 4 | 5 | 3 | Medium |
| 5 | 6 | 2 | Short |
| 6 | 100 | 1 | Short fishtail |

Tentative classification values for the bit profile

5. Bit Economics

For each bit candidate the economics are calculated, taking into account the drilling performance and the tripping cost. This is similar to the selection method for roller cone bits.

6. Appendix

7. Preliminary PDC Bit Catalog

Below is a copy of the preliminary PDC bit catalog. The rollercone and PDC bits are listed in two separate bit catalogs.

| BIT_SIZE | BIT_TYPE | IADC | FOOTAGE | HOURS | ROP | AVG RPM | AVG WOB | KREV | MIN UCS | AVG UCS | MAX UCS | KPSIFT | BitCost |
|---|---|---|---|---|---|---|---|---|---|---|---|---|---|
| 8.5 | BD445 | M443 | 1305.0 | 21.6 | 60.4 | 100.0 | 12.5 | 129600 | 7 | 20.0 | 24 | 26100 | 35000 |
| 8.5 | DS110 | M323 | 2463.9 | 72.0 | 34.2 | 120.0 | 25.0 | 518400 | 4 | 11.4 | 14 | 27999 | 41040 |
| 8.5 | DS56 | M432 | 1625.0 | 44.1 | 68.5 | 110.8 | 19.6 | 293022 | 6 | 18.3 | 22 | 29692 | 25864 |
| 8.5 | FM2546 | M433 | 2076.0 | 68.5 | 30.3 | 80.0 | 10.0 | 328800 | 6 | 18.3 | 22 | 37934 | 25000 |
| 8.5 | G445 | M332 | 2290.0 | 14.0 | 163.6 | 80.0 | 10.0 | 67200 | 4 | 13.1 | 16 | 29979 | 35000 |
| 8.5 | G447 | M432 | 492.1 | 44.2 | 14.2 | 121.0 | 18.5 | 320455 | 6 | 18.3 | 22 | 8993 | 30429 |
| 8.5 | K33 | M432 | 179.0 | 38.6 | 4.6 | 120.0 | 27.0 | 761497 | 6 | 18.3 | 22 | 3271 | 36957 |
| 8.5 | K33B | M432 | 161.0 | 35.0 | 4.6 | 167.5 | 34.0 | 351750 | 6 | 18.3 | 22 | 2942 | 26000 |

-continued

| BIT_SIZE | BIT_TYPE | IADC | FOOTAGE | HOURS | ROP | AVG RPM | AVG WOB | KREV | MIN UCS | AVG UCS | MAX UCS | KPSIFT | BitCost |
|---|---|---|---|---|---|---|---|---|---|---|---|---|---|
| 9.875 | DS56 | M432 | 2092.0 | 83.7 | 25.0 | 104.4 | 13.2 | 524352 | 6 | 18.3 | 22 | 38226 | 35000 |
| 9.875 | DS59 | M432 | 1515.1 | 60.6 | 25.0 | 110.0 | 11.4 | 400117 | 6 | 18.3 | 22 | 27685 | 35000 |
| 9.875 | DS70 | M432 | 2367.9 | 94.7 | 25.0 | 116.2 | 10.2 | 660307 | 6 | 18.3 | 22 | 43268 | 35000 |
| 9.875 | G447 | M432 | 1798.0 | 71.9 | 25.0 | 89.6 | 11.8 | 386590 | 6 | 18.3 | 22 | 32855 | 35000 |
| 9.875 | LP661 | M432 | 2088.0 | 83.5 | 25.0 | 130.0 | 25.0 | 651456 | 6 | 18.3 | 22 | 38153 | 35000 |

Directional Drillability Index (per depth)

Short Name: DDI

Category: Stuck, Mechanical

Calculation: Calculate the DDI using the "Resample data"

Note: The DDI is calculated for the entire well. Therefore, the DDI is not displayed as a risk track, but displayed in the risk summary overview.

$$DDI = \mathrm{LOG}_{10}\left[\frac{MD \times AHD \times \mathrm{TORTUOSITY}}{TVD}\right]$$

MD, TVD in meters (or feet???)

$$\text{Tortuosity: } TOR = \sum_i DLS_i$$

AHD=Along hole displacement. In Swordfish, the AHD will be calculated using the Pythagorean principle (using the resample data)

$$AHD = \sum_{n=i}\left[\sqrt{(X_{n+1} - X_n)^2 + (Y_{n+1} - Y_n)^2}\right]$$

High: DDI>6.8

Medium DDI<6.8 and >6

Low: DDI<6

8. Alternative Classification for the Bit Profile Selection

This selection method is based on using simply the dogleg severity to determine the bit profile.

| DLS from | DLS to | Bit Profile |
|---|---|---|
| 0 | 0.5 | 4 |
| 0 | 1 | 3 |
| 0.5 | 2 | 2 |
| 1 | 10 | 1 |

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of generating and recording or displaying a sequence of drill bits, chosen from among a plurality of bit candidates to be used, for drilling an Earth formation in response to input data representing Earth formation characteristics of the formation to be drilled, comprising the steps of:

comparing said input data representing said characteristics of the formation to be drilled with a set of historical data including a plurality of sets of Earth formation characteristics and a corresponding plurality of sequences of drill bits to be used in connection with said sets of Earth formation characteristics, and, using statistical processing, locating a substantial match between said characteristics of the formation to be drilled associated with said input data and at least one of said plurality of sets of Earth formation characteristics associated with said set of historical data, wherein the Earth formation characteristics include rock strength;

when said substantial match is found, generating one of said plurality of sequences of drill bits in response thereto; and recording or displaying said one of said plurality of sequences of drill bits on a recorder or display device.

2. The method of claim 1, wherein the comparing step comprises the step of: verifying a hole size and filtering out bit sizes that do not match the hole size.

3. The method of claim 1, wherein the comparing step comprises the step of: checking if a bit is not drilling beyond a casing point.

4. The method of claim 1, wherein the comparing step comprises the step of: checking a cumulative mechanical drilling energy for a bit run and comparing said cumulative mechanical drilling energy with a statistical mechanical drilling energy for said bit, and assigning a proper risk to said bit run.

5. The method of claim 1, wherein the comparing step comprises the step of: checking cumulative bit revolutions and comparing said cumulative bit revolutions with statistical bit revolutions for a bit type and assigning a proper risk to said bit run.

6. The method of claim 1, wherein the comparing step comprises the step of: verifying that an encountered rock strength is not outside a range of rock strengths that is optimum for a selected bit type.

7. The method of claim 1, wherein the comparing step comprises the step of: extending a footage by approximately 25% in the event that a casing point can be reached by a last selected bit.

8. The method of claim 1, wherein the comparing step comprises the step of: reading variables and bit selection constants and bit selection catalogs and building a cumulative rock strength curve from casing point to casing point using the following equation: 23 CumUCS=start end (UCS) ft.

9. The method of claim 1, wherein the comparing step comprises the step of: determining a required hole size and finding bit candidates that match a closest unconfined compressive strength of a rock to drill.

10. The method of claim 1, wherein the comparing step comprises the step of: determining an end depth of a bit by comparing a historical drilling energy with a cumulative rock strength curve for all bit candidates.

11. The method of claim 1, wherein the comparing step comprises the step of: calculating a cost per foot for each bit candidate taking into account a rig rate, trip speed, and drilling rate of penetration, using the following equation: 24 TOT Cost=(RIG RATE+SPREAD RATE)(T_TripIn+footage ROP+T_Trip)+Bit Cost.

12. The method of claim 1, wherein the comparing step comprises the step of: evaluating which bit candidate is most economic.

13. The method of claim 1, wherein the comparing step comprises the step of: calculating a remaining cumulative rock strength to casing point.

14. The method of claim 1, wherein the comparing step comprises the step of: (a) finding bit candidates that match a closest unconfined compressive strength of a rock to drill; (b) determining an end depth of a bit by comparing a historical drilling energy with a cumulative rock strength curve for all bit candidates; (c) calculating a cost per foot for each bit candidate taking into account a rig rate, trip speed, and drilling rate of penetration, using the following equation: 25 TOT Cost=(RIG RATE+SPREAD RATE)(T_TripIn+footage ROP+T_Trip)+Bit Cost ;(d) evaluating which bit candidate is most economic; (e) calculating a remaining cumulative rock strength to casing point; and (f) repeating steps (a) through (e) until an end of a hole section is reached.

15. The method of claim 1, wherein the comparing step comprises the step of: building a cumulative unconfined compressive strength.

16. The method of claim 1, wherein the comparing step comprises the step of: selecting bits, and displaying bit performance and operating parameters.

17. The method of claim 1, wherein the comparing step comprises the step of: removing sub-optimum drill bits.

18. The method of claim 1, wherein the comparing step comprises the step of: finding a most economic bit based on cost per foot.

19. The method of claim 1, wherein said input data is selected from a group consisting of: Measured Depth, Unconfined Compressive Strength, Casing Point Depth, Hole Size, Conductor, Casing Type Name, Casing Point, Day Rate Rig, Spread Rate Rig, and Hole Section Name.

20. The method of claim 1, wherein the method of generating and recording or displaying a sequence of drill bits chosen from among a plurality of bit candidates to be used comprises the further step of: generating and recording or displaying a set of bit selection output data, where said bit selection output data is selected from a group consisting of: Measured Depth, Cumulative Unconfined Compressive Strength (UCS), Cumulative Excess UCS, Bit Size, Bit Type, Start Depth, End Depth, Hole Section Begin Depth, Average UCS of rock in section, Maximum UCS of bit, BitAverage UCS of rock in section, Footage, Statistical Drilled Footage for the bit, Ratio of footage drilled compared to statistical footage, Statistical Bit Hours, On Bottom Hours, Rate of Penetration (ROP), Statistical Bit Rate of Penetration (ROP), Mechanical drilling energy, Weight On Bit, Revolutions per Minute (RPM), Statistical Bit RPM, Calculated Total Bit Revolutions, Time to Trip, Cumulative Excess as a ration to the Cumulative UCS, Bit Cost, and Hole Section Name.

21. A program storage device readable by a machine tangibly embodying a program of instructions executable by the machine to perform method steps for generating and recording or displaying a sequence of drill bits, chosen from among a plurality of bit candidates, for drilling an Earth formation in response to input data representing Earth formation characteristics of the formation to be drilled, said method steps comprising:

comparing said input data representing said characteristics of the formation to be drilled with a set of historical data including a plurality of sets of Earth formation characteristics and a corresponding plurality of sequences of drill bits to be used in connection with said sets of Earth formation characteristics, and locating a substantial match, using statistical processing, between said characteristics of the formation to be drilled associated with said input data and at least one of said plurality of sets of Earth formation characteristics associated with said set of historical data, wherein the Earth formation characteristics includes rock strength;

when said substantial match is found, generating one of said plurality of sequences of drill bits in response thereto; and recording or displaying said one of said plurality of sequences of drill bits on a recorder or display device.

22. The program storage device of claim 21, wherein the comparing step comprises the step of: verifying a hole size and filtering out bit sizes that do not match the hole size.

23. The program storage device of claim 21, wherein the comparing step comprises the step of: checking if a bit is not drilling beyond a casing point.

24. The program storage device of claim 21, wherein the comparing step comprises the step of: checking a cumulative mechanical drilling energy for a bit run and comparing said cumulative mechanical drilling energy with a statistical mechanical drilling energy for said bit, and assigning a proper risk to said bit run.

25. The program storage device of claim 21, wherein the comparing step comprises the step of: checking cumulative bit revolutions and comparing said cumulative bit revolutions with statistical bit revolutions for a bit type and assigning a proper risk to said bit run.

26. The program storage device of claim 21, wherein the comparing step comprises the step of: verifying that an encountered rock strength is not outside a range of rock strengths that is optimum for a selected bit type.

27. The program storage device of claim 21, wherein the comparing step comprises the step of: extending a footage by approximately 25% in the event that a casing point can be reached by a last selected bit.

28. The program storage device of claim 21, wherein the comparing step comprises the step of: reading variables and bit selection constants and bit selection catalogs and building a cumulative rock strength curve from casing point to casing point using the following equation: 26 CumUCS=start end (UCS) ft.

29. The program storage device of claim 21, wherein the comparing step comprises the step of: determining a required hole size and finding bit candidates that match a closest unconfined compressive strength of a rock to drill.

30. The program storage device of claim 21, wherein the comparing step comprises the step of: determining an end depth of a bit by comparing a historical drilling energy with a cumulative rock strength curve for all bit candidates.

31. The program storage device of claim 21, wherein the comparing step comprises the step of: calculating a cost per foot for each bit candidate taking into account a rig rate, trip speed, and drilling rate of penetration, using the following equation: 27 TOT Cost=(RIG RATE+SPREAD RATE)(T_TripIn+footage ROP+T_Trip)+Bit Cost.

32. The program storage device of claim 21, wherein the comparing step comprises the step of: evaluating which bit candidate is most economic.

33. The program storage device of claim 21, wherein the comparing step comprises the step of: calculating a remaining cumulative rock strength to casing point.

34. The program storage device of claim 21, wherein the comparing step comprises the step of: (a) finding bit candidates that match a closest unconfined compressive strength of a rock to drill; (b) determining an end depth of a bit by comparing a historical drilling energy with a cumulative rock strength curve for all bit candidates; (c) calculating a cost per foot for each bit candidate taking into account a rig rate, trip speed, and drilling rate of penetration, using the following equation: 28 TOT Cost=(RIG RATE+SPREAD RATE)(T_TripIn+footage ROP +T_Trip)+Bit Cost; (d) evaluating which bit candidate is most economic; (e) calculating a remaining cumulative rock strength to casing point; and (f) repeating steps (a) through (e) until an end of a hole section is reached.

35. The program storage device of claim 21, wherein the comparing step comprises the step of: building a cumulative unconfined compressive strength.

36. The program storage device of claim 21, wherein the comparing step comprises the step of: selecting bits, and displaying bit performance and operating parameters.

37. The program storage device of claim 21, wherein the comparing step comprises the step of: removing sub-optimum drill bits.

38. The program storage device of claim 21, wherein the comparing step comprises the step of: finding a most economic bit based on cost per foot.

39. The program storage device of claim 21, wherein said input data is selected from a group consisting of: Measured Depth, Unconfined Compressive Strength, Casing Point Depth, Hole Size, Conductor, Casing Type Name, Casing Point, Day Rate Rig, Spread Rate Rig, and Hole Section Name.

40. The program storage device of claim 21, wherein the steps of generating and recording or displaying a sequence of drill bits chosen from among a plurality of bit candidates to be used comprises the further step of: generating and recording or displaying a set of bit selection output data, where said bit selection output data is selected from a group consisting of: Measured Depth, Cumulative Unconfined Compressive Strength (UCS), Cumulative Excess UCS, Bit Size, Bit Type, Start Depth, End Depth, Hole Section Begin Depth, Average UCS of rock in section, Maximum UCS of bit, BitAverage UCS of rock in section, Footage, Statistical Drilled Footage for the bit, Ratio of footage drilled compared to statistical footage, Statistical Bit Hours, On Bottom Hours, Rate of Penetration (ROP), Statistical Bit Rate of Penetration (ROP), Mechanical drilling energy, Weight On Bit, Revolutions per Minute (RPM), Statistical Bit RPM, Calculated Total Bit Revolutions, Time to Trip, Cumulative Excess as a ration to the Cumulative UCS, Bit Cost, and Hole Section Name.

41. A method of selecting one or more drill bits to drill in an Earth formation, comprising the steps of:

(a) reading variables and constants, (b) reading catalogs, (c) building a cumulative rock strength curve from casing point to casing point, (d) determining a required hole size, (e) finding the bit candidates that match the closest unconfined compressive strength of a rock to drill, (f) determining an end depth of a bit by comparing a historical drilling energy with a cumulative rock strength curve for all bit candidates, (g) calculating a cost per foot for each bit candidate taking into account the rig rate, trip speed and drilling rate of penetration, (h) evaluating which bit candidate is most economic, (i) calculating a remaining cumulative rock strength to casing point, and (j) repeating steps (e) to (i) until an end of the hole section is reached.

42. The method of claim 41, further comprising the steps of: (k) building a cumulative rock strength curve (Cum UCS), (l) selecting bits, and displaying bit performance and operating parameters, (m) removing sub-optimum bits, and (n) finding a most economic bit based on cost per foot.

43. The method of claim 42, wherein the building step (c) far building a cumulative rock strength curve from casing point to casing point uses the following equation: 29 CumUCS=start end (UCS ) ft.

44. The method of claim 43, wherein the calculating step (g) for calculating a cost per foot for each bit candidate taking into account the rig rate, trip speed and drilling rate of penetration uses the following equation: 30 TOT Cost=(RIG RATE+SPREAD RATE)(T_TripIn+footage ROT+T_Trip)+Bit Cost.

45. A program storage device readable by a machine tangibly embodying a program of instructions executable by the machine to perform method steps for selecting one or more drill bits to drill in an Earth formation, said method steps comprising:

(a) reading variables and constants, (b) reading catalogs, (c) building a cumulative rock strength curve from casing point to casing point, (d) determining a required hole size, (e) finding the bit candidates that match the closest unconfined compressive strength of a rock to drill, (f) determining an end depth of a bit by comparing a historical drilling energy with a cumulative rock strength curve for all bit candidates, (g) calculating a cost per foot for each bit candidate taking into account the rig rate, trip speed and drilling rate of penetration, (h) evaluating which bit candidate is most economic, (i) calculating a remaining cumulative rock strength to casing point, and (j) repeating steps (e) to (i) until an end of the hole section is reached.

46. The program storage device of claim 45, further comprising the steps of: (k) building a cumulative rock strength curve (Cum UCS), (l) selecting bits, and displaying bit performance and operating parameters, (m) removing sub-optimum bits, and (n) finding a most economic bit based on cost per foot.

47. The program storage device of claim 46, wherein the building step (c) for building a cumulative rock strength curve from casing point to casing point uses the following equation: 31 CumUCS=star end (UCS) ft.

48. The method of claim 47, wherein the calculating step (g) for calculating a cost per foot for each bit candidate taking into account the rig rate, trip speed and drilling rate of penetration uses the following equation: 32 TOT Cost=(RIG RATE+SPREAD RATE )(T_TripIn+footage ROP+T_Trip)+Bit Cast.

49. A method of selecting a bit to drill an Earth formation, comprising the steps of:

(a) receiving a list of bit candidates and determining an average rock strength for each bit candidate;

(b) determining a resultant cumulative rock strength for said each bit candidate in response to the average rock strength for said each bit candidate;

(c) performing an economic analysis in connection with said each bit candidate to determine if said each bit candidate is an inexpensive bit candidate; and (d) selecting said each bit candidate to be said bit to drill said Earth formation when said resultant cumulative rock strength is greater than or equal to a predetermined value and said each bit candidate is an inexpensive bit candidate.

50. A program storage device readable by a machine tangibly embodying a program of instructions executable by the machine to perform method steps for selecting a bit to drill an Earth formation, said method steps comprising:

(a) receiving a list of bit candidates and determining an average rock strength for each bit candidate;

(b) determining a resultant cumulative rock strength for said each bit candidate in response to the average rock strength for said each bit candidate;

(c) performing an economic analysis in connection with said each bit candidate to determine if said each bit candidate is an inexpensive bit candidate; and (d) selecting said each bit candidate to be said bit to drill said Earth formation when said resultant cumulative rock strength is greater than or equal to a predetermined value and said each bit candidate is an inexpensive bit candidate.

51. A system adapted for selecting a bit to drill an Earth formation, comprising:

apparatus adapted for receiving a list of bit candidates and determining an average rock strength for each bit candidate;

apparatus adapted for determining a resultant cumulative rock strength for said each bit candidate in response to the average rock strength for said each bit candidate;

apparatus adapted for performing an economic analysis in connection with said each bit candidate to determine if said each bit candidate is an inexpensive bit candidate; and apparatus adapted for selecting said each bit candidate to be said bit to drill said Earth formation when said resultant cumulative rock strength is greater than or equal to a predetermined value and said each bit candidate is an inexpensive bit candidate.

* * * * *